US010449410B2

(12) United States Patent
Hamilton

(10) Patent No.: US 10,449,410 B2
(45) Date of Patent: Oct. 22, 2019

(54) ROWING MACHINE

(71) Applicant: Anthony Carl Hamilton, Hitchin (GB)

(72) Inventor: Anthony Carl Hamilton, Hitchin (GB)

( * ) Notice: Subject to any disclaimer, the term of this patent is extended or adjusted under 35 U.S.C. 154(b) by 111 days.

(21) Appl. No.: 15/558,034

(22) PCT Filed: Mar. 10, 2016

(86) PCT No.: PCT/EP2016/055167
§ 371 (c)(1),
(2) Date: Sep. 13, 2017

(87) PCT Pub. No.: WO2016/146480
PCT Pub. Date: Sep. 22, 2016

(65) Prior Publication Data

US 2018/0056117 A1 Mar. 1, 2018

(30) Foreign Application Priority Data

Mar. 13, 2015 (GB) ..... 1504292.2
Dec. 7, 2015 (GB) ..... 1521545.2

(51) Int. Cl.
*A63B 22/00* (2006.01)
*A63B 69/06* (2006.01)
(Continued)

(52) U.S. Cl.
CPC ..... *A63B 22/0076* (2013.01); *A63B 21/008* (2013.01); *A63B 21/00072* (2013.01);
(Continued)

(58) Field of Classification Search
CPC ..... A63B 22/0076; A63B 21/00072; A63B 71/0622; A63B 21/4035; A63B 21/00192;
(Continued)

(56) References Cited

U.S. PATENT DOCUMENTS 4,047,715 A * 9/1977 Gjessing ..... A61B 5/224 482/64
4,396,188 A * 8/1983 Dreissigacker .... A63B 22/0076 482/110
(Continued)

FOREIGN PATENT DOCUMENTS

CN 2728571 Y 9/2005
CN 2868354 Y 2/2007
(Continued)

OTHER PUBLICATIONS

International Search Report and Written Opinion for PCT Application No. PCT/EP2016/055167, dated Jul. 8, 2016.
(Continued)

*Primary Examiner* — Garrett K Atkinson
(74) *Attorney, Agent, or Firm* — Knobbe, Martens, Olson & Bear LLP

(57) ABSTRACT

A rowing machine comprising: a main body portion extending along a longitudinal axis from a first end of the rowing machine to a second end of the rowing machine; a seat portion; a handle portion; the seat portion and handle portion configured to enable a user to simulate a rowing motion during use of the rowing machine; wherein the rowing machine comprises at least one mechanism configured for transferring a pitching motion to a user relative to said longitudinal axis, during use of the rowing machine.

16 Claims, 53 Drawing Sheets

(51) Int. Cl.

| | |
|---|---|
| ***A63B 21/00*** | (2006.01) |
| ***A63B 21/22*** | (2006.01) |
| ***A63B 22/16*** | (2006.01) |
| ***A63B 21/008*** | (2006.01) |
| ***A63B 71/06*** | (2006.01) |
| ***A63B 71/00*** | (2006.01) |

(52) U.S. Cl.

CPC .... *A63B 21/0088* (2013.01); *A63B 21/00192* (2013.01); *A63B 21/154* (2013.01); *A63B 21/157* (2013.01); *A63B 21/225* (2013.01); *A63B 21/4035* (2015.10); *A63B 22/16* (2013.01); *A63B 69/06* (2013.01); *A63B 71/0622* (2013.01); *A63B 21/00069* (2013.01); *A63B 21/4034* (2015.10); *A63B 22/0087* (2013.01); *A63B 71/0619* (2013.01); *A63B 2022/0035* (2013.01); *A63B 2022/0041* (2013.01); *A63B 2022/0079* (2013.01); *A63B 2022/0082* (2013.01); *A63B 2071/0063* (2013.01); *A63B 2071/065* (2013.01); *A63B 2208/0238* (2013.01); *A63B 2209/08* (2013.01); *A63B 2210/50* (2013.01); *A63B 2220/20* (2013.01); *A63B 2220/24* (2013.01); *A63B 2220/30* (2013.01); *A63B 2220/53* (2013.01); *A63B 2220/62* (2013.01); *A63B 2225/09* (2013.01); *A63B 2225/093* (2013.01); *A63B 2225/107* (2013.01); *A63B 2230/75* (2013.01)

(58) Field of Classification Search

CPC ... A63B 21/008; A63B 21/0088; A63B 69/06; A63B 21/225; A63B 22/16; A63B 21/154; A63B 21/157; A63B 2220/62; A63B 2225/107; A63B 2208/0238; A63B 2230/75; A63B 2225/093; A63B 2220/53; A63B 2220/30; A63B 2220/24; A63B 2220/20; A63B 2071/065; A63B 2071/0063; A63B 71/0619; A63B 2022/0079; A63B 2022/0041; A63B 2022/0035; A63B 22/0087; A63B 21/4034; A63B 21/00069; A63B 2022/0082; A63B 2209/08; A63B 2210/50; A63B 2225/09

See application file for complete search history.

(56) References Cited

U.S. PATENT DOCUMENTS

| | | | | | |
|---|---|---|---|---|---|
| 4,650,181 | A * | 3/1987 | Yang | A63B 22/0076 | 482/148 |
| 4,871,164 | A * | 10/1989 | Tseng | A63B 22/0002 | 482/62 |
| 5,098,040 | A * | 3/1992 | Retat | A63B 71/0054 | 244/171.9 |
| 5,382,210 | A * | 1/1995 | Rekers | A63B 21/157 | 482/125 |
| 5,441,469 | A * | 8/1995 | Chern | A63B 22/0076 | 482/72 |
| 5,779,600 | A * | 7/1998 | Pape | A63B 22/0076 | 482/119 |
| 5,961,423 | A * | 10/1999 | Sellers | A63B 22/001 | 482/52 |
| 6,676,579 | B1 * | 1/2004 | Lin | A63B 22/0012 | 482/146 |
| 7,591,766 | B2 * | 9/2009 | Ellis | A63B 21/153 | 482/72 |
| 7,731,637 | B2 * | 6/2010 | D'Eredita | A63B 21/154 | 482/138 |
| 7,946,964 | B2 * | 5/2011 | Gothro | A63B 22/16 | 434/60 |
| 8,192,332 | B2 * | 6/2012 | Baker | A63B 22/0076 | 482/133 |
| 8,371,992 | B2 * | 2/2013 | Irving | A63B 21/015 | 482/57 |
| 9,302,148 | B1 * | 4/2016 | Vujicic | A63B 22/0605 | |
| 9,623,279 | B2 * | 4/2017 | Domeika | A63B 69/06 | |
| 10,080,919 | B1 * | 9/2018 | Vujicic | F16F 15/30 | |
| 2003/0166438 | A1 * | 9/2003 | Gramaccioni | A63B 21/225 | 482/72 |
| 2005/0170939 | A1 * | 8/2005 | Lin | A63B 23/0211 | 482/148 |
| 2008/0020736 | A1 * | 1/2008 | Kim | H04M 1/274558 | 455/412.1 |
| 2009/0017994 | A1 * | 1/2009 | Ellis | A63B 21/153 | 482/72 |
| 2009/0203503 | A1 * | 8/2009 | Gothro | A63B 22/16 | 482/72 |
| 2010/0190615 | A1 * | 7/2010 | Baker | A63B 22/0076 | 482/73 |
| 2010/0288901 | A1 * | 11/2010 | Wallach | A63B 22/0076 | 248/346.03 |
| 2011/0281694 | A1 * | 11/2011 | Vujicic | A63B 21/225 | 482/63 |
| 2012/0100965 | A1 * | 4/2012 | Dreissigacker | A63B 21/0088 | 482/72 |
| 2013/0017932 | A1 * | 1/2013 | Tayebi | A63B 69/06 | 482/94 |
| 2013/0035216 | A1 * | 2/2013 | Campbell | A63B 22/0076 | 482/72 |
| 2014/0336011 | A1 * | 11/2014 | Singh | A63B 22/0076 | 482/72 |
| 2015/0258366 | A1 * | 9/2015 | Domeika | A63B 69/06 | 482/72 |
| 2016/0361602 | A1 * | 12/2016 | Lagree | A63B 24/0087 | |

FOREIGN PATENT DOCUMENTS

| | | |
|---|---|---|
| CN | 202951174 U | 5/2013 |
| EP | 1557205 | 1/2004 |
| GB | 406123 | 1/1933 |
| GB | 2191103 | 12/1987 |
| GB | 2238001 | 5/1991 |
| WO | WO 2004/112918 | 12/2004 |
| WO | WO 2014/054931 | 4/2014 |
| WO | WO 2014/196870 | 12/2014 |
| WO | WO 2016/091827 | 6/2016 |
| WO | WO 2016/146480 | 9/2016 |

OTHER PUBLICATIONS

Combined Search and Examination Report for application No. GB1713971.8, dated Nov. 9, 2017, in 5 pages.

Combined Search and Examination Report under Section 17 & 18(3) for application No. GB1521545.2, dated Sep. 1, 2016.

* cited by examiner

641

642

ROWING MACHINE

CROSS-REFERENCE TO RELATED APPLICATIONS

This application is a national stage application of International Patent Application No. PCT/EP2016/055167, filed Mar. 10, 2016, which claims priority to Great Britain Patent Application No. 1504292.2, filed Mar. 13, 2015, and Great Britain Patent Application No. 1521545.2, filed Dec. 7, 2015; the disclosures of which are hereby incorporated by reference in their entireties.

This application relates to a rowing machine and a rowing machine system.

BACKGROUND

Rowing machines are typically used in the home or gym to simulate the action of rowing a rowing-boat. Rowing machines are popular for fitness and strength training. Rowing machines are also used by high-level rowers for conditioning, in addition to on-water training.

An example of a rowing machine is the Concept 2®. The Concept 2® rowing machine comprises a slidable seat portion, a footplate, and a handle portion connected to a resistance mechanism by a cable. A user can simulate a rowing action on the rowing machine by pulling on the handle portion and pushing against the footplate, causing the seat portion to reciprocate back and forth. The resistance mechanism is intended to recreate the feeling of moving an oar through water during a rowing stroke.

Concept 2® rowing machines are also known to provide information feedback to a user during use, for example information such as speed, distance travelled, calories burned etc.

Rowing machines are a popular form of exercise, in particular as they provide an upper body, lower body, and cardiovascular workout simultaneously.

SUMMARY

According to a first aspect there is provided a rowing machine comprising: a main body portion extending along a longitudinal axis from a first end of the rowing machine to a second end of the rowing machine; a seat portion; a handle portion; the seat portion and the handle portion configured to enable a user to simulate a rowing motion during use of the rowing machine; wherein the rowing machine comprises at least one mechanism configured for transferring a pitching motion to a user relative to said longitudinal axis, during use of the rowing machine.

According to some embodiments, said at least one mechanism is further configured for transferring a rolling motion to a user relative to said longitudinal axis, during use of said rowing machine.

According to some embodiments, the rowing machine comprises a pitching mechanism for enabling said pitching motion and a rolling mechanism for enabling said rolling motion.

According to some embodiments, said pitching mechanism comprises a spring and/or a damper arrangement.

According to some embodiments, said rolling mechanism comprises a rotatable bearing assembly.

According to some embodiments, the rolling mechanism comprises a damping mechanism to dampen and/or limit rolling.

According to some embodiments, said damping mechanism of the rolling mechanism comprises one or more resilient bump-stops.

According to some embodiments, said at least one mechanism comprises at least one mechanism at said first end of said rowing machine and at least one mechanism at said second end of said rowing machine.

According to some embodiments, said at least one mechanism at said first end of said rowing machine comprises a pitching mechanism and a rolling mechanism, and said at least one mechanism at said second end of said rowing machine comprises a pitching mechanism and a rolling mechanism.

According to some embodiments, the rowing machine comprises a rail portion extending parallel to said longitudinal axis, said rail portion being suspended relative to said main body portion of said rowing machine between said first and second ends of the rowing machine.

According to some embodiments, said rail portion has a first end configured to be mounted proximate to the first end of the rowing machine, and said rail portion having a second end configured to be mounted proximate to the second end of the rowing machine, said rail portion comprising a trough portion between said first end of said rail portion and said second end of said rail portion.

According to some embodiments, said rail portion is suspended relative to said main body portion via said at least one mechanism.

According to some embodiments, said rowing machine comprises a footplate assembly.

According to some embodiments, said rowing machine comprises a footplate assembly, said footplate assembly being connected to said rail portion.

According to some embodiments, said footplate assembly is slidably connected to said rail portion.

According to some embodiments, said seat portion is operatively connected to said rail portion.

According to some embodiments, said seat portion is slidable on said rail portion.

According to some embodiments, the rowing machine comprises a further rail portion mounted to said rail portion, said seat portion being slidable on said further rail portion.

According to some embodiments, at least one of said seat portion and said handle portion are operatively connected to a resistance mechanism.

According to some embodiments, said resistance mechanism comprises a flywheel having one or more vanes connected to a central shaft.

According to some embodiments, said handle portion is operatively connected to said flywheel via a gear mechanism.

According to some embodiments, said gear mechanism comprising a first gear and a second gear, and a drive connection between the first gear and the second gear, the first gear being driven by movement of the handle portion and the second gear being operatively connected to said central shaft of said flywheel, the second gear having a radius that is smaller than a radius of the first gear, such that a speed of rotation of the second gear and the flywheel is greater than a speed of rotation of the first gear, during use of the rowing machine.

According to some embodiments, at least one of said seat portion and said handle portion are operatively connected to a resistance mechanism, wherein said resistance mechanism comprises a flywheel having one or more vanes connected to a central shaft.

According to some embodiments, a radius of said one or more vanes is less than a minimum vertical distance between said central shaft and a top surface of said rail portion.

According to some embodiments, said handle portion is interchangeable with one or more different handle portions.

According to some embodiments, said handle portion comprises at least one oar member.

According to some embodiments, said handle portion is interchangeable between a sweep configuration and a sculling configuration.

According to some embodiments, the rowing machine comprises a display for displaying information to said user.

According to some embodiments, said display is configured to receive information from said mechanism, and to display information relating to said information received from said at least one mechanism.

According to some aspects there is provided a rowing machine system comprising: two or more rowing machines as set forth in the first aspect, connected in series.

According to a third aspect there is provided a rowing machine comprising: a main body portion extending longitudinally from a first end to a second end of the rowing machine, so as to define a longitudinal axis of the rowing machine; a seat portion; a first handle portion; a second handle portion; said seat portion and said first and second handle portions being configured to enable a user to simulate a rowing motion during use of said rowing machine; said first handle portion being operatively connected to a first resistance mechanism, and said second handle portion being operatively connected to a second resistance mechanism.

According to some embodiments, respective resistances of said first and second resistance mechanisms are independently adjustable.

According to some embodiments, said first and second handle portions are attachable and detachable from each other.

According to some embodiments, said first and second handle portions comprise oar members.

According to some embodiments, said first and second handle portions are connected to their respective first and second resistance mechanisms with respective first and second cables.

According to some embodiments, said first resistance mechanism comprises a first flywheel, and said second resistance mechanism comprises a second flywheel.

According to a fourth aspect there is provided a rowing machine comprising: a main body portion extending along a longitudinal axis from a first end of the rowing machine to a second end of the rowing machine; a seat portion and a handle portion configured to enable a user to simulate a rowing motion during use of the rowing machine; wherein the rowing machine comprises at least one mechanism configured for transferring at least one of a pitching motion and a rolling motion to a user relative to said longitudinal axis, during use of the rowing machine.

According to a fifth aspect there is provided a rowing machine substantially as described herein with respect to the accompanying drawings.

DETAILED DESCRIPTION

Figure 1A:
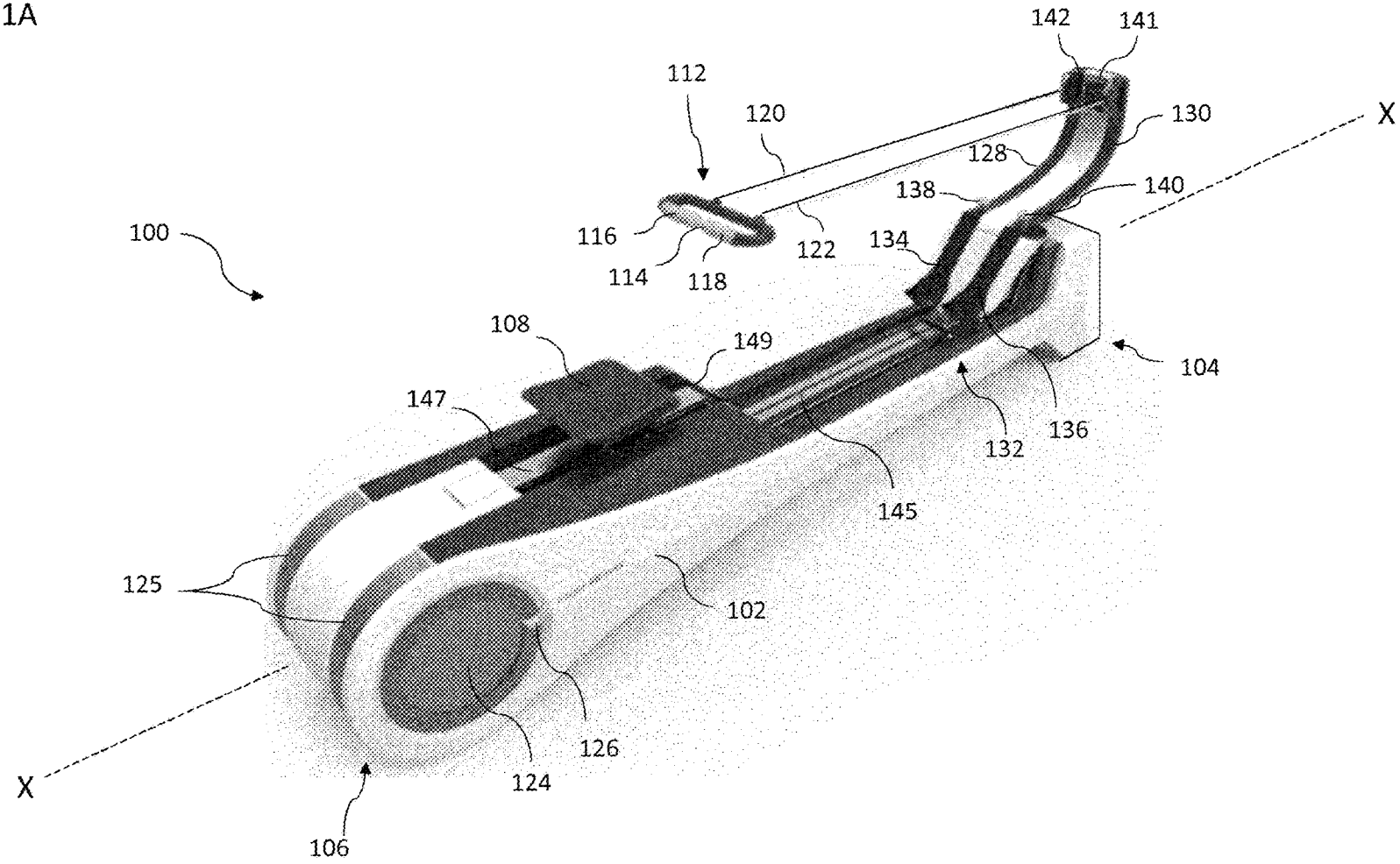
FIGS. 1A and 1B show a rowing machine in one configuration, according to an embodiment.
Figure 1B:
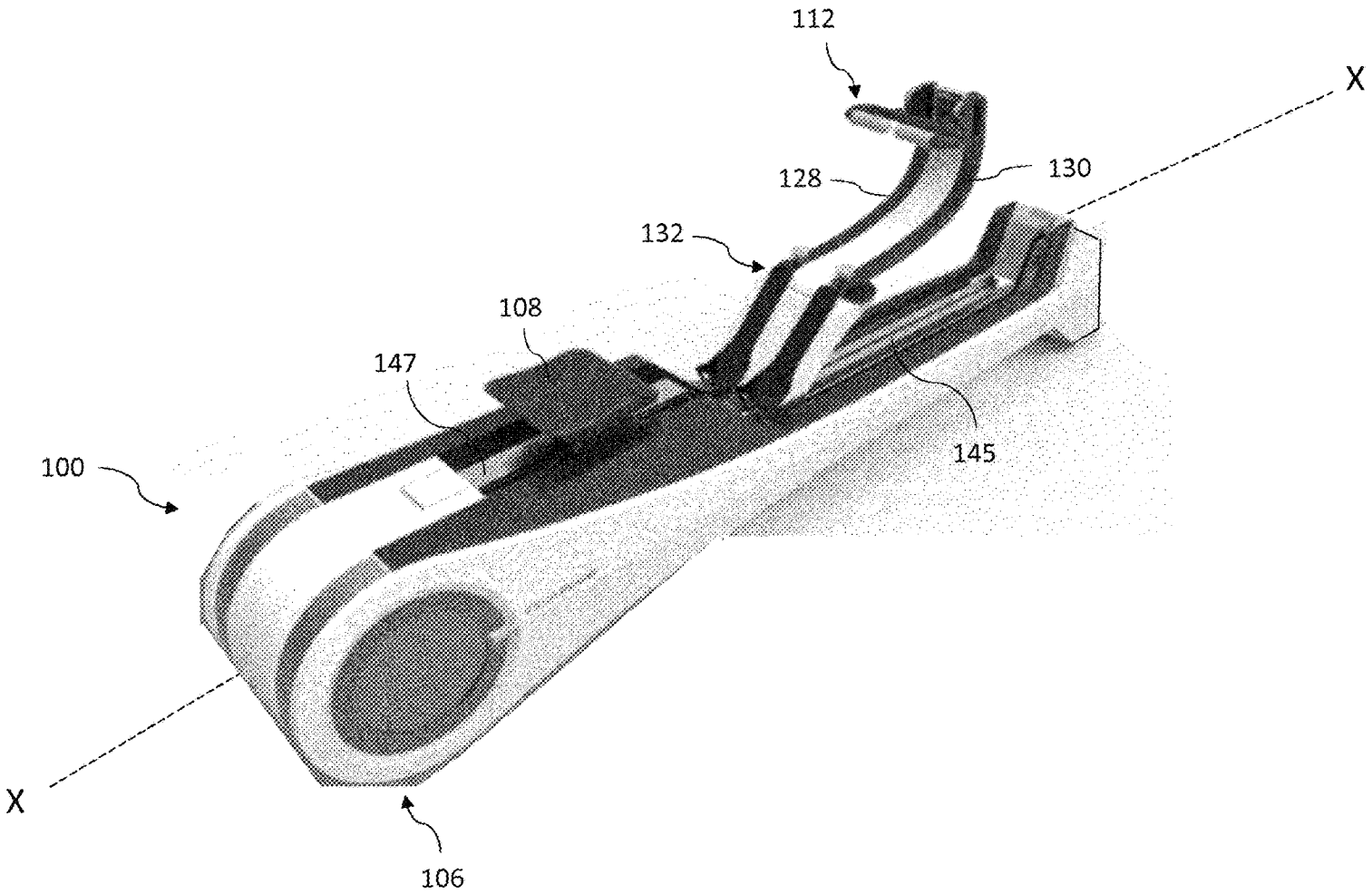

FIGS. 1A and 1B show a rowing machine 100 according to an embodiment. The rowing machine comprises a main body portion 102 which extends in a longitudinal direction i.e. along the axis X-X in FIG. 1A. The rowing machine comprises a first, or front portion 104, and a second, or rear portion 106. A seat portion 108 is located towards the rear portion 106 of the rowing machine. The seat portion 108 is movably mounted on a rail portion 147, along which rail the seat portion 108 can slide back and forth (i.e. in a direction parallel to the X axis), during use of the rowing machine. The rail portion and/or seat may comprise front and rear stops to limit overall movement of the seat 108. In some embodiments the positions of the stops may be adjusted by the user. The seat portion 108 may comprise wheels on an underside thereof to enable the seat portion to run on the rail 147. The wheels may be self-cleaning. Alternatively the seat could be fixed in place and a footplate assembly 132 (explained in more detail below) slides back and forth during the rowing motion. The term "rail" may be used interchangeably with the term "beam" or "monorail" or the like.

A handle portion 112 is also provided. In this example the handle portion 112 is substantially oval in shape, with a gap 114 between hand-grip portions 116 and 118. It will of course be appreciated that this is by way of example only and that other handle shapes may be provided in other embodiments.

Cables 120 and 122 operatively connect the handle portion 112 to a resistance mechanism 124 located at the rear of the rowing machine. In this embodiment the resistance mechanism comprises a flywheel that acts against air resistance. In other embodiments the flywheel may act against magnetic resistance or water resistance. In embodiments the resistance of the resistance mechanism can be adjusted. In the example of FIG. 1A the resistance is adjusted by moving lever 126, which increases or decreases the air-resistance during the drive phase of the stroke. Air outlets for the resistance mechanisms are shown at 125.

It will be appreciated that the described embodiment is exemplary and that in other embodiments a resistance mechanism of any kind can be used.

In one embodiment a single resistance mechanism is provided, to which both cables 120 and 122 are operatively connected. In another embodiment two independent resistance mechanisms are provided, to which cables 120 and 122 are independently operatively connected. This enables both cables 120 and 122 to operate entirely independently. This is described in more detail with respect to FIGS. 2A and 2B.

In the embodiment of FIGS. 1A and 1B the seat is free to slide on rail portion 147 i.e. it is not connected to the resistance mechanism. In other embodiments the seat portion 108 may also be connected to the resistance mechanism 124. This may be the same resistance mechanism that is connected to one or both of cables 120 and 122, or a further resistance mechanism may be provided to act independently on the seat portion 108.

In the example of FIG. 1A, arms 128 and 130 provide an attachment point for the cables 120 and 122 to the rowing machine. The cables 120 and 122 are routed within these arm portions 128 and 130 towards the resistance mechanism 124.

A foot plate assembly 132 is also provided, comprising foot plate portions 134 and 136. In this embodiment the foot plate assembly 132 is of unitary construction, with footplate portions 134 and 136 attached thereto. The footplate 132 and/or rail portion 145 may also comprise front and rear stops to limit overall movement of the footplate 132 on the rail portion 145. In some embodiments the positions of the backstops may be adjusted by the user. In other embodiments there is no need to adjust the stops on the rails, as the position is dictated by the user's leg length. In some embodiments the footplate 132 is also adjustable for height (i.e. in an up and down direction with respect to the floor). In some embodiments the foot plates 134 and 136 are able to move back and forth relative to the foot plate assembly 132 to accommodate different users' body sizes and to ensure positioning is correct. In some embodiments the footplate is slidable on the rail assembly. In some embodiments the footplate is attached to the resistance mechanism.

In this embodiment the arms 128 and 130 are each connected to footplate assembly 132. A first pin 138 connects the arm 128 to the foot plate assembly 132. A second pin 140 connects the arm 130 to the foot plate assembly 132. Both the pins 138 and 140 have lock and unlock positions so as to selectively lock and unlock the arms 128 and 130 to the foot plate assembly 132. This enables the arms 128 and 130 to be rotated when the pins are in their unlocked positions. This can be appreciated more fully in the description below with respect to FIG. 2A.

The rowing machine 100 also comprises a user interface 142 on a display 141. The display 141 may be an LCD screen or a display of any other type. The display 141 may comprise hardware buttons for inputting information or commands to the rowing machine. The display 141 may additionally/alternatively comprise a touchscreen display.

In FIG. 1A a user is not shown, to maximize clarity of the drawings. However it will be understood that the position of the handle portion 112, and the tension in cables 120 and 122 is representative of a user pulling the handle 112 towards themselves during a stroke phase of a rowing motion.

The foot plate assembly 132 can, in the embodiment of FIG. 1A, move along rail portion 145. In the embodiment of FIGS. 1A and 1B the rail portions 147 and 145 are vertically spaced apart, and connected by a ramped portion 149. This can be appreciated more fully in FIG. 4A. The portions 145, 147 and 149 may be part of a rail of unitary construction. In another embodiment the portions 145, 147 and 149 are separate rail portions connected with appropriate connectors/brackets. In other embodiments the ramped portion 149 may be omitted, in which case rails 145 and 147 are separated. In another embodiment a single, straight rail portion may be provided, in which case the seat portion 108 and footplate assembly 132 will be positioned at the same level.

FIG. 1B shows the rowing machine 100 of FIG. 1A at a different point of the rowing motion phase (again for clarity the user is not shown). In FIG. 1B the foot plate assembly 132 has moved along the rail 145 towards the rear 106 of the rowing machine. The handle portion 112 has moved towards the arms 128 and 130, and the cables 120 and 122 have retracted into the arms 128 and 130. Although the seat portion 108 is movable on rail 147, the seat portion 108 has remained in a substantially static position. Again, in FIG. 1B the user is not shown for clarity. However the positions of the seat portion 108, the foot plate assembly 132, and the handle portion 112 are representative of the end of the recovery phase/beginning of the drive phase of a rowing stroke.

Figure 2A:
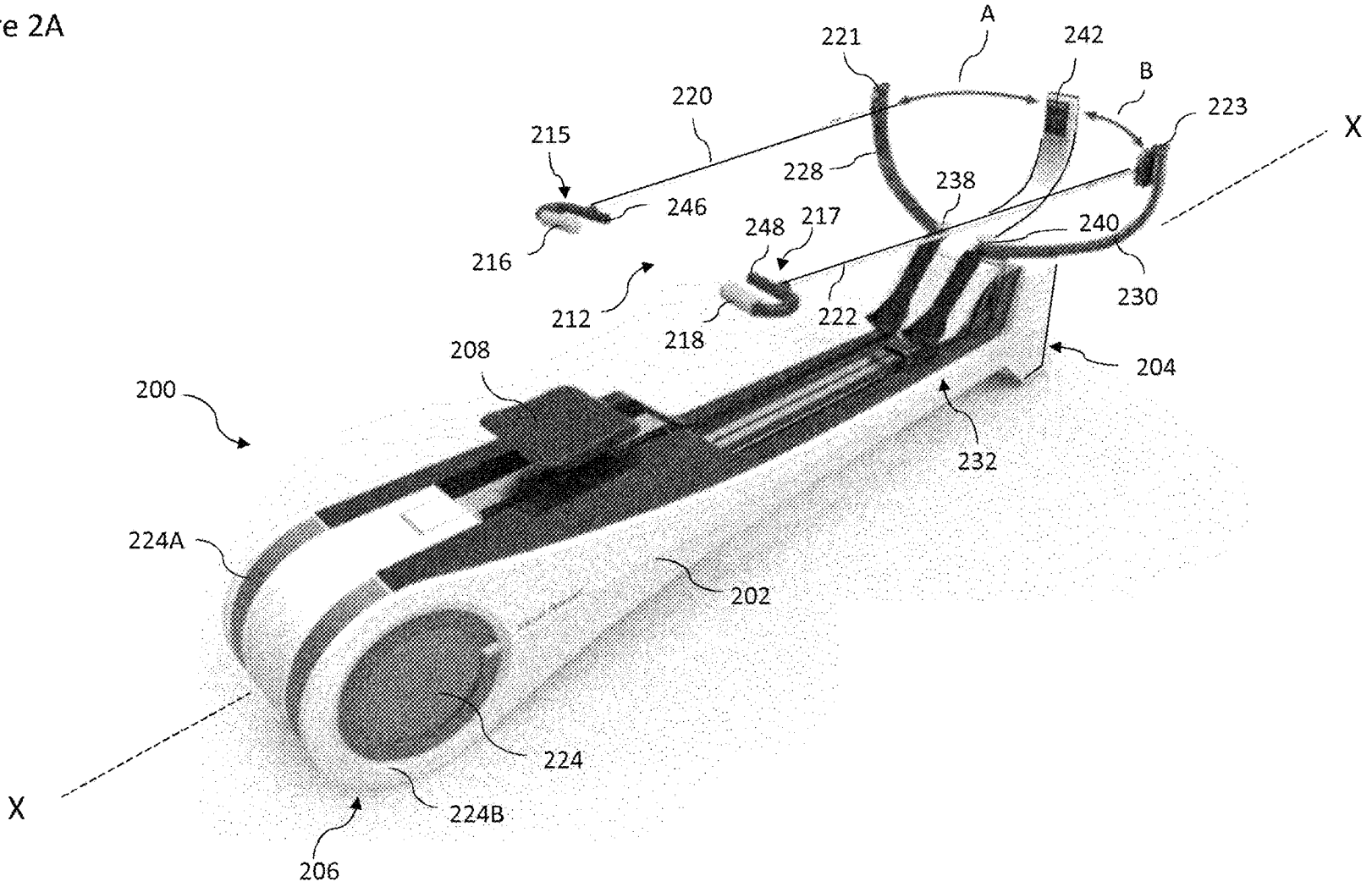
FIGS. 2A and 2B show a rowing machine in another configuration, according to an embodiment.
Figure 2B:
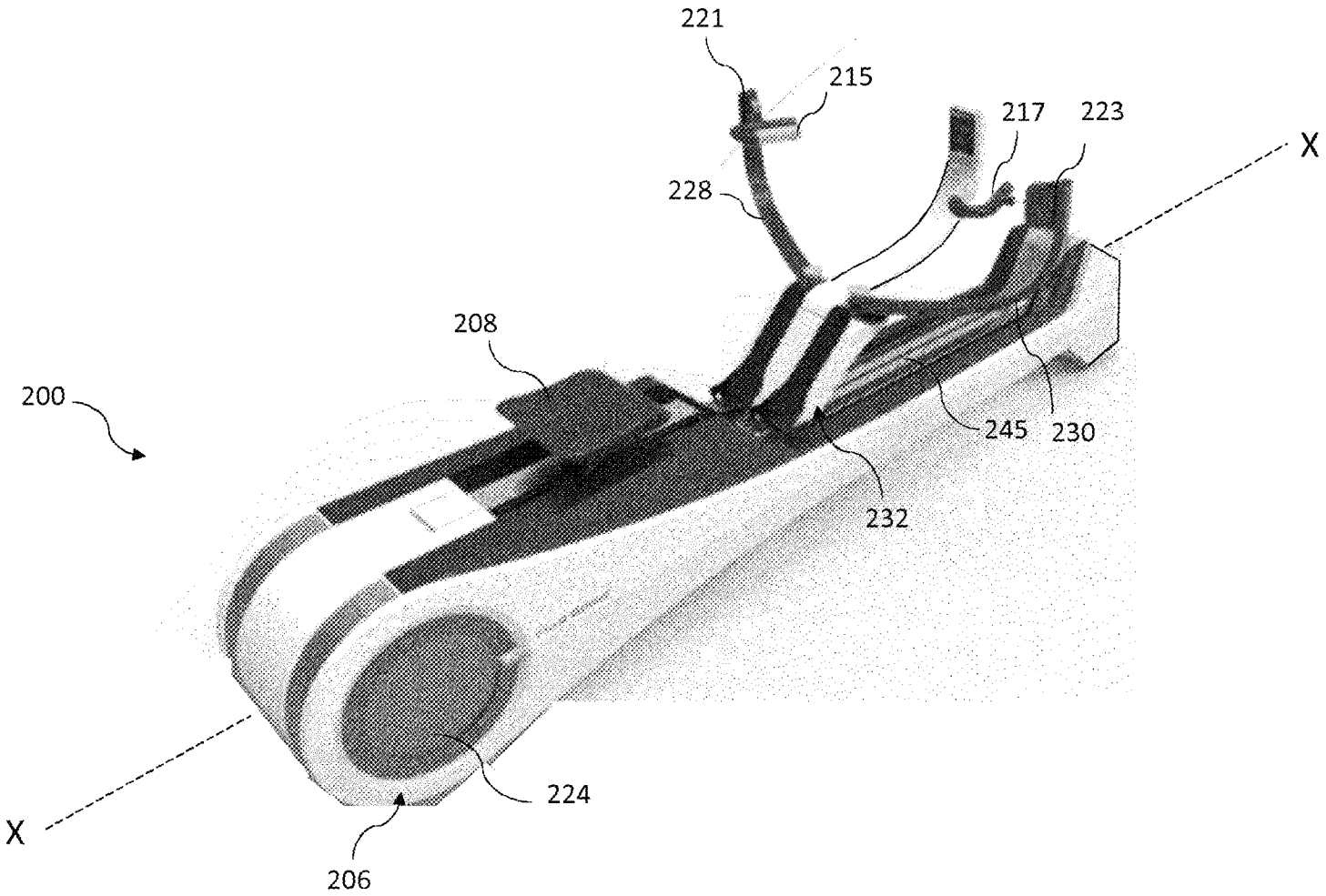

FIGS. 2A and 2B show a rowing machine 200 according to another embodiment. As per FIGS. 1A and 1B, the rowing machine 200 comprises a main body portion 202, a seat portion 208, a resistance mechanism 224, a front end 204, and a rear end 206. Apart from where explicitly described otherwise, features from the embodiments of FIGS. 1A and 1B may be combined in any way with the embodiment of FIG. 2A and FIG. 2B. For conciseness only the main differences between the embodiments are described in detail here.

The arms 228 and 230 are connected to the footplate assembly 232. In some embodiments this connection is by means of one or more quick-release skewers to allow quick assembly and disassembly of the arms to the footplate.

As can be seen from FIG. 2A the handle portion 212 comprises two separate handles, 215 and 217. Handle 215 comprises a handgrip portion 216, and handle 217 comprises a handgrip portion 218. Handle 215 is operatively connected to the resistance mechanism 224 via cable 220 and arm 228. Handle 217 is operatively connected to resistance mechanism 224 via cable 222 and arm 230.

In the embodiment of FIG. 2A, the arms 228 and 230 have been rotated outwardly compared with the arms 128 and 130 of FIG. 1A and FIG. 1B. Arrows A and B show how the arms 228 and 230 can be rotated inwardly and outwardly. This is facilitated by selectively unlocking and locking pins 238 and 240. By rotating the arms 228 and 230 outwardly as shown in FIG. 2A, the distance between point 221 (where the cable 220 first meets the arm 228), and point 223 (where the cable 222 first meets the arm 230) is increased compared to FIGS. 1A and 1B. This distance can be further increased or decreased by rotation of the arms. This adjustability enables the user to adjust the handle position. This may allow the user to replicate a particular rowing position, or may make the handle position more comfortable for a user, or may enable a user to work different muscle groups. In one embodiment the swing arms 128 and 130 can rotate around to an angle of about 50 degrees (and more particularly 49.5 degrees) to the longitudinal axis of the rail 145. These angles are considered to give a similar feel to that of a rowing/sculling handle.

In some embodiments the handles 215 and 217 can be attached to each other to provide a handle the same as or similar to handle 112 in FIGS. 1A and 1B. This may be done by attaching end 246 of handle 215 to end 248 of handle 217. Any type of connection may be used, for example a screw fit, a friction fit etc.

In the embodiment of FIG. 2A the resistance mechanism 224 comprises a first resistance mechanism 224A and a second resistance mechanism 224B. The resistance mechanisms 224A and 224B may each comprise a flywheel, for example. Handle 215 is operatively connected to flywheel 224A, and handle 217 is operatively connected to flywheel 224B. The resistance of flywheels 224A and 224B can be independently adjusted. For example a user could set a larger resistance on one flywheel than the other. A user may utilise such a function in order to concentrate on strengthening a particular side of their body.

Again, for clarity, a user is not shown in FIG. 2A. However it will be appreciated that the position of the handles 215 and 217, and the position of the movable foot plate assembly 232 are representative of the end of the drive phase/beginning of the recovery phase of the rowing stroke.

FIG. 2B shows the rowing machine 200 during a different phase of the rowing cycle. In FIG. 2B the cable 220 is retracted in the arm 228, and the cable 222 is retracted in the arm 230. Accordingly handle 215 is proximate attachment point 221, and handle 217 is proximate attachment point 223.

Also in FIG. 2B the foot plate assembly 232 has slid rearwards along rail 245 towards the rear end 206 of the rowing machine. The positions of the seat, foot plate assembly 232, and handles 215 and 217 are representative of the end of the recovery phase/beginning of the drive phase of the rowing stroke.

Although not shown in the Figures it will be appreciated that the foot plates may comprise straps or similar to enable a user to strap their feet to the foot plates. In this embodiment the foot plate assembly 232 can slide on the rail 245, and is connected to the resistance mechanism by means of a cable. This provides resistance to the user during the leg drive. In other embodiments the foot-plate may be fixed relative to the main body 202 of the rowing machine 200 i.e. such that the footplate cannot slide on rail 245. Such an embodiment may require extension of the rail 147, to provide sufficient travel for the seat portion 108. Therefore embodiments may provide one or more of a fixed seat and a moving footplate; a moving seat and a fixed footplate; a moving seat and a moving footplate. In some embodiments a rowing machine may be adjustable between any of these configurations.

Although not shown in the Figures a cable take up assembly may be comprised in the main body 202 of the rowing machine to take up the cables 120/220 and 122/222 as necessary during the stroke and/or recovery phases. The cable take up mechanism may be incorporated in the resistance mechanism 124/224.

Although described as two separate embodiments, the configuration of FIGS. 1A and 1B and the configuration of FIGS. 2A and 2B may be provided by the same rowing machine. That is the handle portions of FIGS. 1A and 1B may be separated to provide the two handle portions of FIGS. 2A and 2B, and the arms 128 and 130 of FIGS. 1A and 1B may be swung out to the configuration of FIGS. 2A and 28.

Figure 3A:
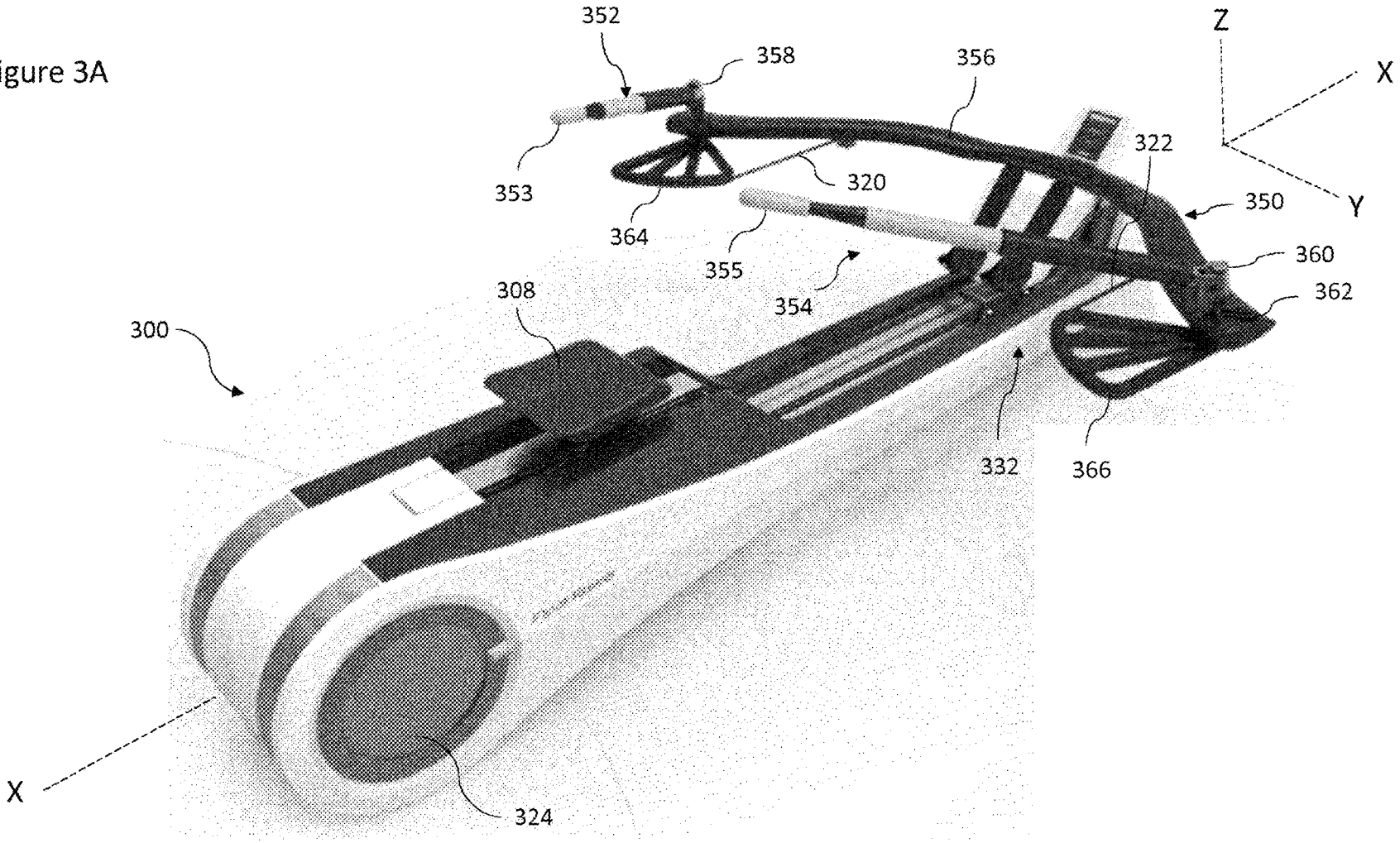
FIGS. 3A and 3B show a rowing machine according to another embodiment.
Figure 3B:
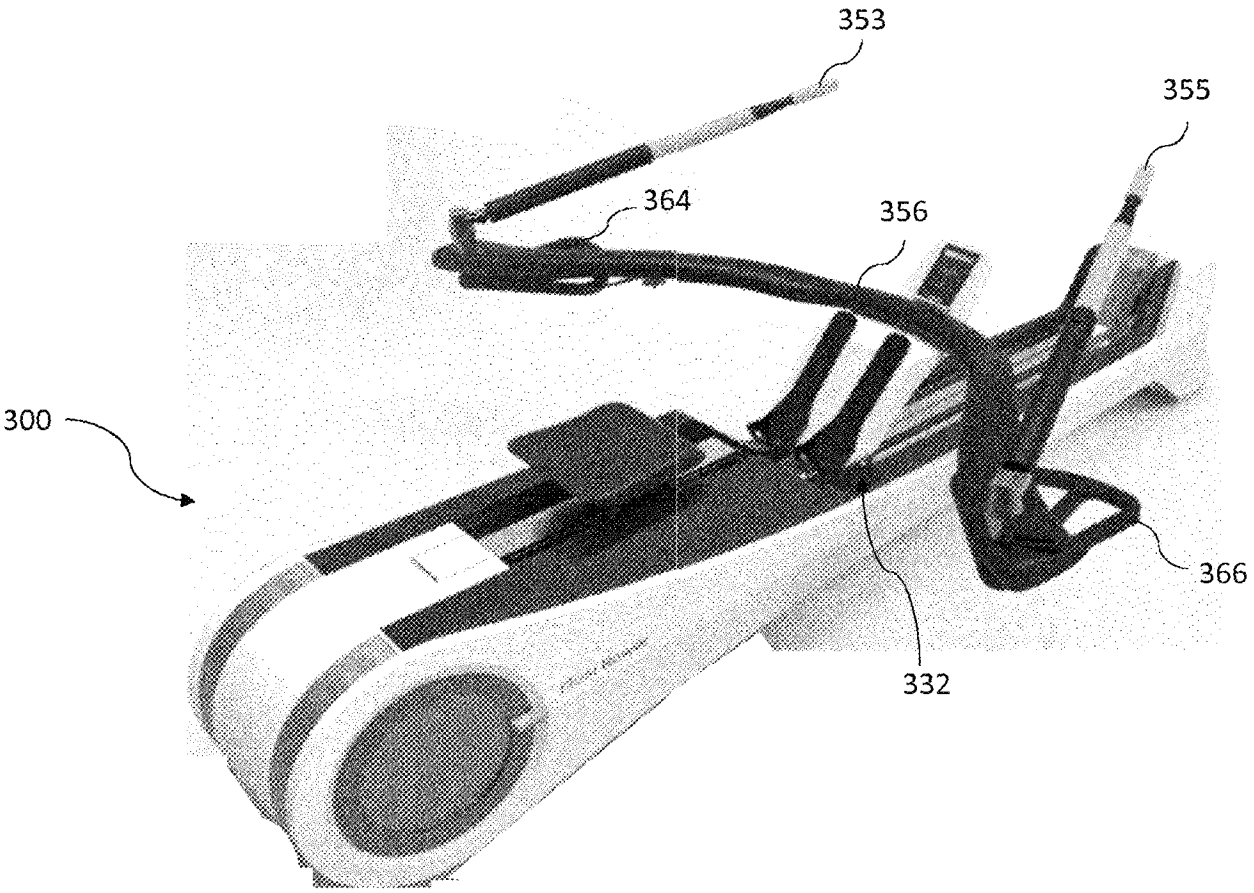

FIGS. 3A and 3B show an embodiment having an alternative rigger design. As shown in FIG. 3A the rowing machine 300 comprises a rigger assembly 350. In the embodiment of FIGS. 3A and 3B the rigger assembly 350 is fixed for movement to foot plate assembly 332. The rigger assembly 350 comprises a first oar member 352 and a second oar member 354 attached to a cross member 356. The oar member 352 comprises a handgrip portion 353, and the oar member 354 comprises a handgrip portion 355.

The cross member 356 is fixed to the foot plate assembly 332 at an upper portion of the foot plate assembly 332. The oar member 352 is attached to the cross member 356 with a linkage 358. The oar member 354 is attached to the cross member 356 with a linkage 360. The linkages 358 and 360 enable the oar member to move in the X, Y and Z directions, as well as enabling the oars to rotate about their longitudinal axes. The linkages 358 and 360 may comprise for example a universal joint. The linkages 358 and 360, and the degrees of motion they provide, enable a user to "feather" and "square" the oar members, and replicate the "tapping down" and "raising of the hands" when extracting and placing the oar respectively, during the stroke, to accurately recreate an on-water rowing motion.

The dual oar configuration of FIGS. 3A and 3B is representative of a rowing boat "sculling" configuration. In another embodiment the configuration of the oar members can be changed to provide a "sweep" configuration (see FIG. 7B).

As shown in FIG. 3A the linkage 360 is located in a slot 362. This enables the position of the linkage 360 to be adjusted within the slot 362, thus allowing a user to fine tune the correct position and angle of the oar member 354. An equivalent slot is also provided on the other side of cross member 356 for the oar 352, to enable fine tuning adjustment of that oar member also. In some embodiments the linkage 360 can be fixed in place in the slot 362 using a rigger pin or the like. Then the rigger pins would not move once set-up and rowing has begun. In other embodiments the slot 360 may be removed and the linkages 358 and 360 are fixed in place that way.

The oar member 352 is operatively connected to resistance mechanism 324 by cable 320. The oar member 354 is operatively connected to the resistance mechanism 324 by cable 322. As previously discussed, the resistance mechanism 324 may comprise independent resistance mechanisms for each oar member. The cable 320 is routed via a cable guide 364 to resistance mechanism 324. The cable 322 is routed via a cable guide 366 to the resistance mechanism 324. The cable guides 364 and 366 help maintain tension in the cables 320 and 322.

Again, the user is not shown in FIG. 3A for clarity. In FIG. 3A the position of the oars 352 and 354, the foot plate assembly 332, and the seat 308 is representative of the end of a stroke phase of a rowing motion i.e. with hand grip portions 353 and 355 pulled towards the upper body of a user, and the foot plate assembly 332 pushed away from the upper body of the user.

FIG. 3B shows the rowing machine 300 in a position representative of the end of a recovery phase of a rowing motion i.e. with the handle portions 353 and 355 of the oars pushed away from the upper body of a user, and the foot plate assembly 332 pulled towards the upper body of a user. It can also be appreciated from FIG. 3B that the cable guides 364 and 366 can rotate about the cross member 356 in the same arc as the oar member 352 and 354 respectively, to take up tension in the cables 320 and 322.

In some embodiments the length of the oar members 352 and 354 may be adjustable to replicate the lengths of sculling oars and also sweep oars. The oar members may comprise a telescopic mechanism for adjusting their length.

Figure 4A:
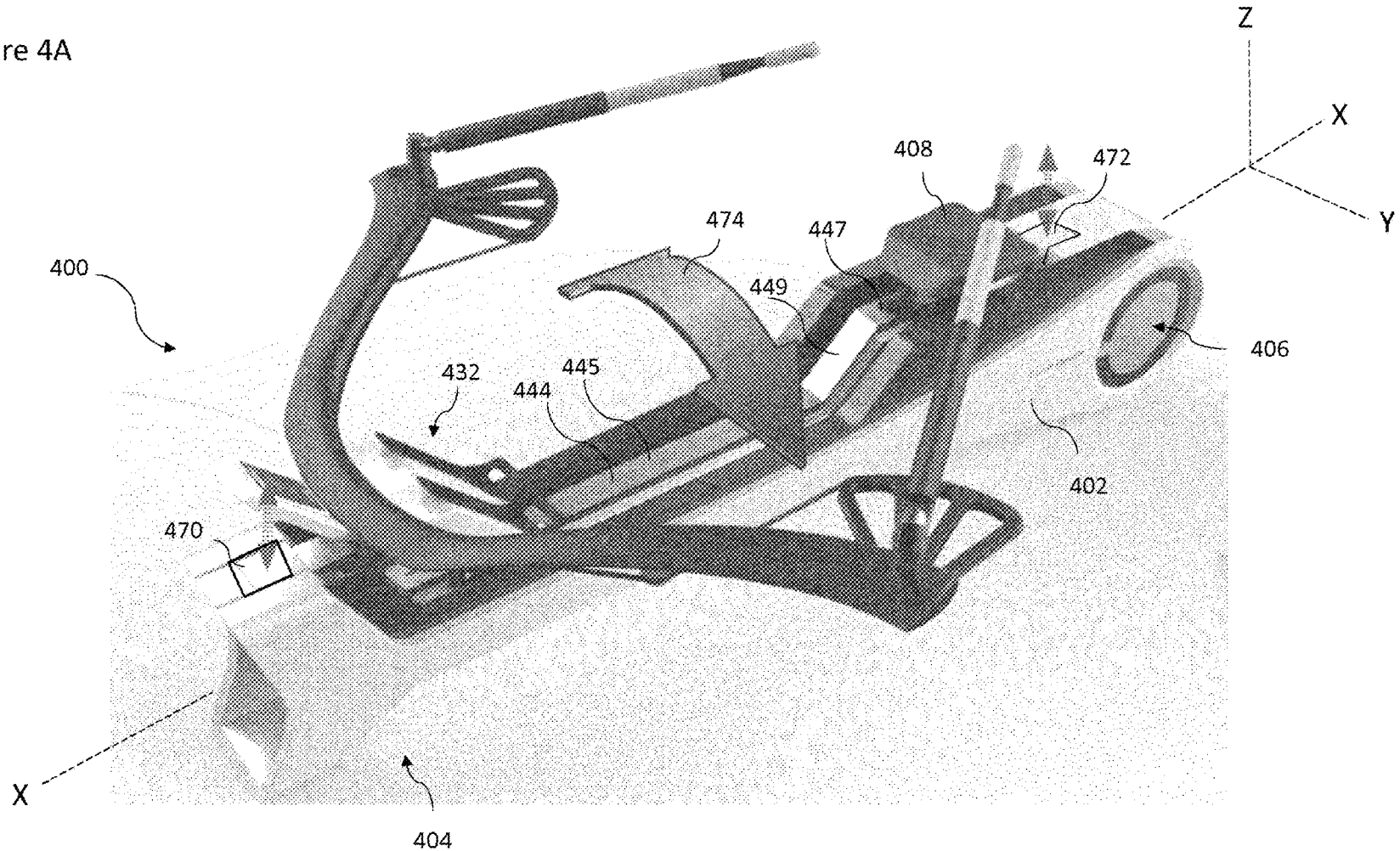
FIG. 4A shows a rolling functionality of a rowing machine according to an embodiment.
Figure 4B:
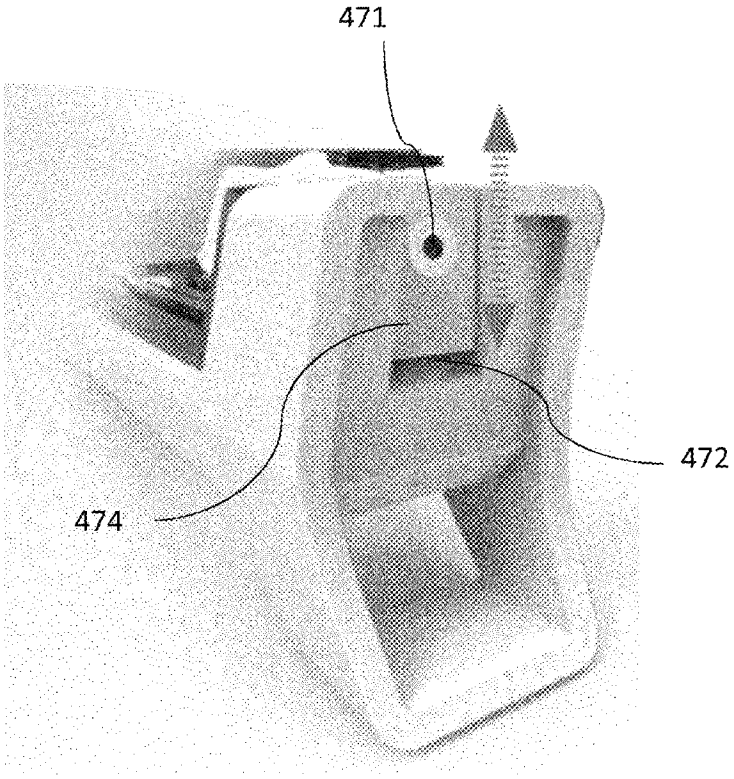
FIG. 4B shows a pitching functionality of a rowing machine according to an embodiment.

In embodiments, elements of the rowing machine may pitch (or in other words tilt) and/or roll to transfer a pitching and/or rolling motion to a user, as shown in FIGS. 4A and 4B.

As shown in FIG. 4A the rowing machine 400 comprises a unitary rail portion or monorail 444 which extends from a front end 404 of the rowing machine towards a rear end 406 of the rowing machine. Both the foot plate assembly 432 and the seat portion 408 are configured to slide back and forth along the monorail 444 parallel to longitudinal axis X-X. The foot plate assembly 432 is configured to slide on a first portion 445 of monorail 444, and the seat portion 408 is configured to slide on a second portion 447 of the monorail 444. A ramp portion 449 of monorail 444 is provided to connect the lower, first portion 445 of the monorail to the higher, second portion 447 of the monorail. As discussed previously the rail assembly may be provided in one or more other configurations e.g. three separate rails 445, 447 and 449 connected with suitable brackets, or just a lower rail 445 and upper rail 447 may be provided. Where appropriate, suitable stops may be provided to prevent the footplate 432 and seat 408 from sliding off the rail(s).

Towards the front 404 of the rowing machine there is provided a first suspension mechanism 470. Towards the rear 406 of the rowing machine there is provided a second suspension mechanism 472. A front end of the monorail 444 is connected to the suspension mechanism 470, and a rear end of the monorail is connected to the suspension mechanism 472. This enables the monorail to move in an up and down direction i.e. in the Z direction when viewing FIG. 4A. In some embodiments the suspension mechanisms 470 and 472 can move independently of each other i.e. the suspension mechanism 470 can move in a downward direction whilst the suspension mechanism 472 can move in an upward direction, and vice versa. This provides a "pitching" (or tilting) and/or "floating" sensation to the user.

Therefore it may be considered that the monorail is suspended or slung between the front end and the rear end of the rowing machine. In some embodiments a beam or other structure may be suspended or slung between the front and rear ends of the rowing machine, with one or more further rail portions attached to the beam. In such embodiments the beam (and by association the rail) is suspended, with the rail portions providing a track or track portions for the foot assembly and/or seat portion to slide thereon.

The monorail 444 is also connected to the main portion 402 of the rowing machine in a manner such that a "rolling" motion or rotation motion can also be provided to a user. In the embodiment of FIG. 4A the monorail can roll or rotate as shown by the arrow 474. To provide the rolling motion, the monorail 444 may be slung, suspended or rotated within a bearing, such as a slide bearing, within the main body portion 402 of the rowing machine. In some embodiments the mechanisms 470 and 472 provide dual functionality of enabling the monorail to both pitch and roll. In other embodiments separate mechanisms provide the rolling and pitching functionalities.

FIG. 4B shows in more detail the suspension mechanism 470. The suspension mechanism 470 comprises a block 474 to which the monorail 444 can be attached. Although not visible in FIG. 4B, a spring and damper arrangement is provided within the block 474. A similar suspension arrangement is provided at 472. An aperture 471 is also provided which enables linking of multiple rowers. This is discussed in more detail with respect to FIG. 56.

In some embodiments the stiffness of the spring and/or the rebound rate of the damper can be adjusted to suit the weight of a user and/or as desired.

It will be understood that the pitching and rolling mechanism shown in FIGS. 4A and 4B is by way of example only and that the pitching and/or rolling motions can be provided in any other way. The application is also not limited to the monorail design shown in FIG. 4A. As explained above in other embodiments separate rails can be provided for the foot plate and the seat. The separate rails can be mounted to pitch and/or roll independently of each other. That is each rail may have its own rolling and/or pitching mechanism(s). In some embodiments one of the seat and foot plate is configured to pitch and/or roll, whilst the other of the seat and foot plate is fixed. For example in a simplified embodiment only the seat portion 408 is configured to pitch and/or roll, whilst the foot plate is fixed.

The described embodiment may give the user the sensation that they are floating on water, so as to accurately mimic a real life rowing situation. Embodiments may also help to build core strength of a user as they use their core muscles to control the pitching and rolling movements of the rowing machine.

Figure 5A:
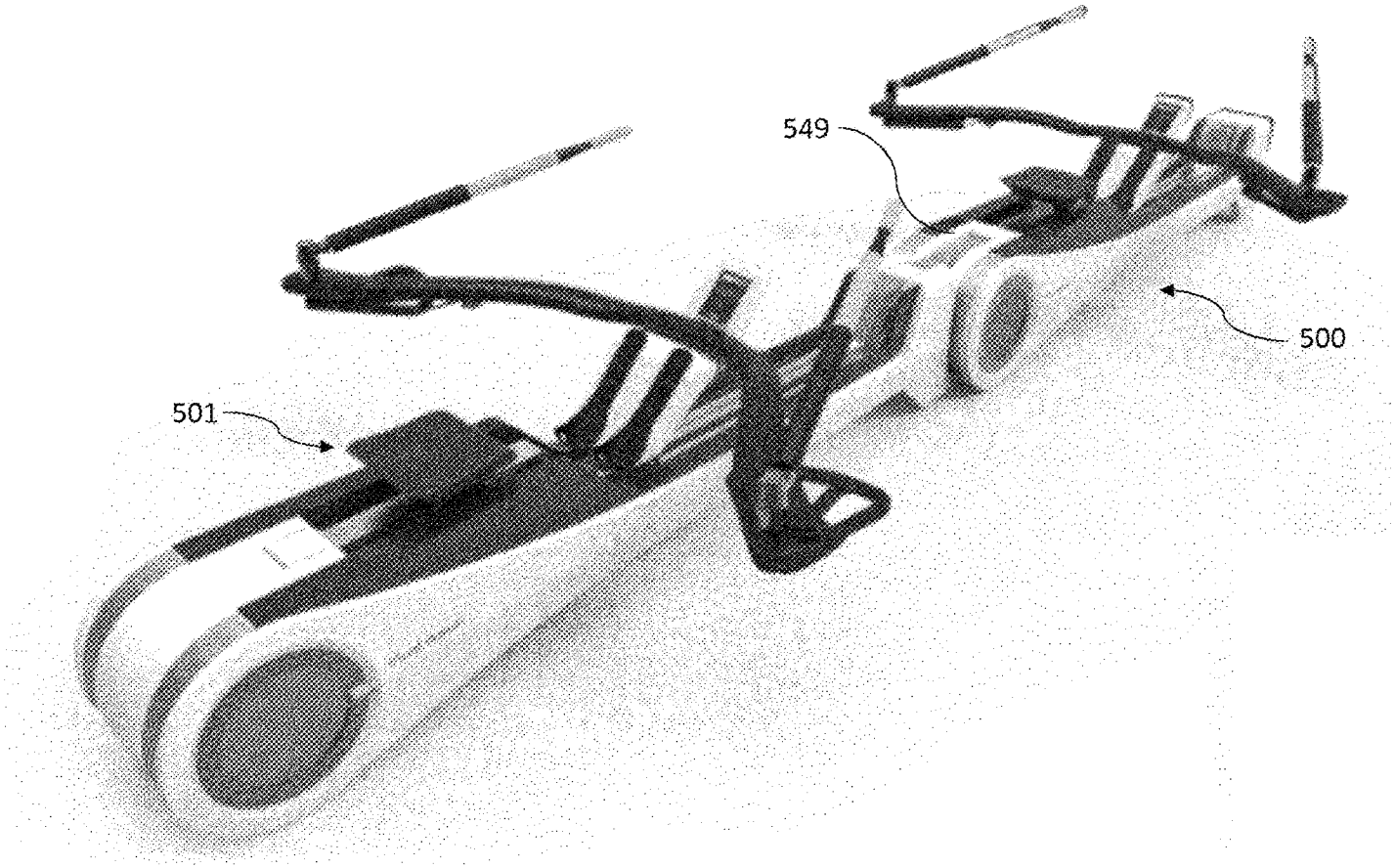
FIG. 5A shows two rowing machines linked together, according to an embodiment.

In some embodiments two or more rowing machines can be connected in series to enable two or more rowers to mimic rowing as a crew. This is shown for example in FIG. 5A which shows a first rowing machine 500 connected to a second rowing machine 501. The first and second rowing machines are connected using a rail 549 which acts as a link between the two rowing machines. This is shown in more detail in FIG. 5B which is an exploded view of the connection between first rowing machine 500 and second rowing machine 501. The link rail 549 comprises plugs 574 and 576 at either end of the rail. Although in this example the plugs are shown as detachable items from the link rail 549, in other embodiments they may be integrally formed with the rail. The plugs 574 and 576 comprise rod portions 575 and 577 respectively. These rod portions engage with the rolling mechanisms 572 and 570 of the respective rowing machines. For example rod 575 engages aperture 573 in the rolling mechanism 572.

Once connected the rowing machines 500 and 501 can transfer pitching and/or rolling motions between each other. This enables the rowers to simulate operating as a crew.

Figure 5B:
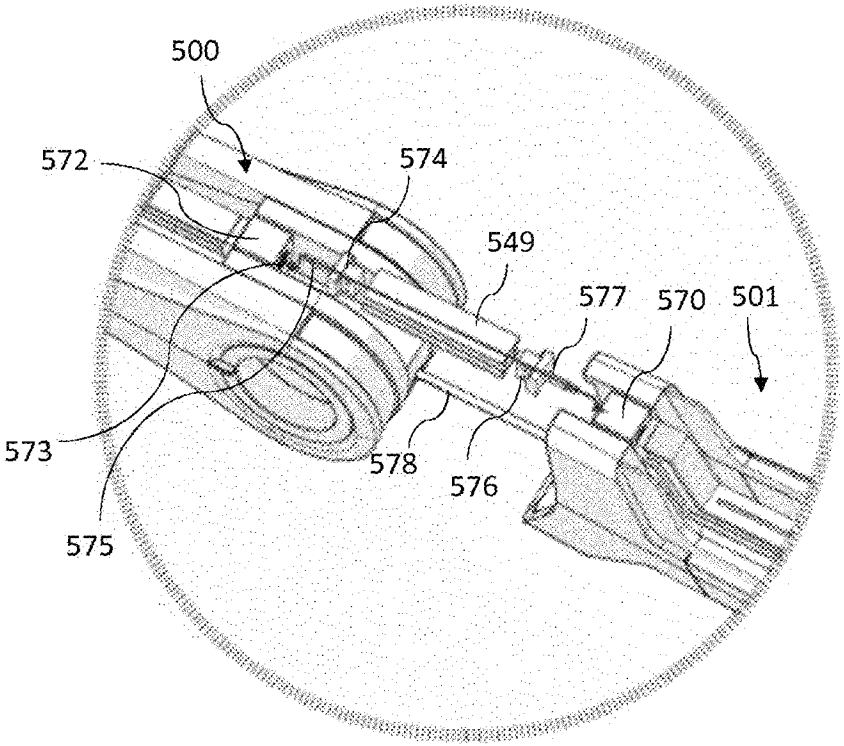
FIG. 5B shows in more detail a mechanism for linking two or more rowing machines, according to an embodiment.

In the example of FIG. 5B a further connector 578 is provided. The connector 578 connects the footplate assemblies from adjoining rowing machines. This enables a user to feel when another user on an adjoining machine is applying pressure during the stroke and likewise when they are not.

Also, this allows the users to feel whether they are moving in a coordinated fashion at the various phases of the rowing stroke.

As shown for example in FIG. 1A, a user interface 142 is provided which enables the user to program aspects of the rowing machine and/or to receive performance information.

FIGS. 6A to 6D show in more detail a user interface 642 provided on a display 641. In the embodiments of FIGS. 6A to 6D the display is a touchscreen display. In other embodiments hardware keys may additionally be provided in addition to or alternatively to the touchscreen display. In some embodiments a port, such as a USB port, is provided which enables a user to attach their own tablet or smart phone or other display device to the rowing machine for providing the display. In embodiments an application or "app" may be downloaded for providing the user interface.

Referring back to FIG. 6A, a menu screen 680 is shown on the user interface 642. Options on the main menu screen include "Users" 681, which enables a user to retrieve or store user information such as biometric data or identification data for a particular user or users; "Row" 692 which enables a user to simply begin rowing without any further programming; "Standard workouts" 683 which takes a user to a selection of pre-programmed workouts; "Favourites" 684 which enables a user to select a favourite workout; "Records" 685 where records can be stored and viewed; and "History" 686 where a user can retrieve a history of their previous rows or the previous rows of other users. An identity of the current user is displayed at 687.

Figure 6A:
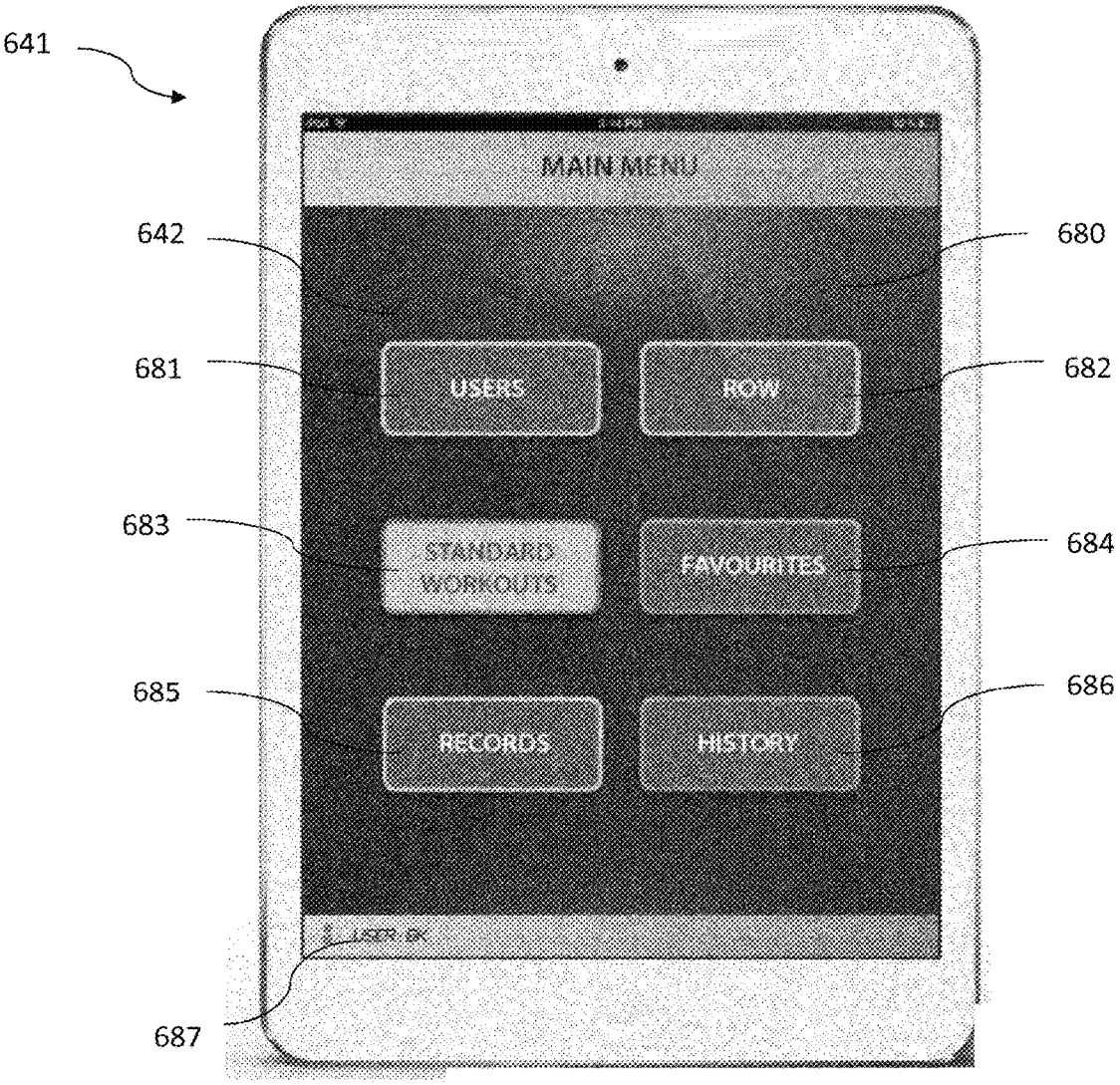
FIGS. 6A to 6D show a user interface display according to an embodiment.
Figure 6B:
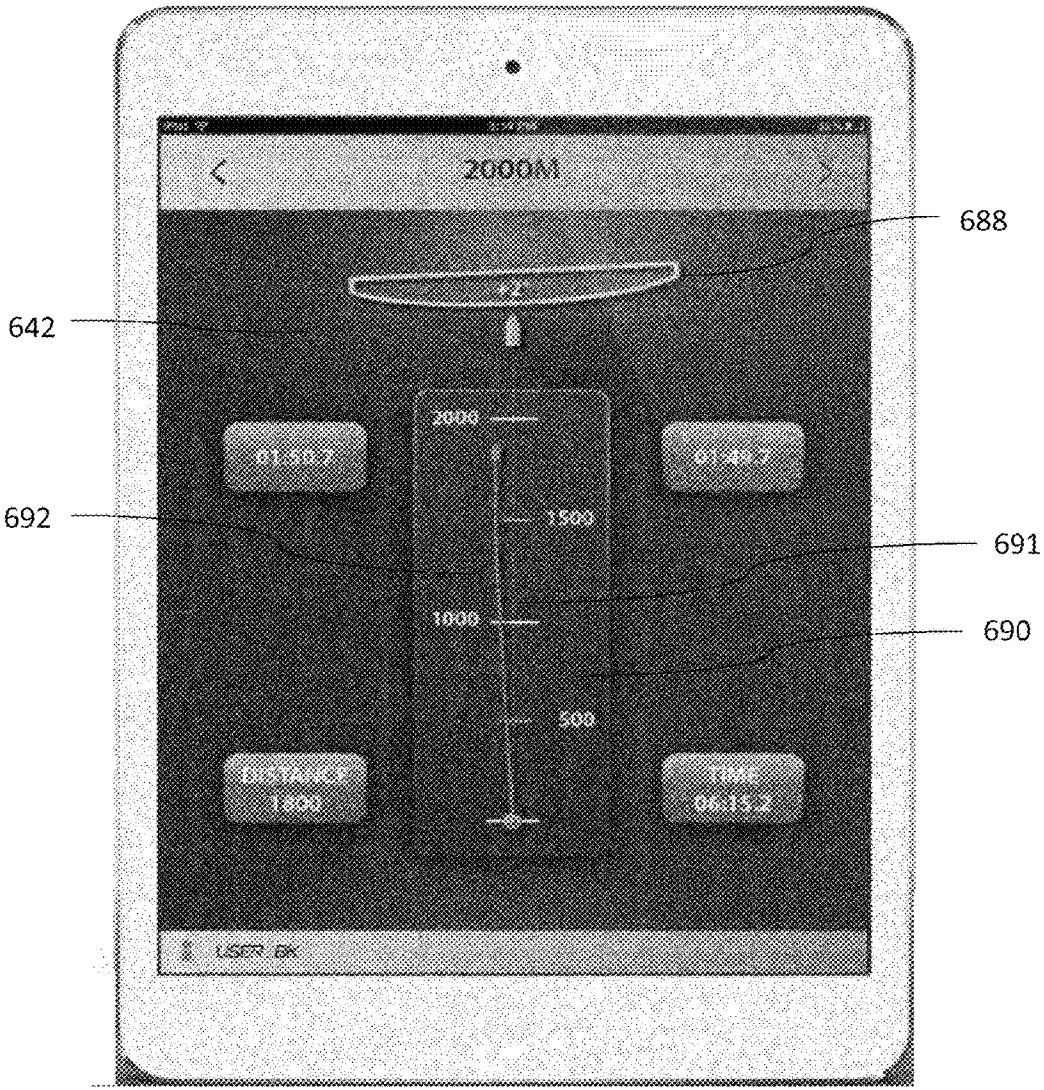

In embodiments "live" performance data can be fed back to a user. This can be information such as time, speed etc. In some embodiments, and as shown in FIG. 6B, further useful information such as a degree of roll can be provided to a user. As displayed at 688 the user is provided with a sectional representation of a rowing boat, and is shown in this example to be rolling at an angle of 2° in an anticlockwise direction. Therefore the user interface 642 can show a user how far they are rolling, as well as in what direction they are rolling. The user can then use this information to correct and "flatten" the rowing machine, for example by using their bodyweight to tilt themselves back in to an upright position. This information can be useful to a user as it teaches them how to correctly align and position the rowing machine, which can then be translated to a rowing boat when on water. This information is also particularly useful when multiple rowing machines are linked together as a crew, as it teaches the crew how to coordinate their movements to ensure that the "boat" remains as flat as possible.

Although a degree of roll is shown with respect to FIG. 6B, it will of course be appreciated that a degree of pitch may additionally/alternatively be provided to the user, which may be accompanied with a suitable graphical representation.

The pitching and rolling motions may be detected and fed back to the user interface in any known way. By non-limiting example only, in some embodiments piezo-electric actuators are incorporated in the pitching and rolling mechanisms which can then feedback electrical signals to a processing entity to translate the electrical signals into information regarding the degree of pitch and/or the degree of roll. The processing capability may be provided on the rowing machine itself (for example on an integrated display unit), or the processing capability may be provided by an external device, such as a user's connected tablet/PC/smartphone etc.

As also shown in FIG. 6B a chart 690 may be provided which gives a user directional information. The dotted line 691 represents a straight line. The plot 692 shows the path that the user has/is following. The user can therefore see when they are deviating from a straight course. This facility can be used to help train rowers to row in a straight line, and can also be used to teach rowers how to steer.

Figure 6C:
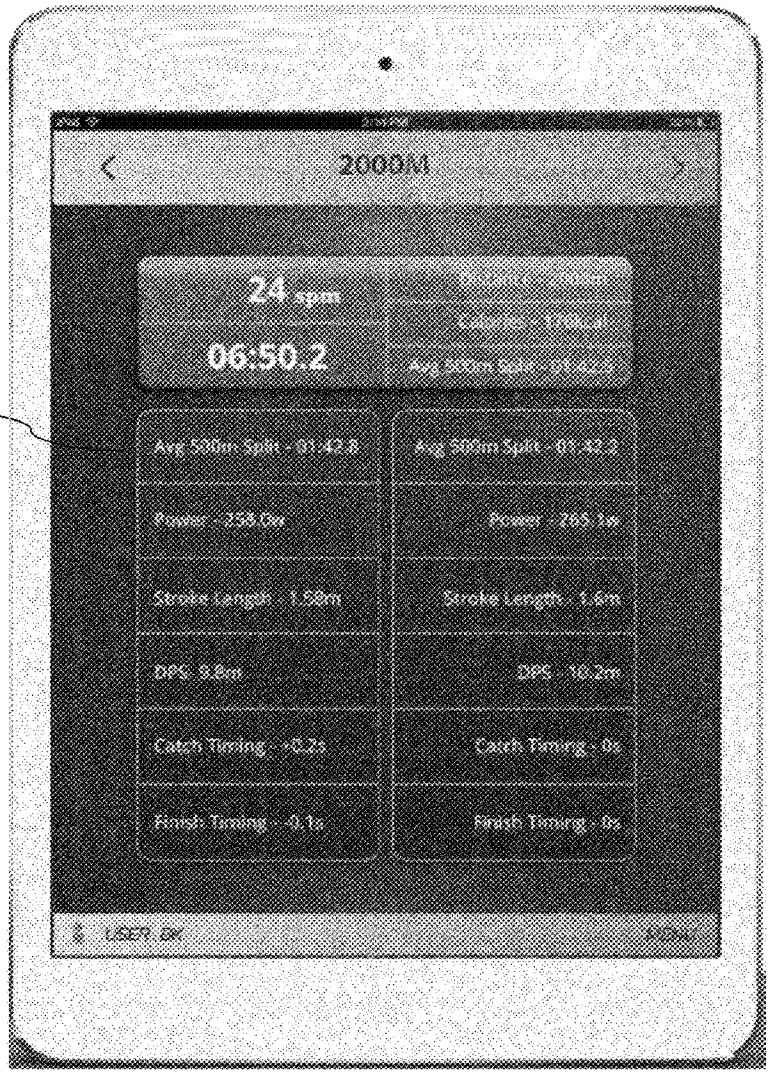
Figure 6D:
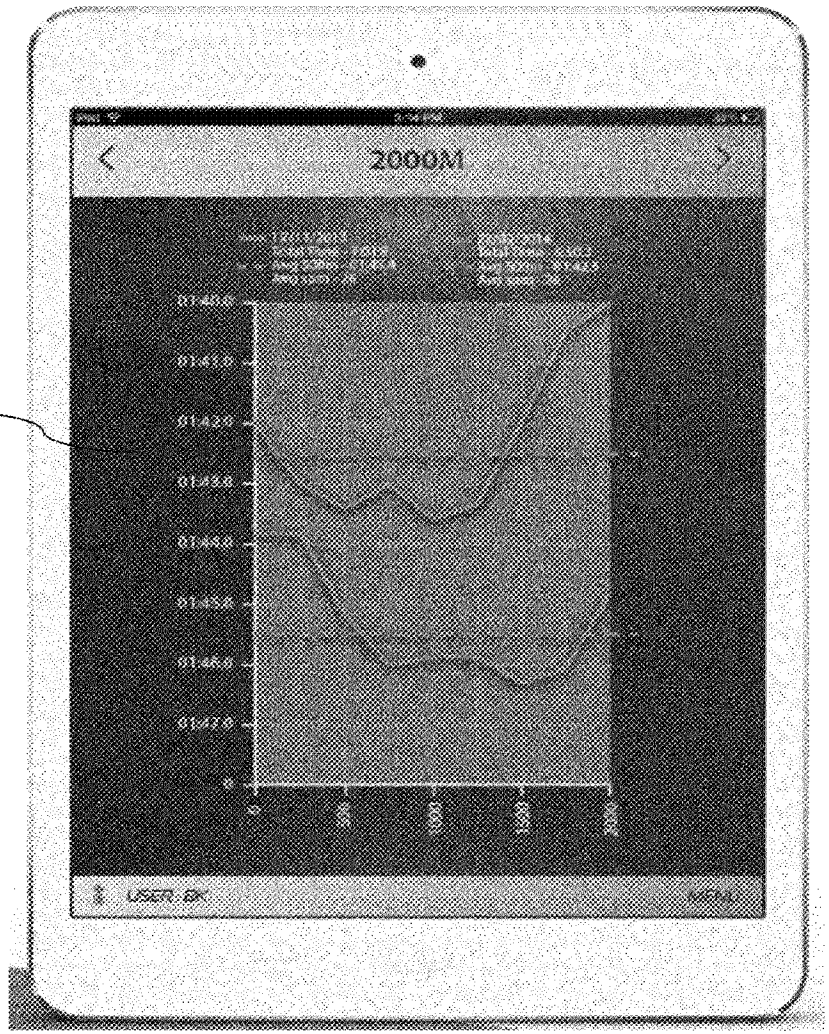

FIGS. 6C and 6D show further information that can be provided to a user. As shown in FIG. 6C this further information comprises distance, calories, average 500*m* split, power, length, distance per stroke (DPS). The embodiment of FIG. 6C also splits the results between left and right resistance mechanisms (or left and right legs/arms). The data gathered from the independent flywheels could be used to understand the effects of yaw on the "boat" as it travels forwards. This helps a user to train their left and right sides to ensure they travel in a straight direction, when needed. Where only one resistance mechanism is provided then only information pertaining to that mechanism will be provided. This may be for example in a sweep rowing configuration when only one oar is used. Where a plurality of rowing machines are connected then information may be provided pertaining to each user/rowing machine. The information for all rowers may be available on a single display, and a display displaying such information may be provided on one or more of the rowing machines. Knowledge of each other's performance statistics may help the users to synchronise with each other.

FIG. 6D shows a plot of a user's speed (average 500*m* splits) against distance travelled.

Figure 7A:
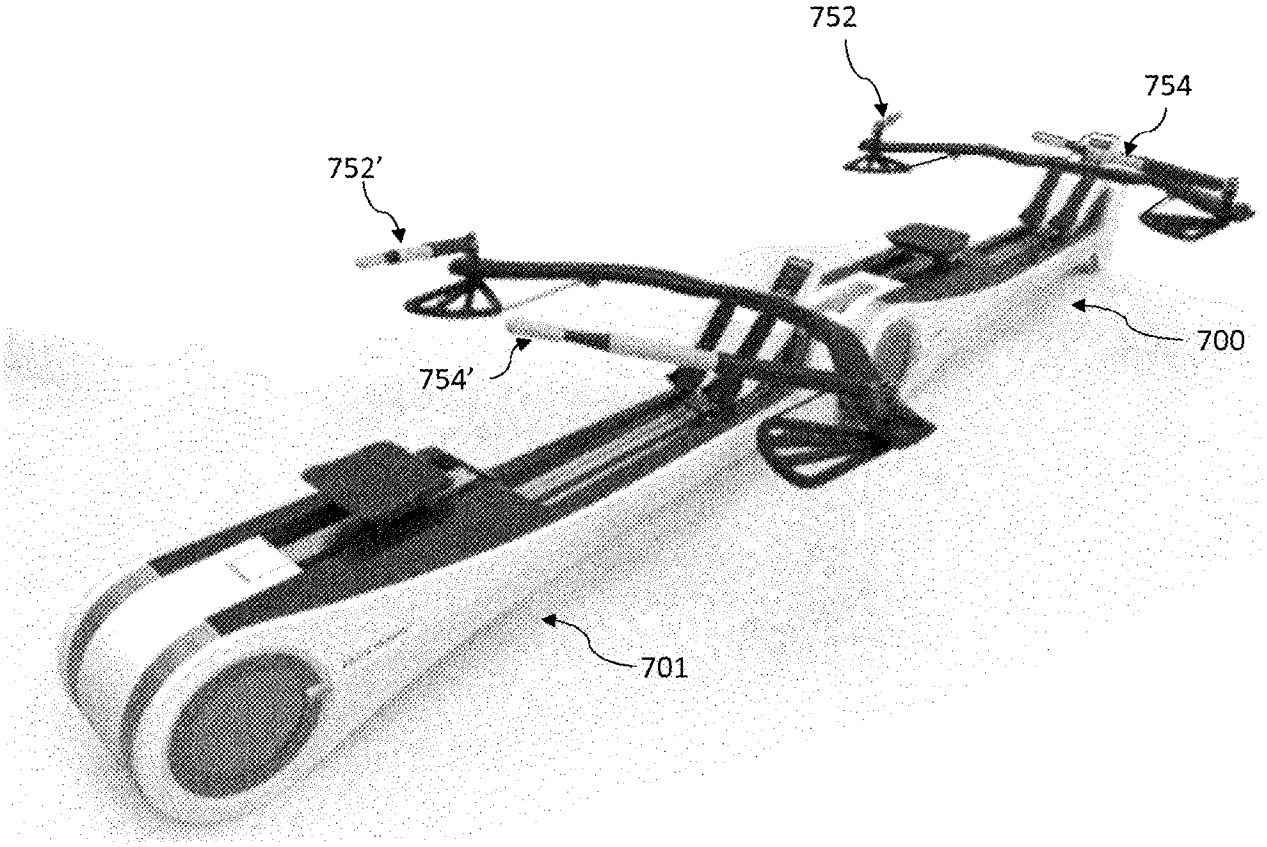
FIGS. 7A and 7B show two rowing machines linked together, according to another embodiment.
Figure 7B:
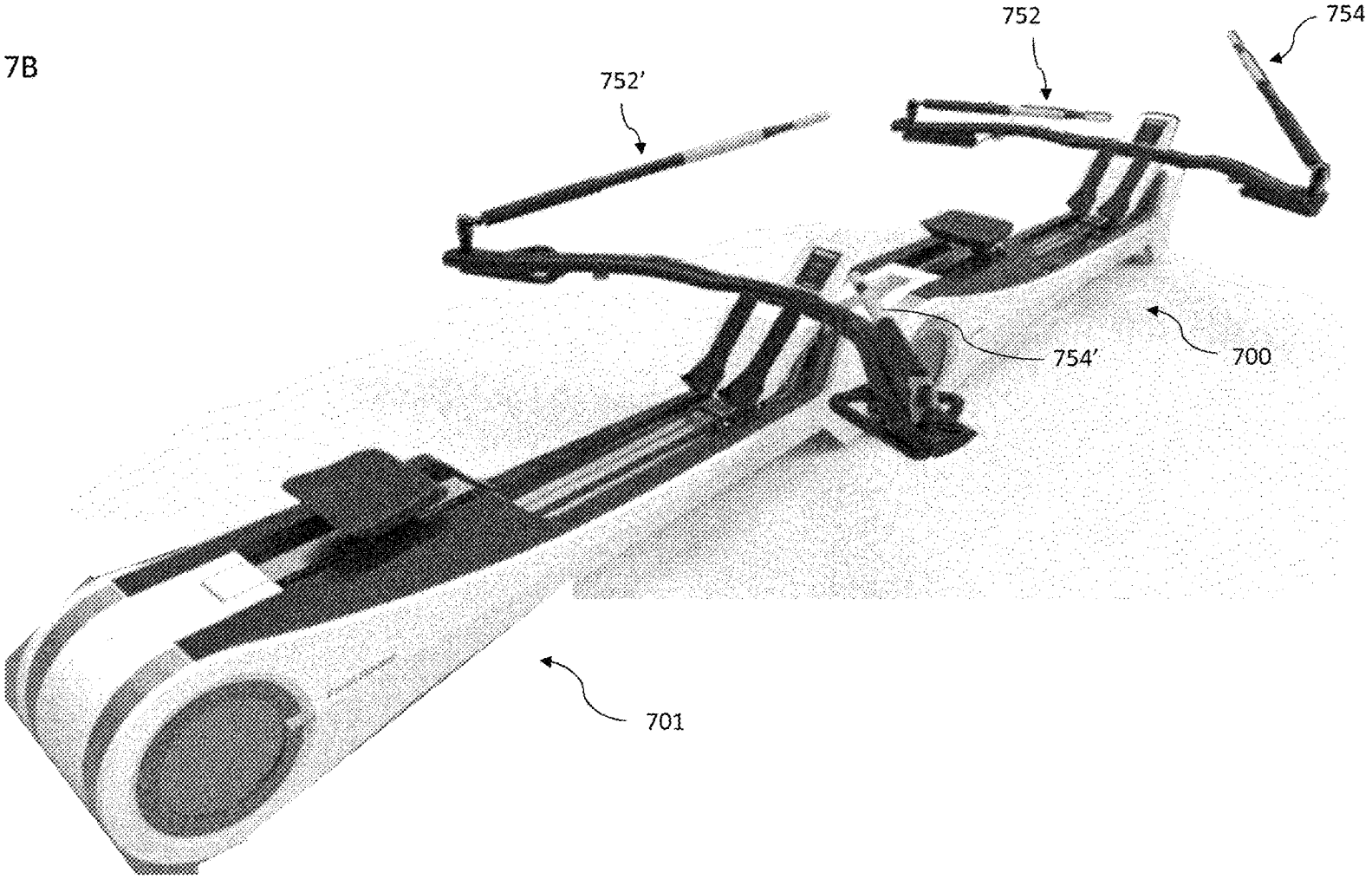

As shown in FIGS. 7A and 7B, the oars of the rowing machines can be configured for a sculling motion or a sweep motion respectively. In FIG. 7A both rowing machines 700 and 701 have their oars 752 and 754, and 752' and 754' in an operative position such that the user uses both oars when rowing i.e. a sculling configuration.

As shown in FIG. 76 the first rowing machine 700 has oar 754 in an operative position, and the other oar 752 has been folded in to an inoperative position. The second rowing machine 701 has its oar 752' in an operative position, and the oar 754' has been folded into an inoperative position. Therefore the user of the front rowing machine 700 can use a double handed action on oar 754, and the user of the second rowing machine 701 can use a double handed rowing action on oar 752' i.e. a sweep configuration.

Although in FIGS. 7A and 7B two rowing machines have been shown in series, it will of course be understood that the principle of selectively putting the oars in operative/inoperative configurations can be applied to any number of rowing machines.

Figure 8:
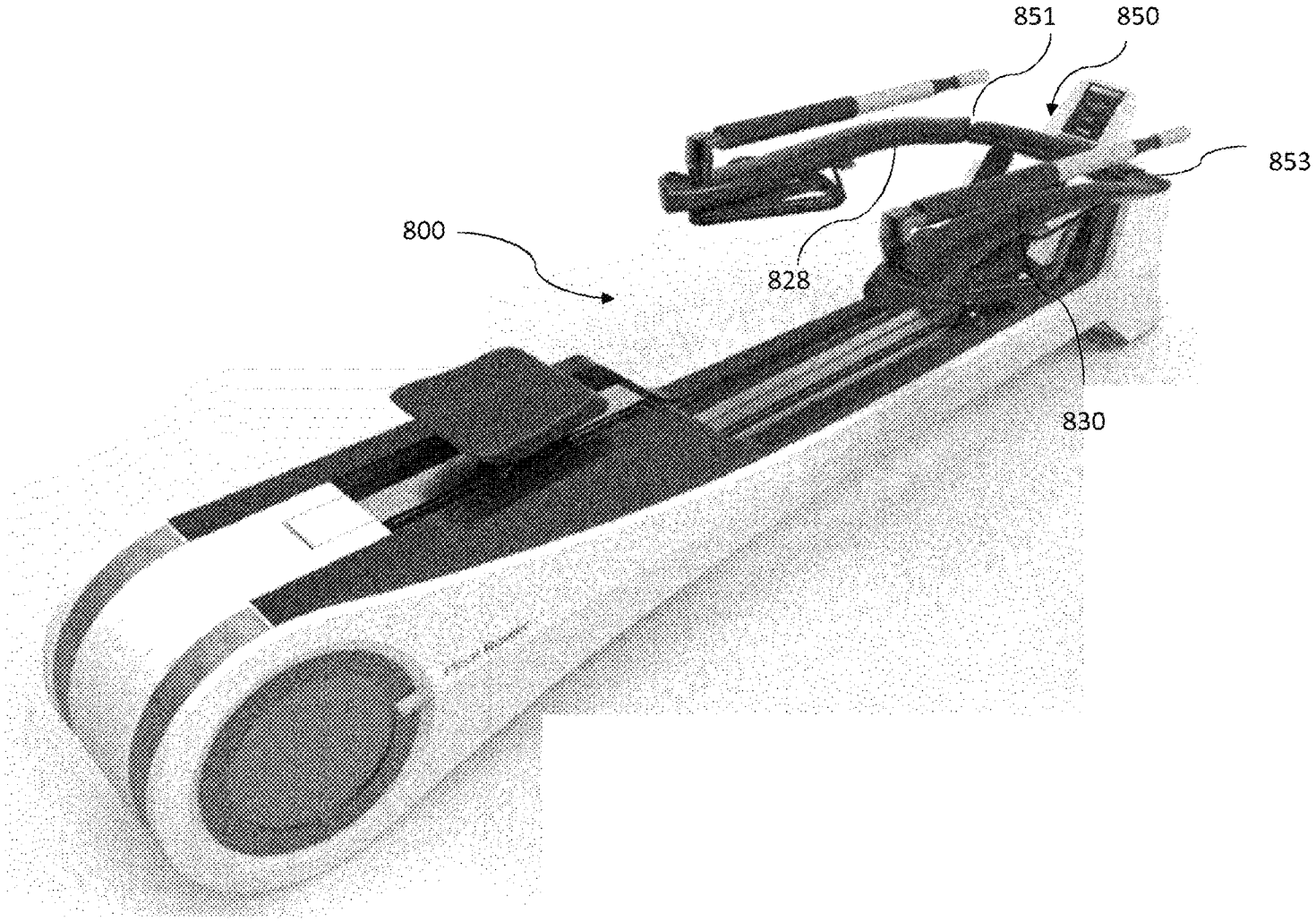
FIG. 8 shows a rowing machine with its oars in a stowed position, according to an embodiment.

FIG. 8 further shows a rowing machine 800. As shown, the cross member 850 comprises joint portions 851 and 853. This enables arm portions 828 and 830 of the cross member 850 to be folded inwardly to the rowing machine. This enables a compact arrangement for transport and/or storage.

Figure 9:
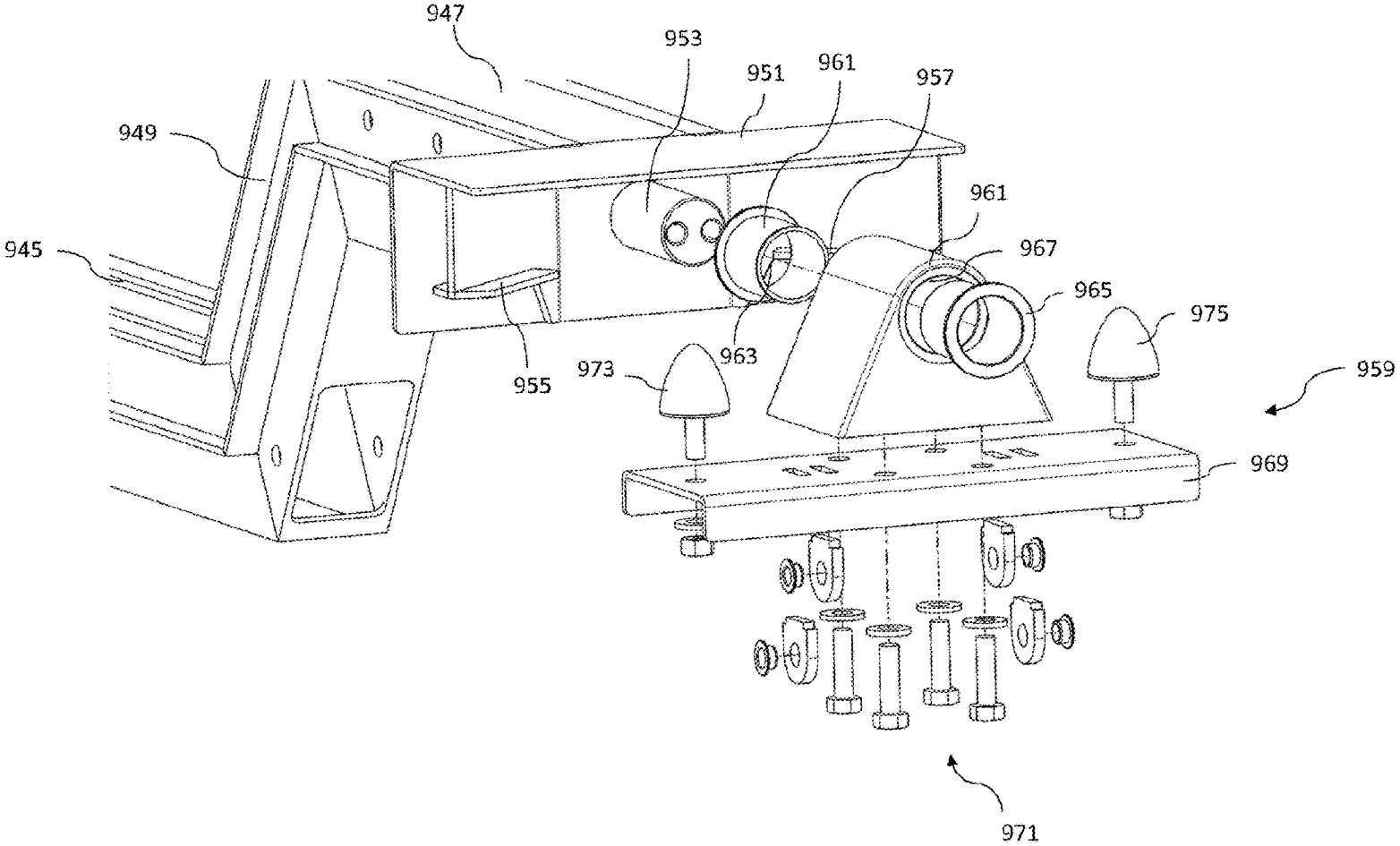
FIGS. 9 to 11B show a rolling mechanism in more detail, according to an embodiment.

FIG. 9 shows in more detail a rolling mechanism configured to enable the rail assembly or monorail (and consequently the seat portion and user), to roll during use of the rowing machine. This rolling mechanism may also be comprised in any of the earlier described embodiments. In FIG. 9 regions 945, 947, and 949 of the monorail are shown. A bracket, herein referred to as a roll bracket 951 is attached to a rear end of the rail 947. The roll bracket 951 comprises a rearwardly extending projection in the form of a tube 953. The roll-bracket comprises stops 955 and 957.

An exploded view of the roll mechanism is shown generally at 959. The roll mechanism 959 comprises a bearing block 961, which in this embodiment is generally triangular in shape. Flange bearings 963 and 965 are insertable into a cylindrical through-hole 967 of the bearing block 961. The bearing block 961 is attachable to a plate 969 with fixing means 971, which in this embodiment is in the form of a screw and washer arrangements. Bump-stops 973 and 975 are attachable to the plate 969. In this embodiment the bump stops are conical. Each bump-stop comprises an elongate cylindrical portion for insertion through a corresponding hole in the plate 969, and an enlarged or dome shaped portion for interacting with the stops 955 and 957 on the roll bracket 951. The dome shaped portions of the bump-stops 973 and 975 are formed from a compressible and resilient material, for example rubber.

Figure 10B:
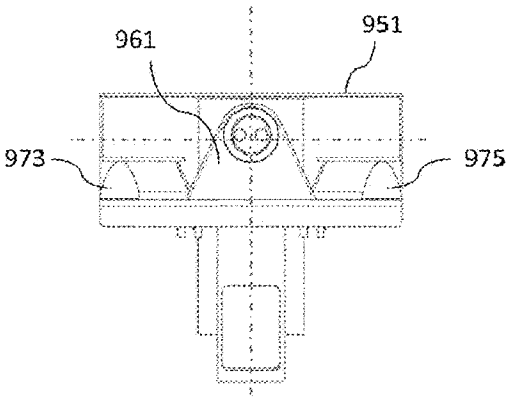
Figure 10A:
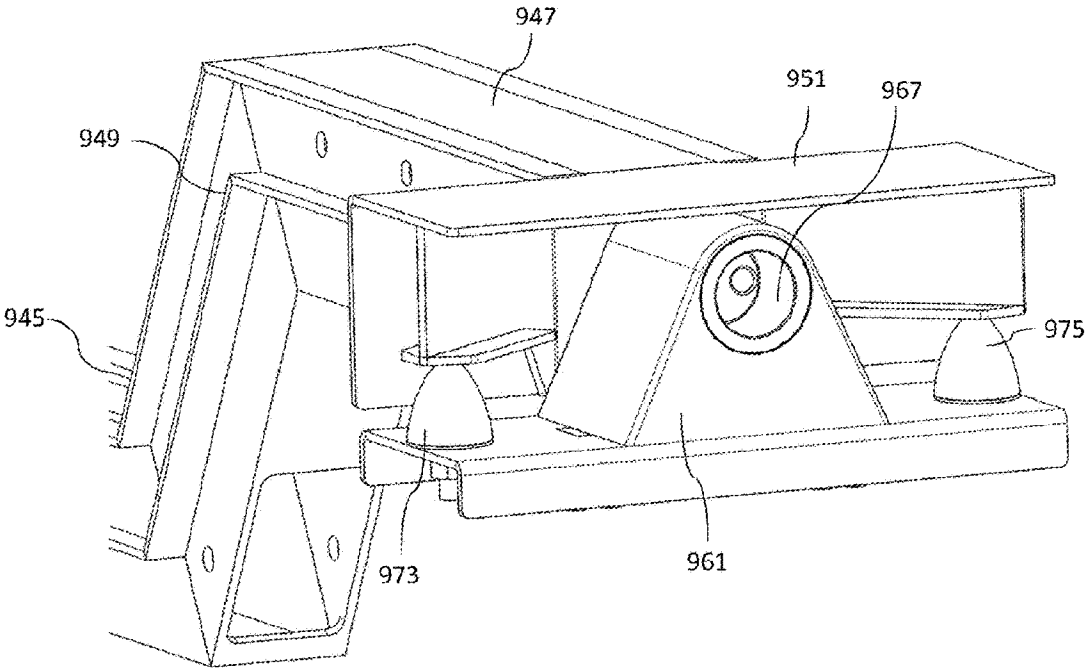

The roll mechanism is shown in its assembled state in FIGS. 10A and 10B, where FIG. 10A is a perspective view and FIG. 10B is an end on view. In these Figures the roll mechanism is in a "rest" position. That is as best seen in FIG. 10B the roll bracket 951 is horizontal, or in other words there is 0° of roll. The through-hole 967 may be configured to receive a front end of a further rowing machine, and more particularly may receive a corresponding rolling mechanism at a front-end of the further rowing machine, thus enabling synchronised rolling between multiple machines.

Figure 11B:
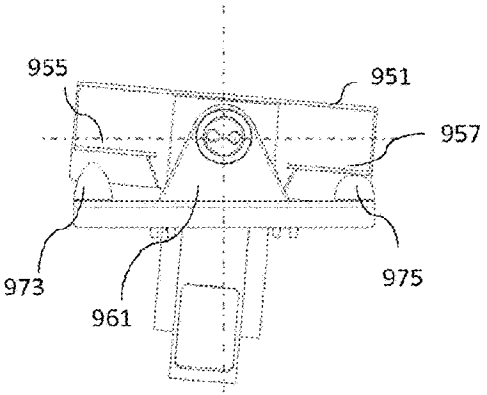
Figure 11A:
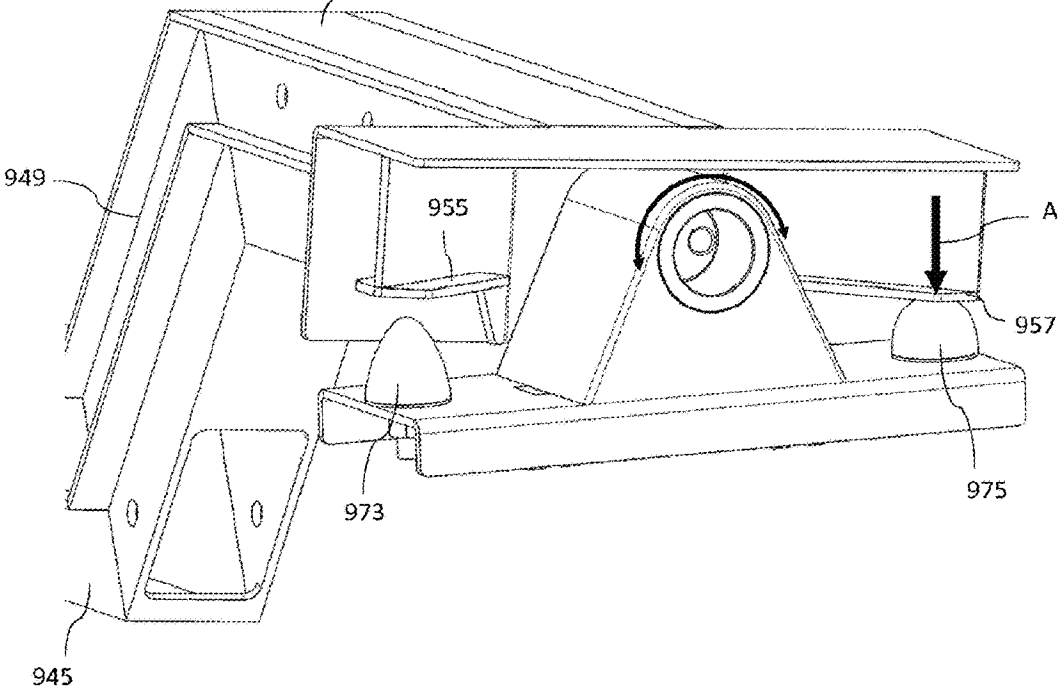

FIGS. 11A and 11B show the rolling mechanism under a rolling action. In this example the user has caused the rolling mechanism to rotate 5° clockwise, causing a corresponding rotation of the monorail. As displayed by arrow A this has caused a downward movement of bracket 957 which has thus pushed down on and compressed bump-stop 975. Likewise, the bracket stop 955 has lifted off bump-stop 973.

Although in FIGS. 11A and 11B a roll angle of 5° has been described for the purposes of example, it will of course be understood that larger or smaller roll angles are possible. Nevertheless the rolling mechanism may be configured to limit the maximum amount of roll to a certain degree e.g. 45°. In some embodiments the maximum degree of roll is defined by the distance of the brackets 955 and 957 above their respective bump-stops 973 and 975 in the rest position. The degree of roll may also be controlled by the resilience of the bump-stops 973 and 975. The bump-stops may be replaced to enable bump-stops of different resilience to be inserted. For example the rowing machine may be supplied with a number of sets of bump-stops, which can be selected by the user depending upon how much resistance to rolling they want. For example a novice may want a relatively hard bump-stop, so as to provide more resistance to roll, whereas a more experienced user may want a relatively soft bump-stop to enable a greater degree of rolling. Heavier users may also choose harder bump-stops than lighter users.

In some embodiments the pitch and/or roll mechanism is lockable, independently or together. When locked the monorail is prevented from pitching and/or rolling. To this end a locating pin may be provided that is insertable into the pitching and/or rolling mechanism(s) to prevent pitching and/or rolling thereof. This enables a user to lock and unlock the pitching and/or rolling mechanism as and when required. In some embodiments the heights of the bump stops 973 and 975 can be adjusted to alter the degree of roll permitted, and/or to adjust the sensitivity to rolling.

Figure 12:
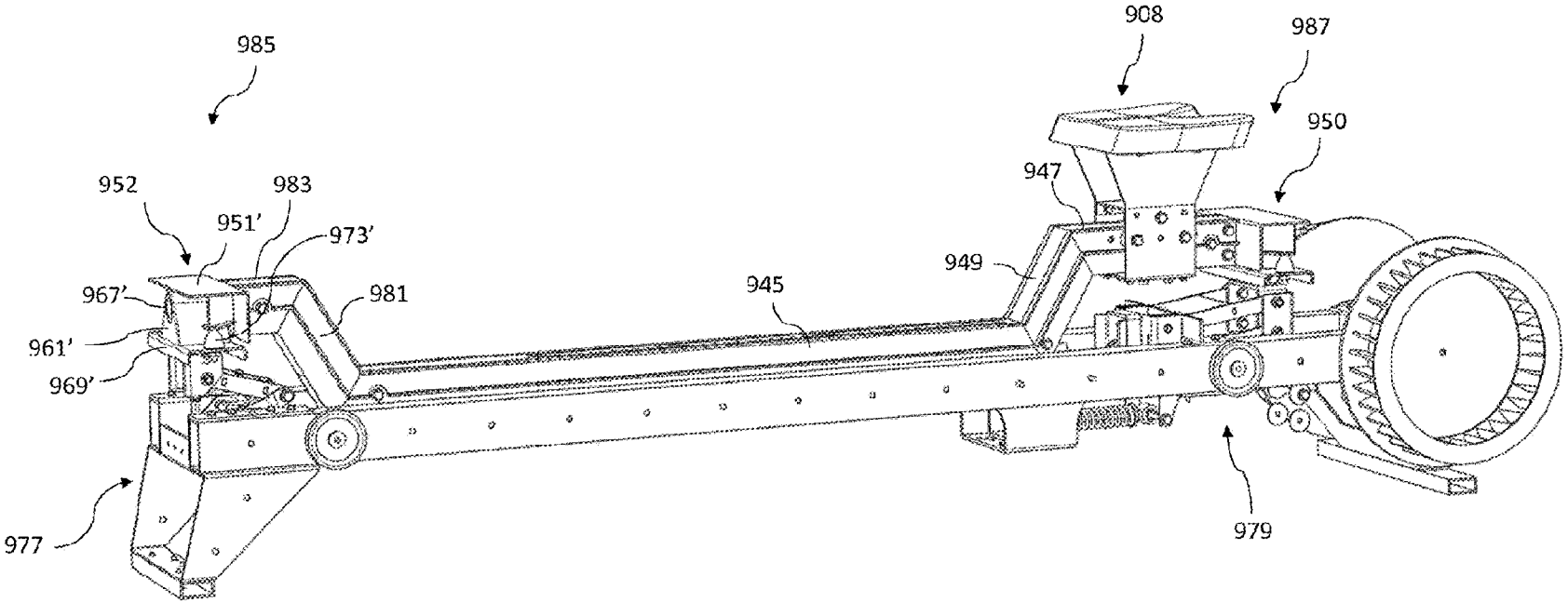
FIGS. 12 to 17 show a damping mechanism of a rowing machine, according to an embodiment.

As shown in FIG. 12 the monorail can be supported for rotation at both ends thereof. In FIG. 12 the rear rotation mechanism is shown generally at 950, and the front rotation mechanism is shown generally at 952. The front rotation mechanism may be the same as or similar in construction to the rear rotation mechanism. As shown in FIG. 12 the front rotation mechanism comprises a bearing block 961', a roll bracket 951', a plate 969' and bump-stops 973' and 975' (only bump-stop 973' is visible in FIG. 12). The bearing block 961' also comprises through-hole 967' which as explained above enables multiple rowing machines to be fixed together for rotation.

In some embodiments multiple rowing machines can be connected in a way that enables the rolling mechanism of each rowing machine to act independently.

Also shown in FIG. 12 are front damping mechanism 977 and rear damping mechanism 979. As will be explained in more detail with respect to the subsequent Figures, the mechanisms 977 and 979 enable the monorail to pitch relative to the longitudinal axis of the rail, mimicking the lifting and dropping of the front and rear ends of a rowing boat. Also visible in FIG. 12 is seat portion 908.

In addition to rail portions 945, 947 and 949, also shown in FIG. 12 is front ramped portion 981 and end portion 983. The portions 983, 981, 945, 949 and 947 may be integrally formed, or may be formed from one or more separate sections connected in any suitable way to form a rail assembly, rail portion or "monorail". Thus the monorail has a front or first end 985 and a rear or second end 987. The first end 985 is attached to first rolling mechanism 952, and second end 987 is connected to second rolling mechanism 950. The rail assembly may therefore be considered to be suspended or slung between first end 985 and second end 987 of the rowing machine.

Figure 13:
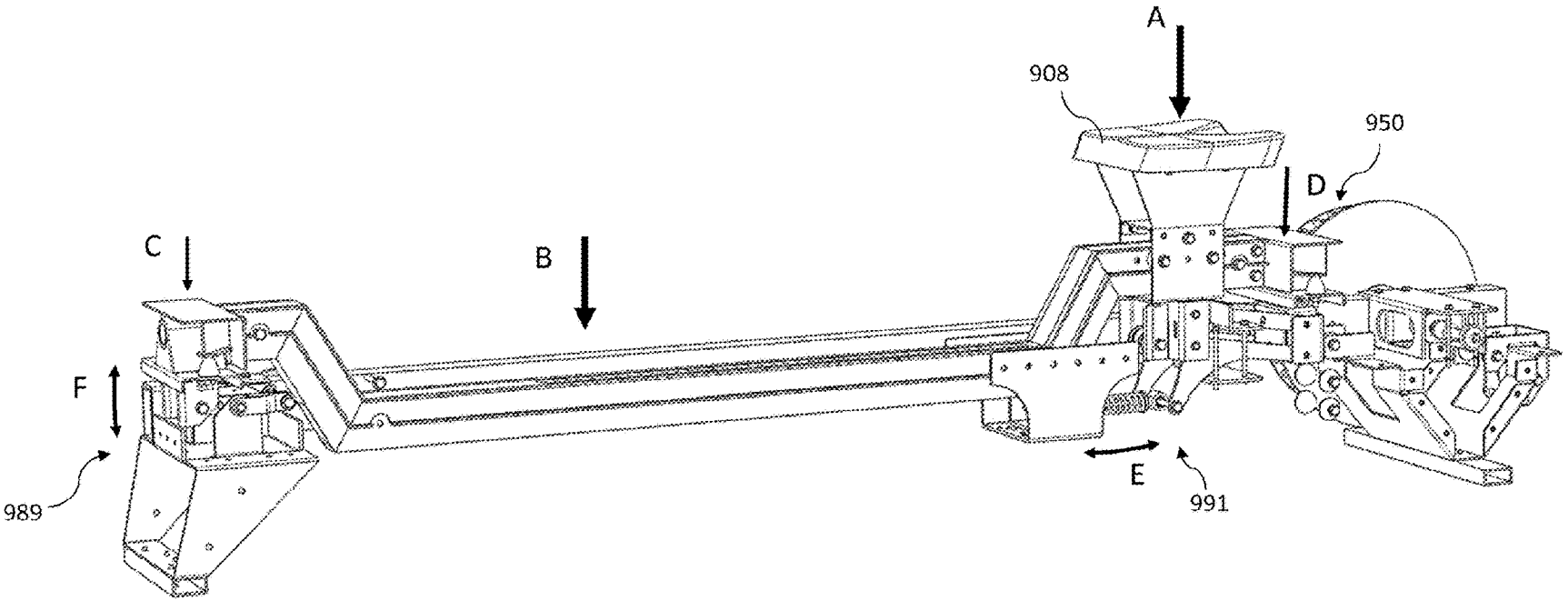

FIG. 13 shows a user's weight pressing down on seat portion 908 (see arrow A). The user's weight may also press down through the foot plate assembly (see arrow B). This weight or force is distributed between a first or front damping assembly shown generally at 989 and a second or rear damping assembly shown generally at 991. The weight or force acting on front damping assembly 989 is represented by arrow C, and the weight or force acting on rear damping assembly 991 is shown by arrow D. The forces acting on the front and rear damping assemblies may vary during a stroke cycle. For example at some point of the stroke the front damping assembly 989 may support the majority of the user's weight, whereas at other points in the stroke the rear damping assembly 991 may support the majority of the user's weight/force. The front and rear damping assemblies will be explained in more detail in the subsequent Figures.

As can be seen from FIG. 13 the rear damping assembly 991 is connected to the rail assembly via linkages. The damping assembly 991 comprises a spring and damper assembly which are disposed in a longitudinal axis parallel to the longitudinal axis of the rail assembly. Therefore any vertical movement of the seat portion 908 is transferred via linkage arrangement to a horizontal movement of the spring and damper assembly, as represented by arrow E. The front damping mechanism 989 comprises a vertically mounted spring arrangement, such that vertical force at the front (e.g. represented by arrow C) is transferred in a vertical direction through the front damping assembly as shown by arrow F.

The rear damping arrangement 950 is described in more detail with respect to FIGS. 14 and 15. The rear roll mechanism 959 is mounted atop rear damping assembly 991. The damping mechanism 991 comprises a shock absorber 1002 which comprises a damper 1004 mounted within a spring 1006 in a MacPherson strut type arrangement. The shock absorber 1002 is attached at a first end 1008 to a mounting bracket 1010. The bracket 1010 may be fixed to a main body portion of the rowing machine when fully assembled. A second end of the shock absorber 1012 is attached to a linkage arm 1014 about a locating shaft 1016.

The linkage arm 1014 comprises a dual linkage arm in this embodiment. The linkage arm 1014 is further connected to a bracket 1018 with locating shafts 1020 and 1022, and is further connected to bracket 1024 with locating shafts 1026 and 1028. The rolling mechanism 959 is fixed to bracket 1024. All of the fixing points are free to pivot about their respective locating shafts 1016, 1018, 1022, 1026 and 1028. Therefore the linkage 1014 can rotate about its locating shafts.

Figure 14A:
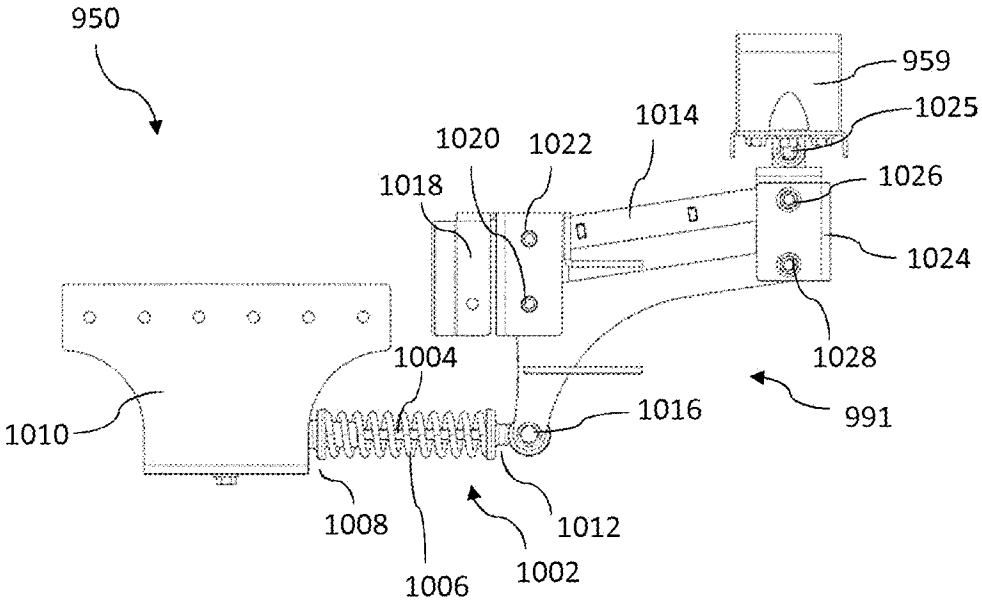
Figure 14B:
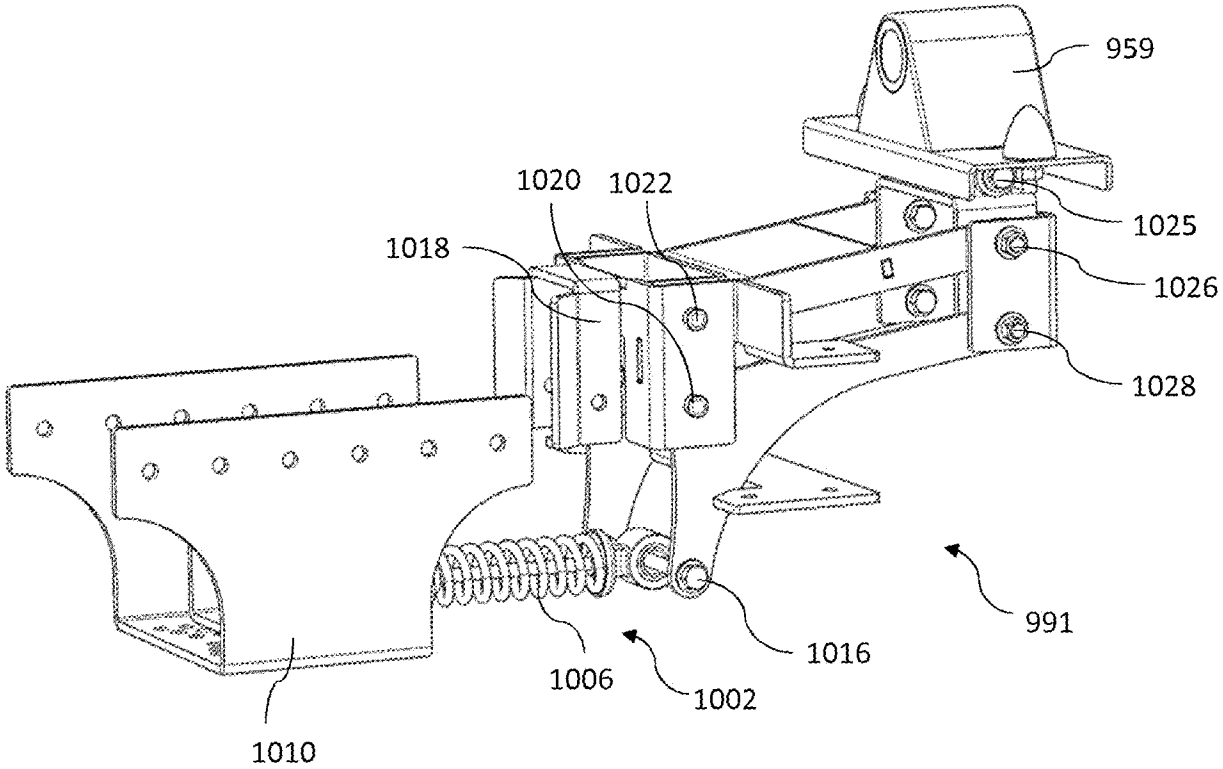

In FIG. 14A the damping mechanism 991 is shown in a rest position, and the spring 1006 is in its extended state. FIG. 14B is a perspective view of FIG. 14A, showing the spring in an uncompressed (free) state. Also to be noted from FIGS. 14A and 14B is that the roll mechanism is mounted on brackets which allow the roll mechanism to remain in-line with the monorail, due to a slight arc caused by the deflection movement. Furthermore, pivoting at the rear in the region of shaft 1025 allows for variation in front and rear deflection during the stroke, which will aid simulation of pitching in a boat.

Figure 15A:
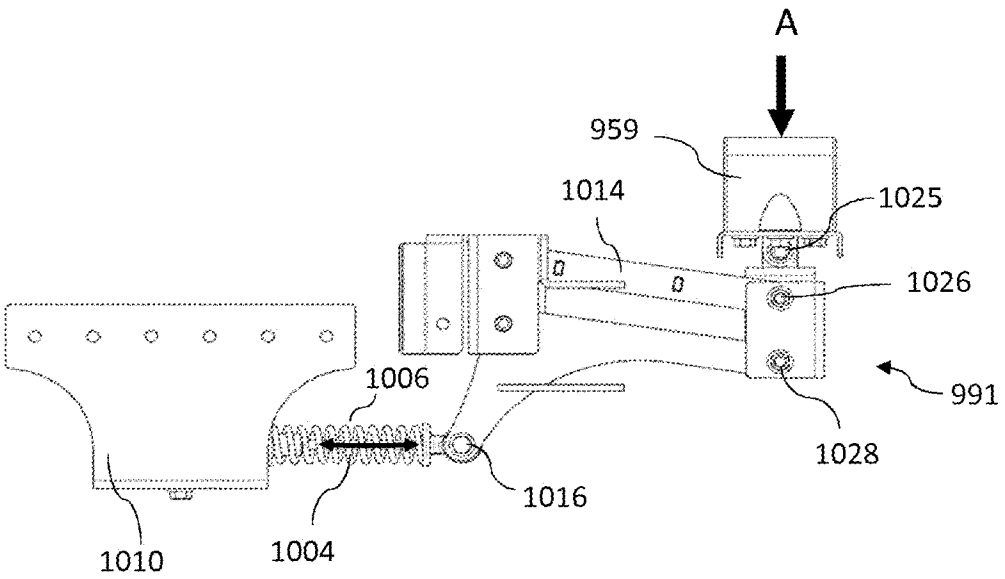
Figure 15B:
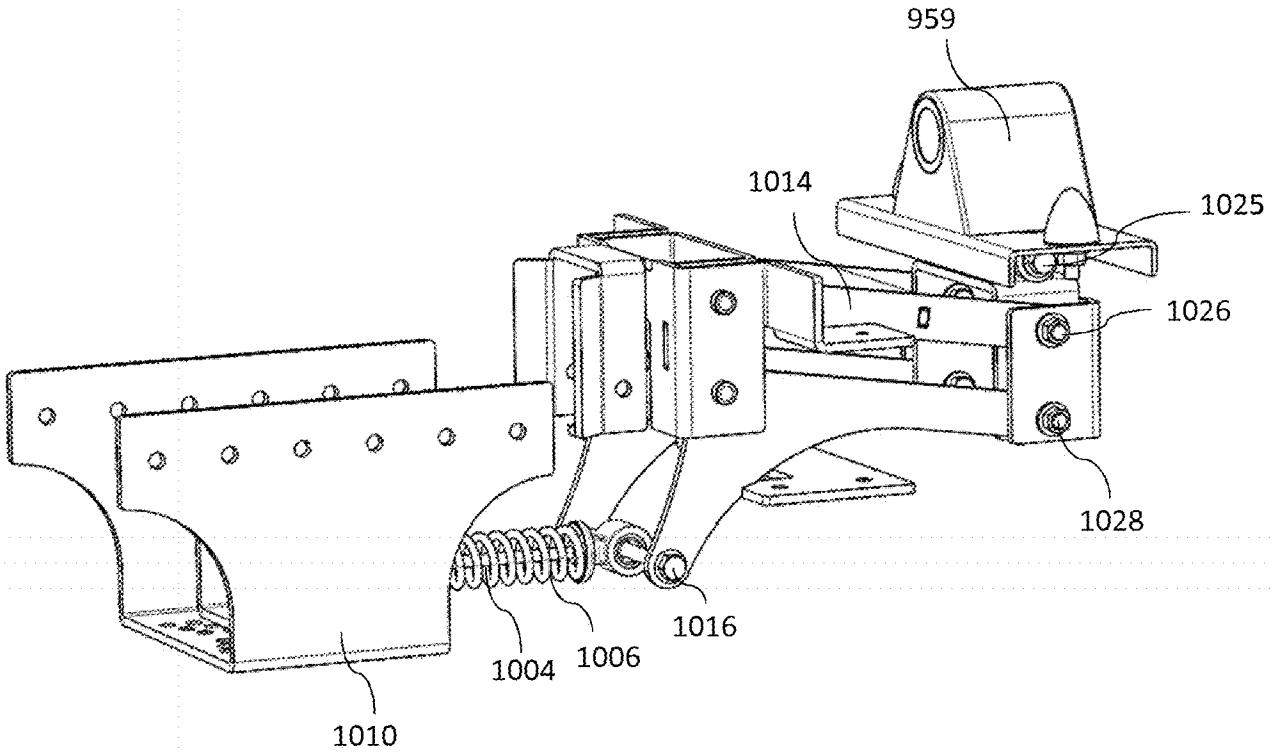

FIG. 15A shows the damping mechanism 991 when a weight or force is applied, as shown by arrow A. The application of this force has caused the linkage arm 1014 to rotate clockwise when viewing FIGS. 14 and 15. This accordingly causes the end of the swing arm in which locating shaft 1016 is positioned to move to the left when viewing FIGS. 14 and 15, thus causing spring 1006 to compress. The rate of compression and rebound of the spring is controlled by damper 1004. It will be appreciated that the rotational mechanism 959 has maintained its generally vertical orientation despite rotation of linkage arm 1014, by virtue of connection via rotatable locating shafts 1026 and 1028. Therefore vertical motion of the seat portion may be transferred to horizontal motion of the shock absorber 1002, by the linkage mechanism. FIG. 15B is a perspective view of FIG. 15A, showing the spring 1006 in a compressed state.

Figure 16A:
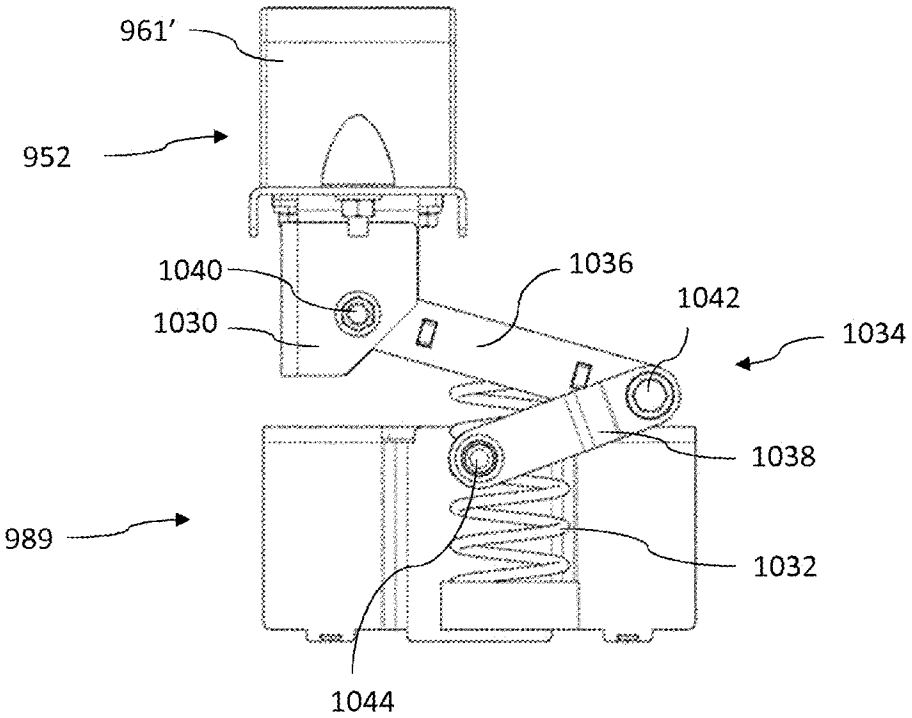
Figure 16B:
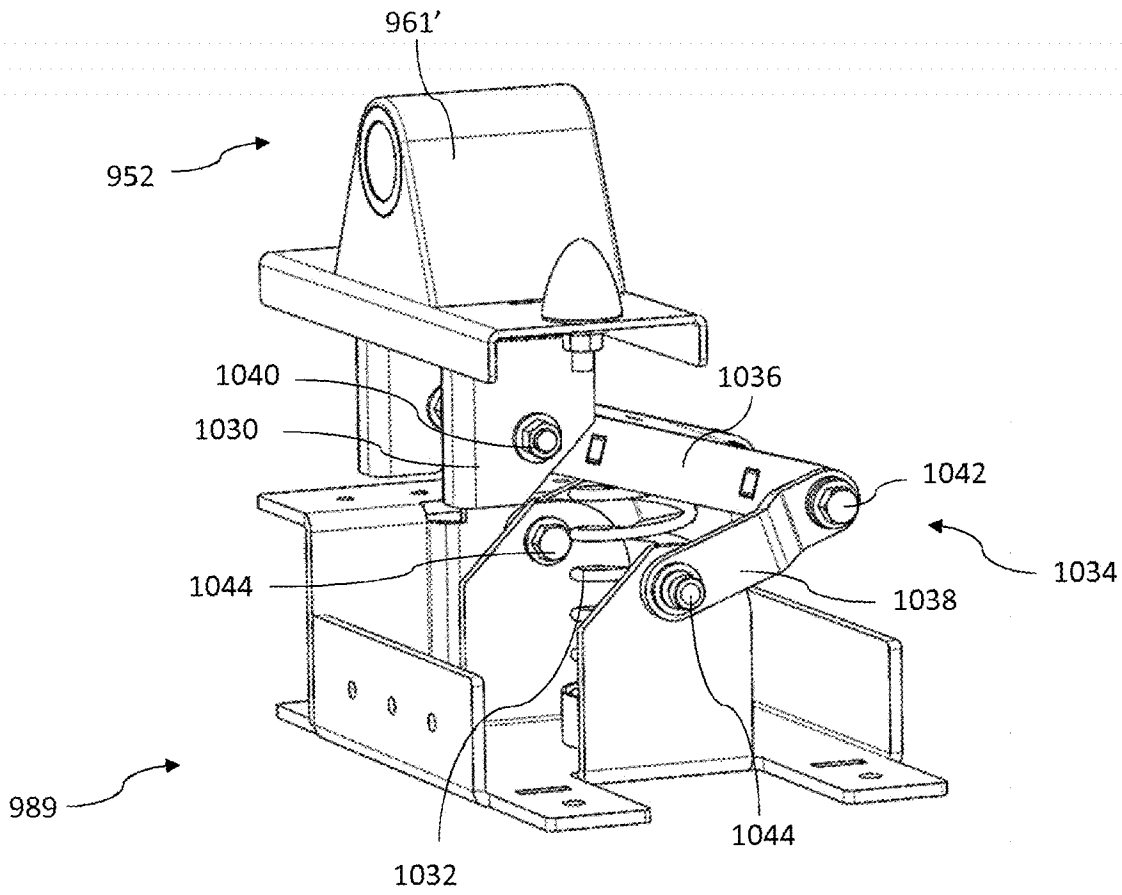

The front damping mechanism 989 is described in more detail with respect to FIGS. 16 and 17. As shown in FIG. 16A the front rolling mechanism 952 is attached to a bracket 1030. The bracket 1030 is operatively connected to a spring 1032 via linkage mechanism 1034. The linkage mechanism 1034 comprises a first link 1036 and a second link 1038. The first link 1036 is attached at a first end to the bracket 1030 with a locating shaft 1040. The first link 1036 is connected to the second link 1038 with a further locating shaft 1042. The second link 1038 is operatively connected to the spring 1032 with a locating shaft 1044. The fixing points are free to pivot about the locating shafts 1040, 1042 and 1044. One end of the spring 1032 is attached to a flat portion of link 1036. In FIG. 16A the front damper mechanism 989 is shown in its uncompressed state, when no weight or force is applied thereto. FIG. 16B is a perspective view of FIG. 16A.

Figure 17A:
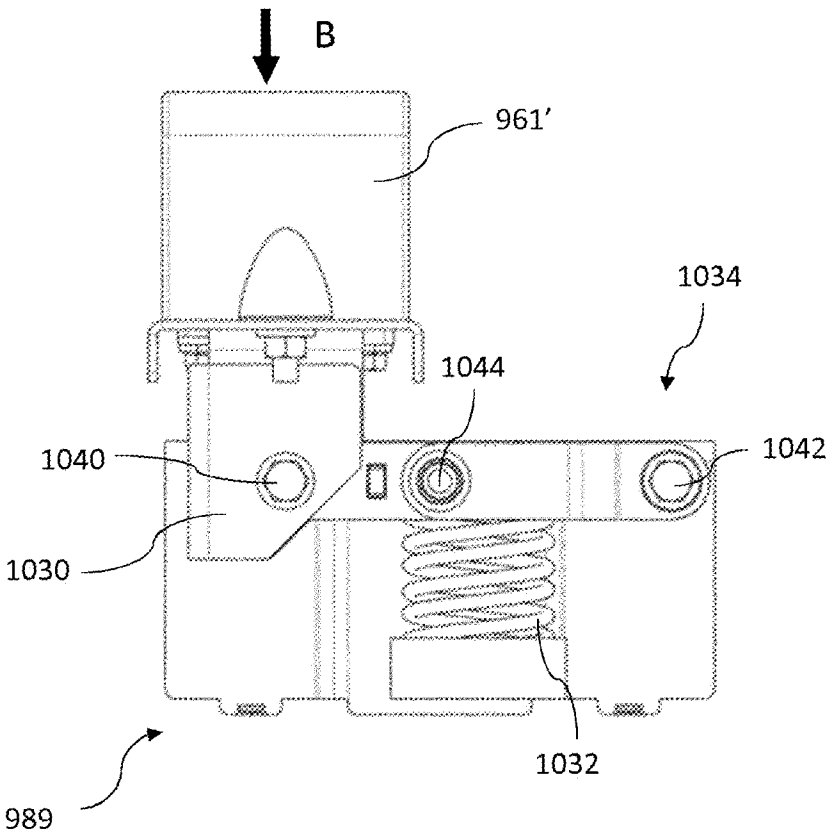
Figure 17B:
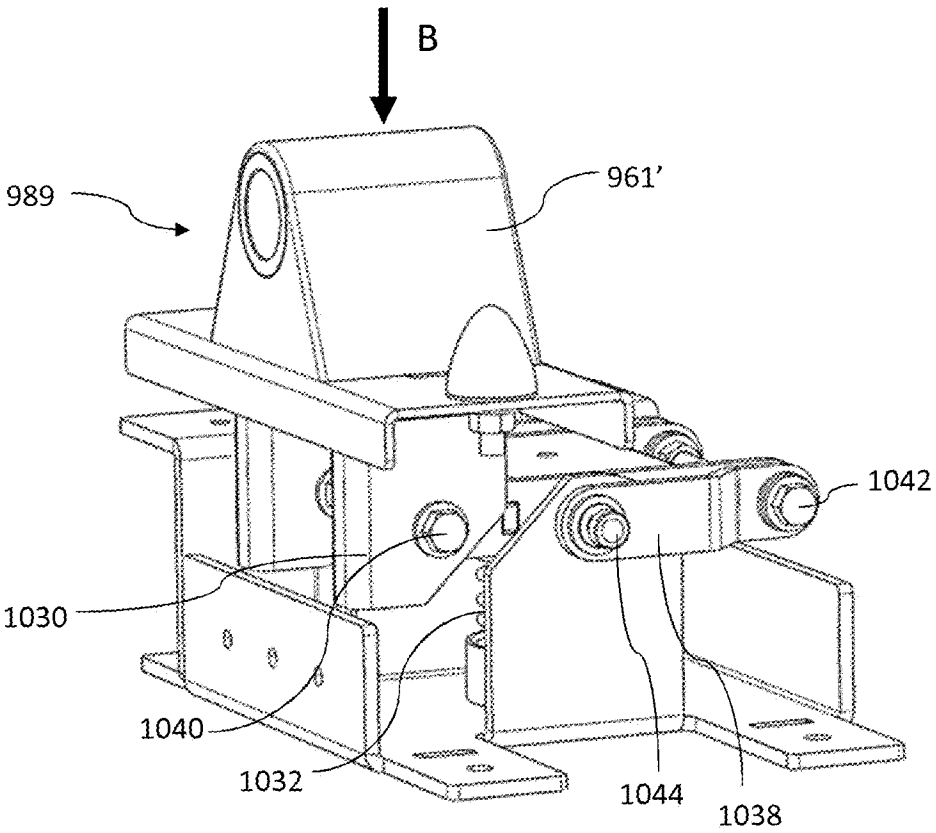

FIG. 17A shows the front damping mechanism 989 when a downward force is applied, as shown by arrow B. This causes downward movement of bearing block 961' and bracket 1030, thus causing the linkage arms 1036 and 1038 to close via a scissor action and to compress spring 1032. It will be appreciated that the roll mechanism 961' has maintained a generally vertical orientation during downward movement of the roll mechanism, by virtue of the linkage mechanism 1034. In this embodiment the damper mechanism 989 is shown as comprising a spring 1032. In other embodiments a damper may also be provided in a similar manner to the rear damper mechanism 991. FIG. 17B is a perspective view of FIG. 17A, showing the spring 1032 in a compressed state.

It will be understood that in other embodiments different mechanisms may be used to provide the necessary damping. In the described embodiments the rear shock absorber is configured to compress and decompress in a horizontal direction, and the front shock absorber is shown to compress and decompress in a vertical direction relative to the longitudinal direction of the rail assembly. In other embodiments any orientation or combination of orientations of the front and rear damper mechanisms may be provided. The shock absorbers furthermore do not have to be in horizontal or vertical planes, rather in other embodiments they may be angled to the horizontal and/or vertical. Nevertheless the embodiment described with respect to FIGS. 13 to 17 is considered to provide a space efficient arrangement.

Figure 18A:
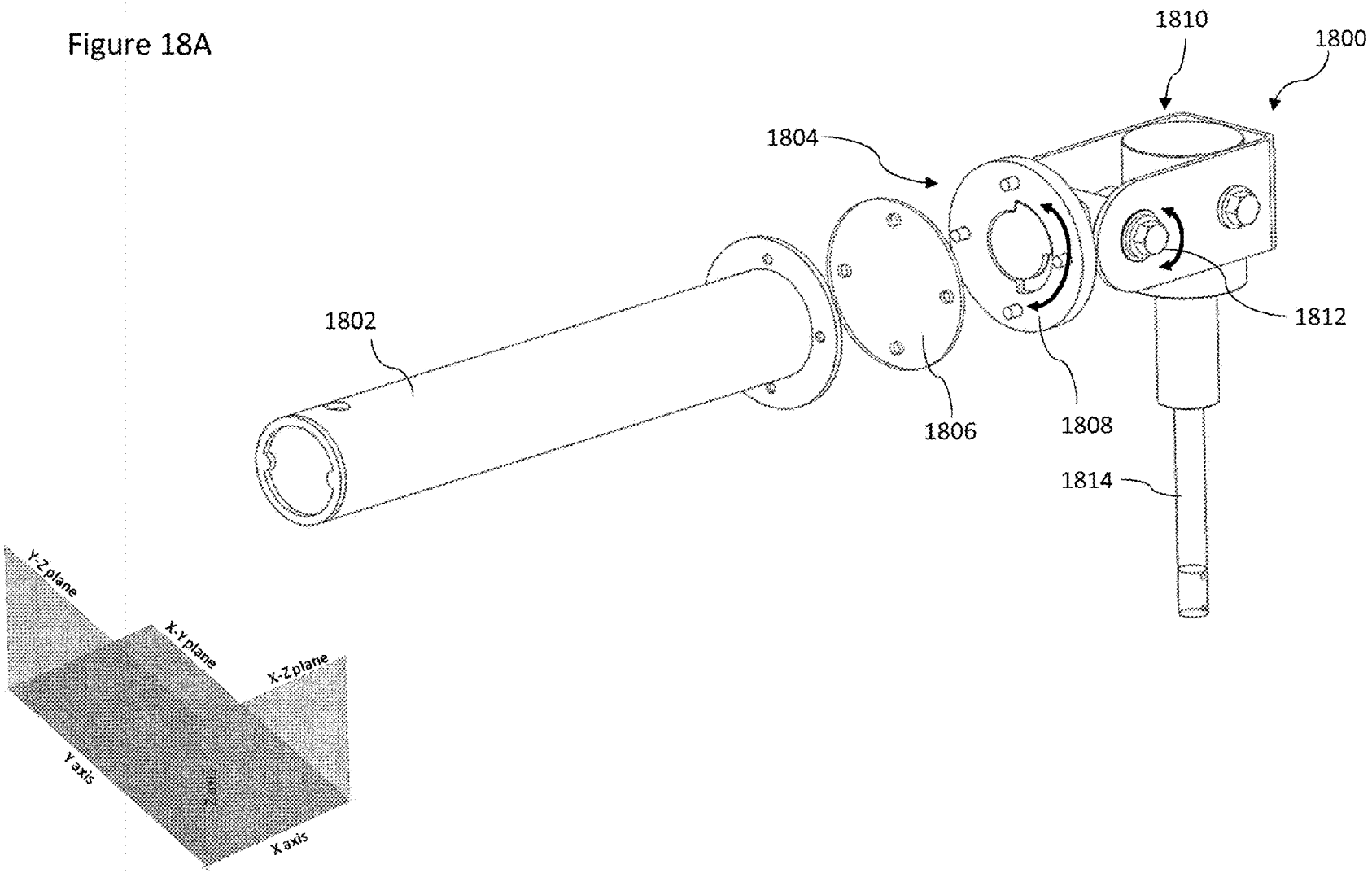
FIGS. 18A and 18B show a handle assembly of a rowing machine, according to an embodiment.

As discussed previously, a linkage mechanism may be provided for the oars, which enables feathering and squaring of the oar members, as well as enabling a user to replicate the tapping down and raising of the hands. An example of such a linkage mechanism is shown in FIG. 18A. The linkage mechanism 1800 comprises a handle base 1802 to which a handle or oar member can be attached. The handle base 1802 is attachable to bearing 1804 comprising bearing surface 1806 and plate 1808. Thus the handle base (and accordingly the handle) can rotate about the x-axis on the YZ plane which allows rotation of the handle (i.e. mimicking squaring and feathering).

The bearing 1804 is attached to a three-axis pivot 1810. A shaft 1812 is rotatable to allow the handle 1802 to rotate about the Y axis on the XZ plane, which allows up and down movement of the handle to mimic tapping down and raising hands at the catch.

A shaft 1814 is insertable in a corresponding mounting (not shown) to enable rotation about the Z axis on the XY plane which allows movement back and forth with the handle. Accordingly an authentic handle movement can be provided to the user.

Figure 18B:
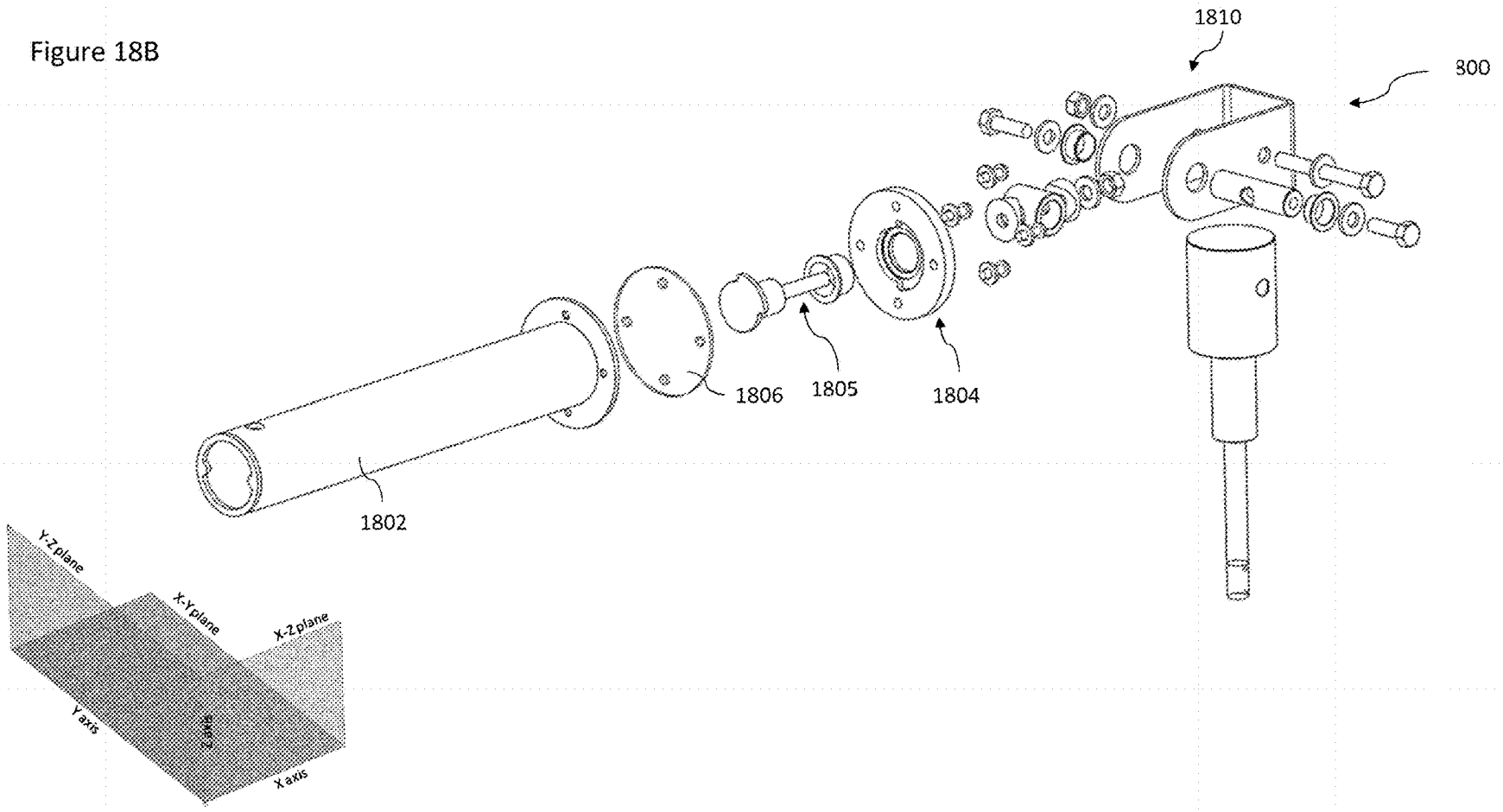

FIG. 18B shows the linkage mechanism of FIG. 18A in an exploded manner. Further shown in FIG. 18B is a 90 degree rotating pin 1805 which is attachable to bearing 1804.

Figure 19A:
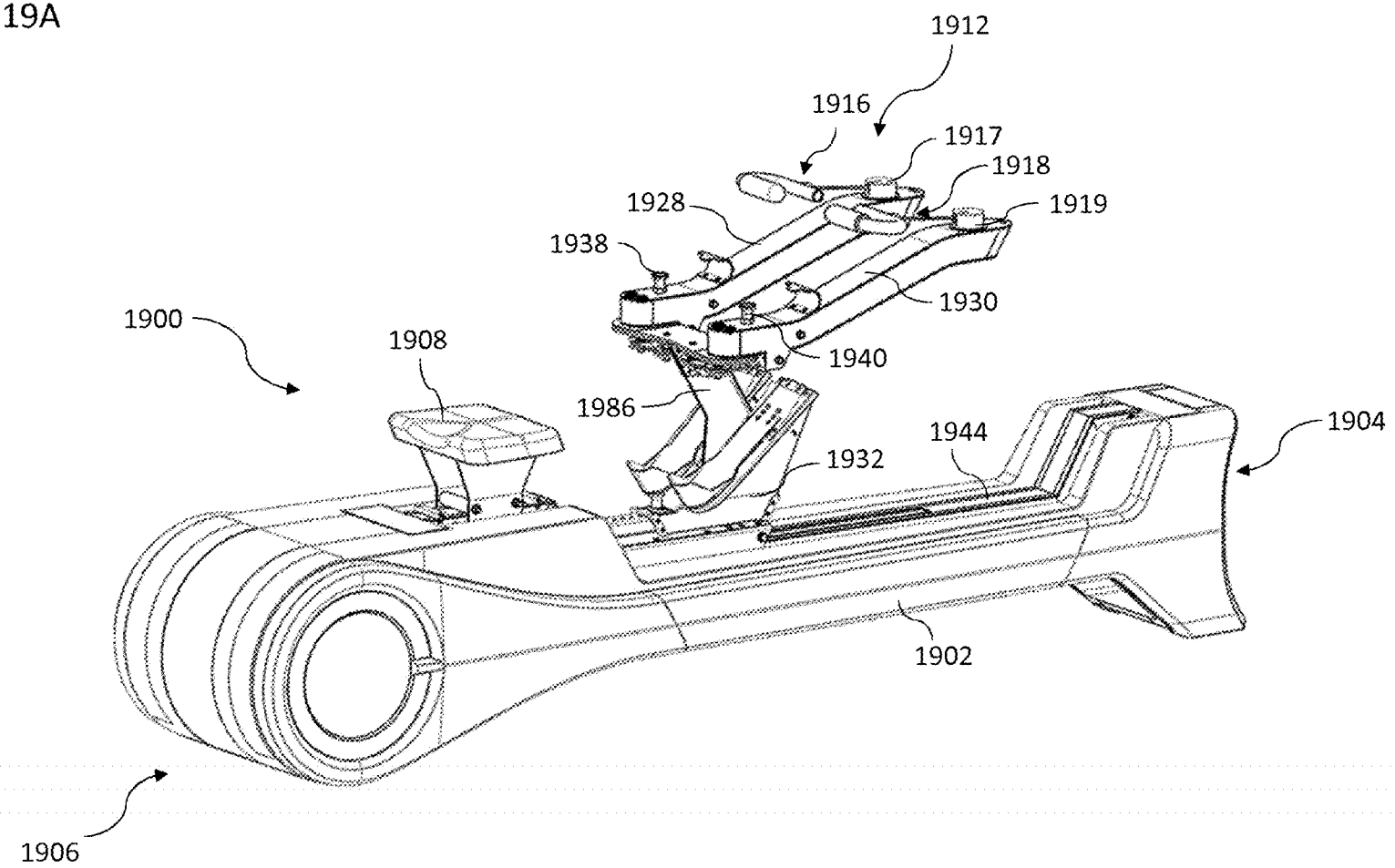
FIGS. 19 to 21 show a rowing machine according to another embodiment.
Figure 19B:
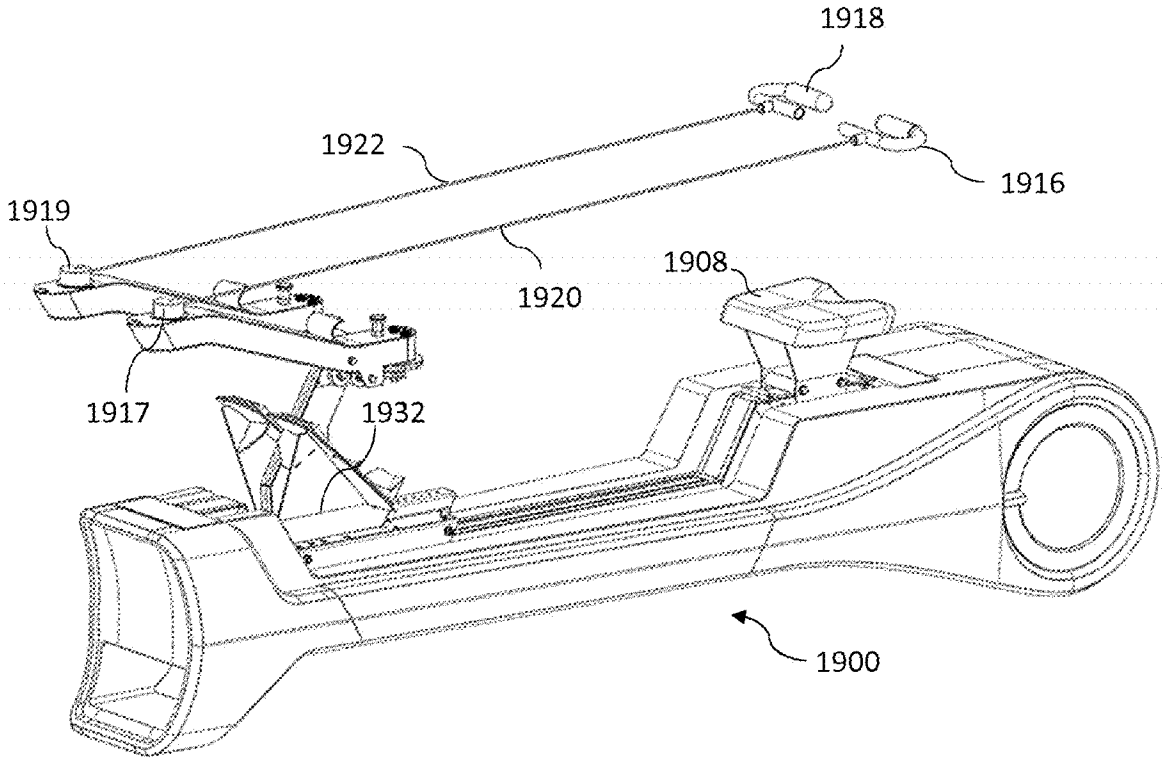

FIGS. 19A and 19B show a rowing machine according to a further embodiment. The rowing machine 1900 comprises a main body portion 1902 extending from a front end 1904 to a rear end 1906. A slidable seat portion is shown at 1908 and a slidable foot plate assembly is shown at 1932. The rail assembly is shown at 1944. In FIG. 19A the rowing machine is shown in the "catch" position.

The rowing machine 1900 further comprises arms 1928 and 1930. Arm 1928 is connected to the foot plate assembly 1932 with a rotating shaft and located with an index plunger 1938. The arm 1930 is attached to the footplate assembly 1932 with a rotating shaft and located with an index plunger 1940. This enables the arms to be adjusted between a straight position (as shown in FIG. 19A), and one or more indexed angled positions as will be described in more detail later. The rowing machine 1900 comprises handle portion 1912 comprising hand grip portions 1916 and 1918 connected to respective swinging pulleys 1917 and 1919 via cables 1920 and 1922 (see FIG. 19B). The swinging pulley assemblies allow for freedom of movement for the hand grip portions 1916 and 1918 during use in all indexed angled arm positions. This further allows for the ability to "tap down" and "raise the hands" as when rowing on the water.

FIG. 19B shows the rowing machine of FIG. 19A in the "finish" position.

Figure 20:
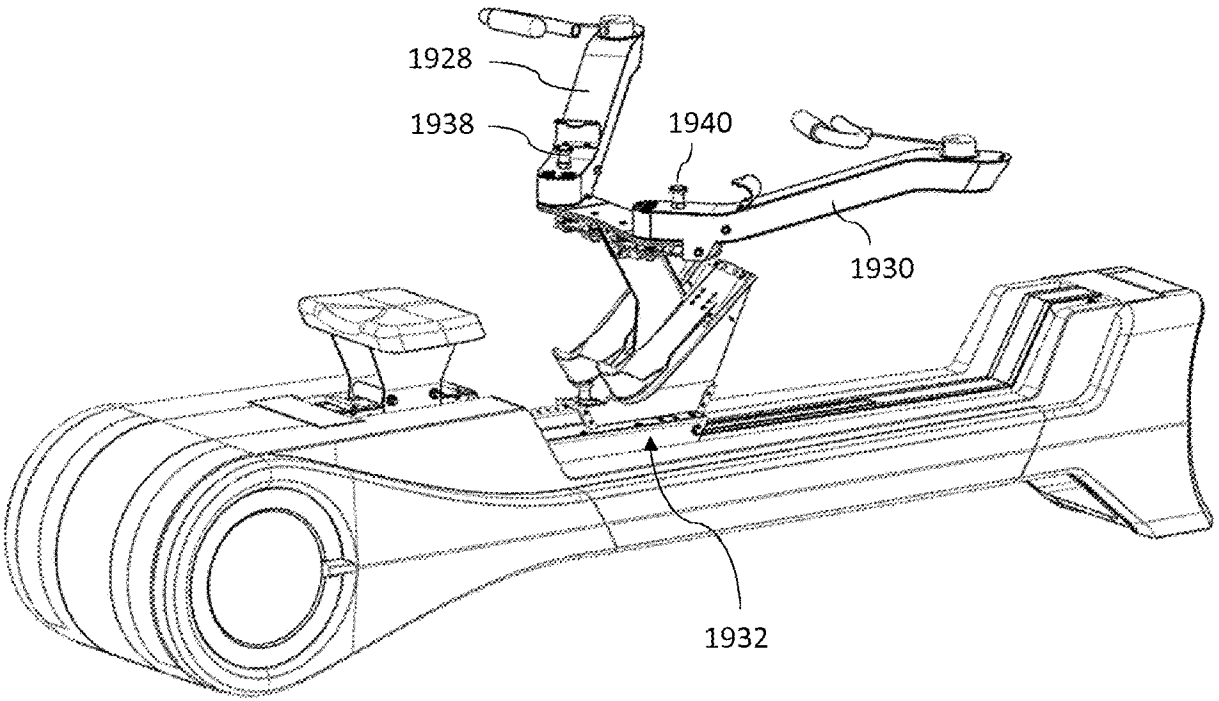

FIG. 20 shows the rowing machine of FIGS. 19A and 19B, where the arms 1928 and 1930 have been adjusted to an angled position using index plungers 1938 and 1940. This enables a user to open the swing arms 1928 and 1930 to a realistic catch position. In embodiments the footplate assembly 1932 may also be adjustable for height (up and down) and depth (back and forth).

Figure 21:
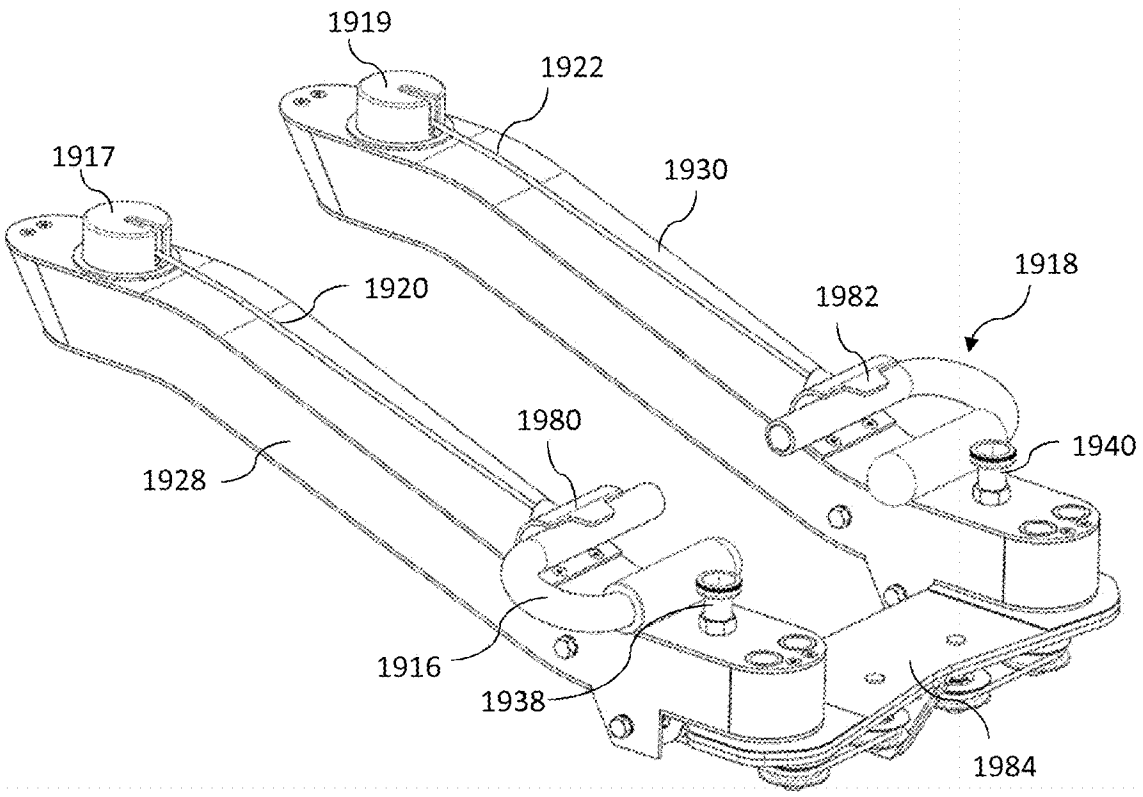

FIG. 21 shows the rigging assembly in more detail. Also shown in this Figure are handle retainers 1980 and 1982 for respectively retaining handles 1916 and 1918 when not in use. The rigger assembly also comprises a rigger base 1984 which is attachable to a corresponding bracket 1986 of the footplate assembly 1932 (see FIG. 19A).

It will be appreciated that the arms 1928 and 1930 can be independently indexed between straight and angled positions. When both arms are in their angled orientation then this replicates the position of a sculler at the beginning of their stroke, at the catch position.

Furthermore, in some embodiments the left and right arms 1928 and 1930 are identical to reduce manufacturing/assembly time and costs.

Figure 22A:
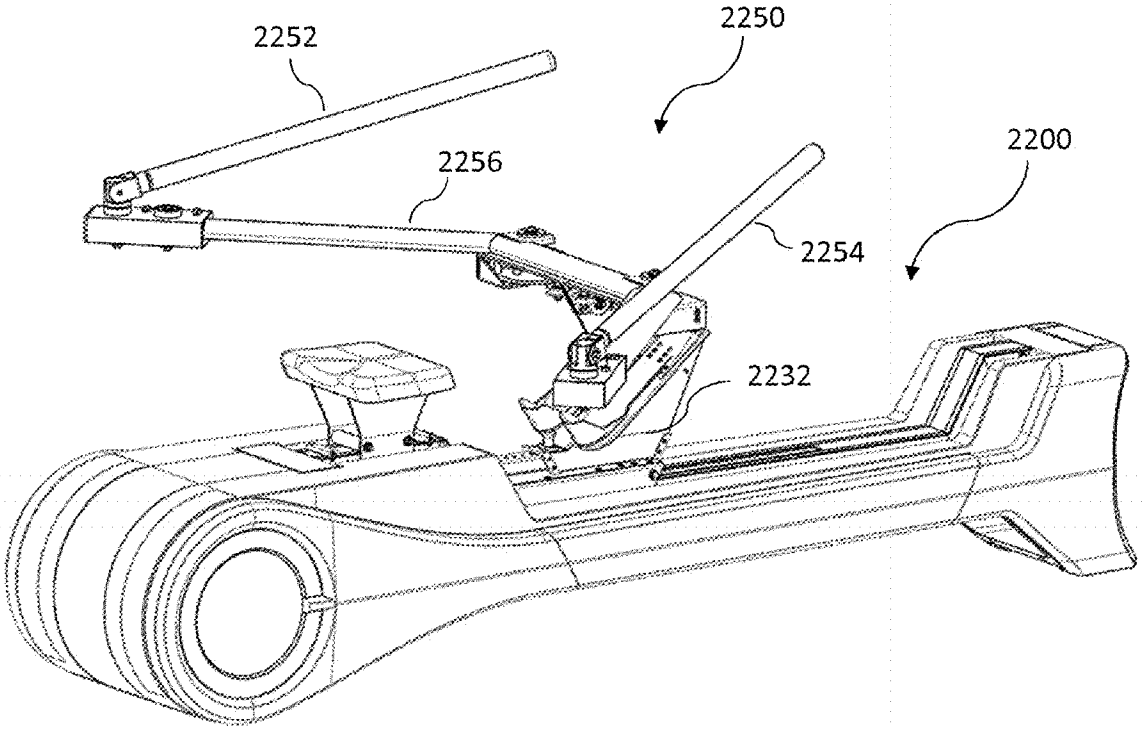
FIGS. 22 to 24 show a rowing machine according to another embodiment.
Figure 22B:
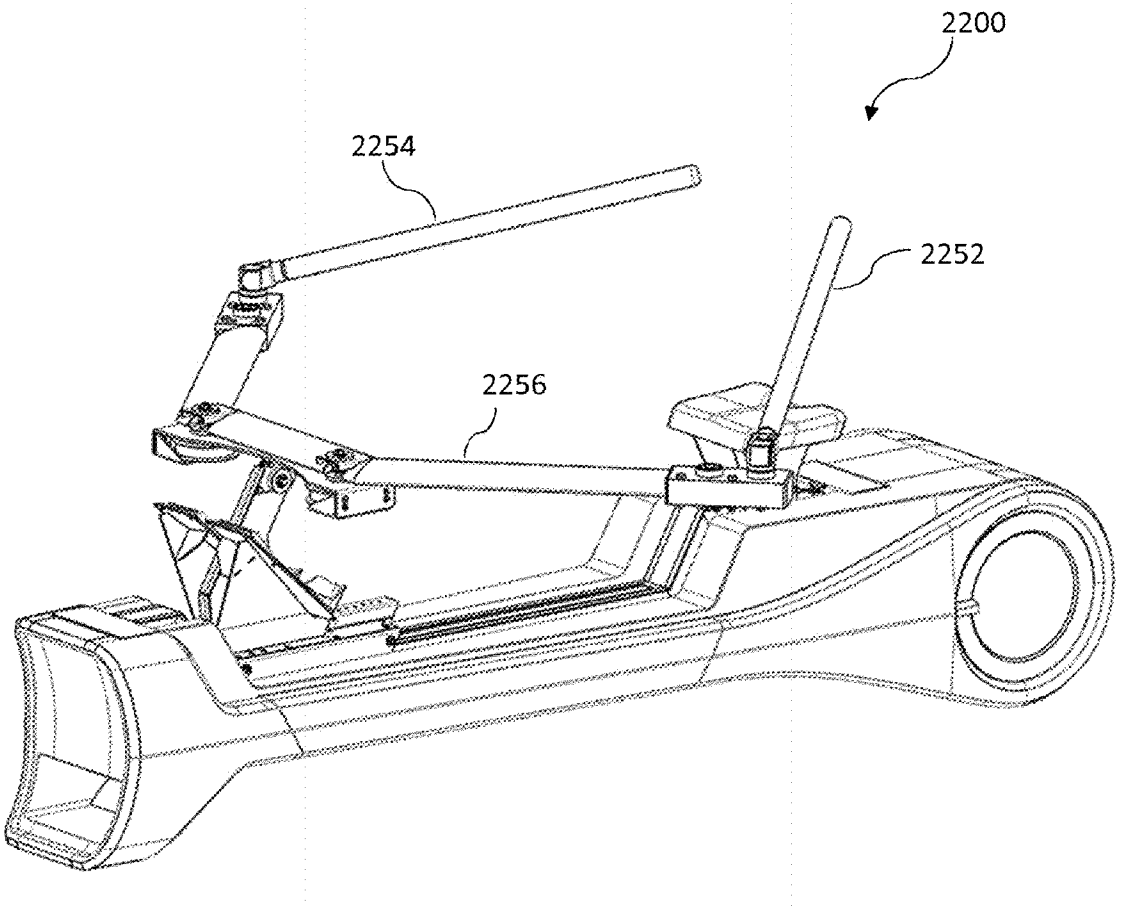

FIGS. 22A and 228 show a rowing machine 2200 according to a further embodiment. In this embodiment the rigging assembly 2250 comprises a cross member 2256 to which are attached oar members 2252 and 2254. In FIG. 22A the rowing machine 2200 is shown in the catch position, and in FIG. 22B the rowing machine 2200 is shown in the finish position.

Figure 23A:
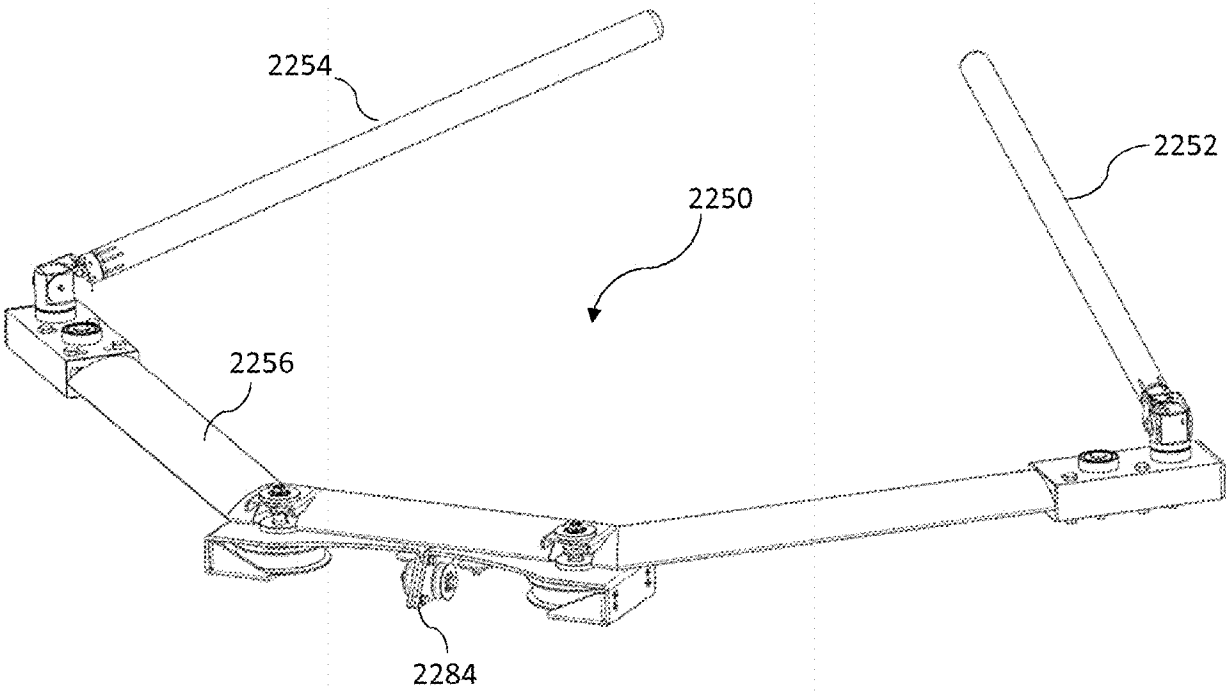
Figure 23B:
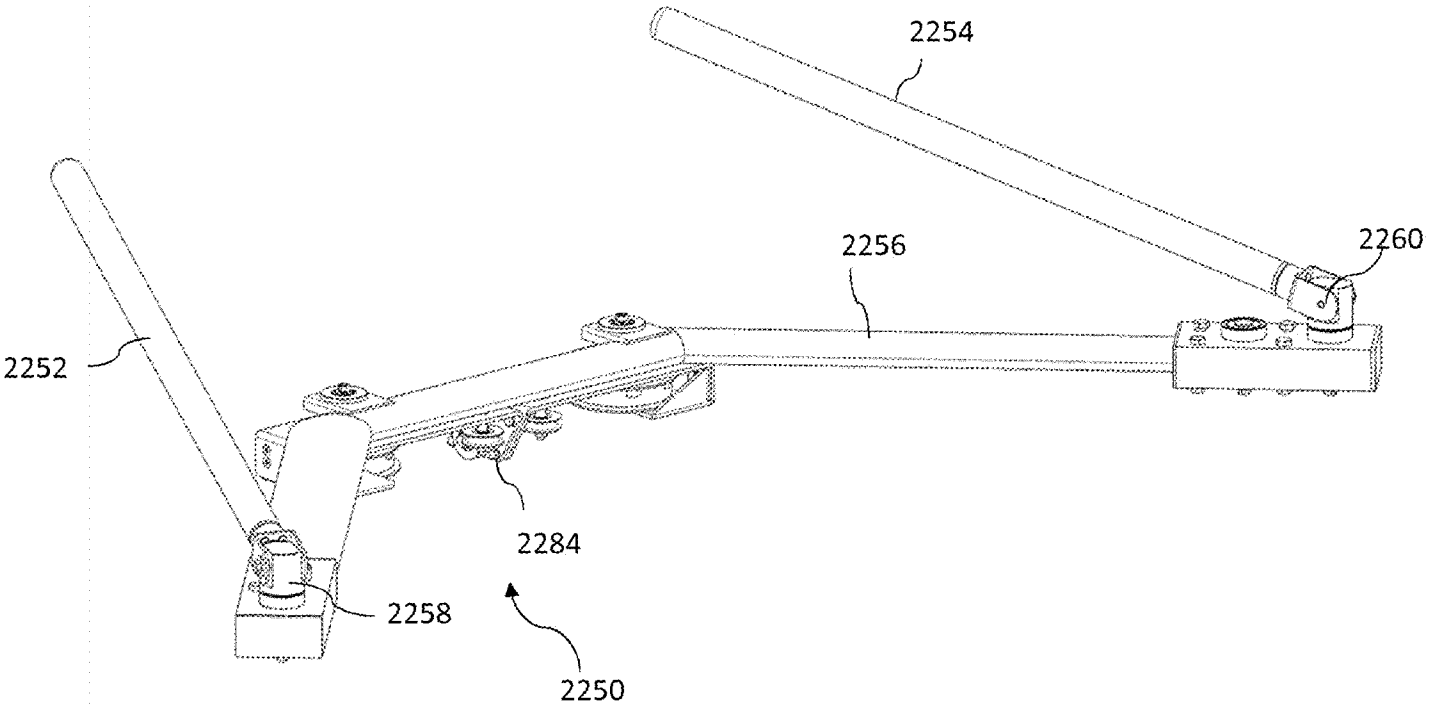

The rigger assembly is shown in more detail in FIGS. 23A and 23B. In embodiments the handles 2252 and 2254 may be extendable to adjust their length. Cross member 2256 may be formed in one piece or may be formed from a number of pieces attached together. The rigger assembly 2250 further comprises a bracket 2284 for attaching the rigger assembly to the foot carriage 2232 (see FIG. 22A). The oars 2252 and 2254 are attached to the wing rigger 2256 with 3-axis pivots 2258 and 2260 respectively.

Figure 24A:
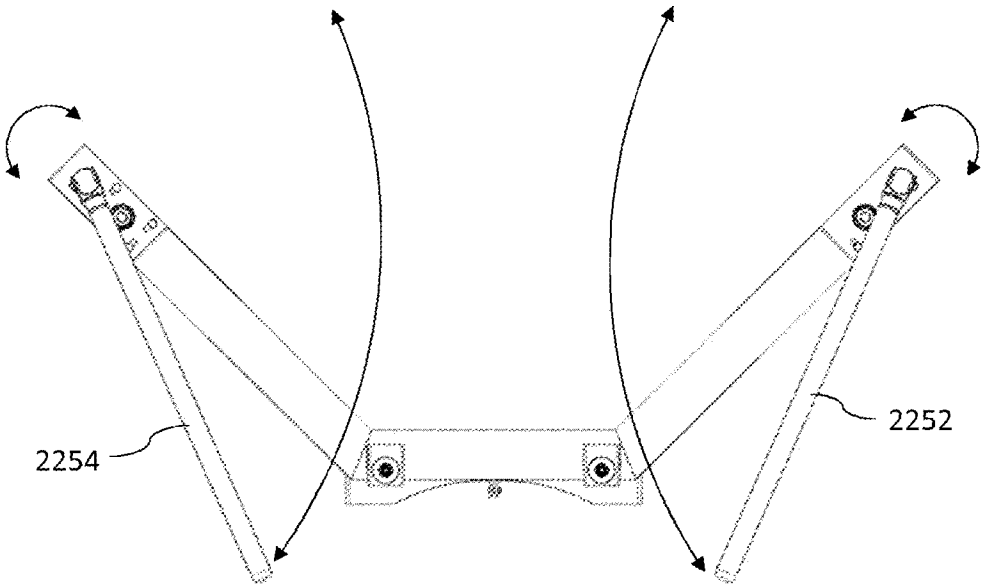
Figure 24B:
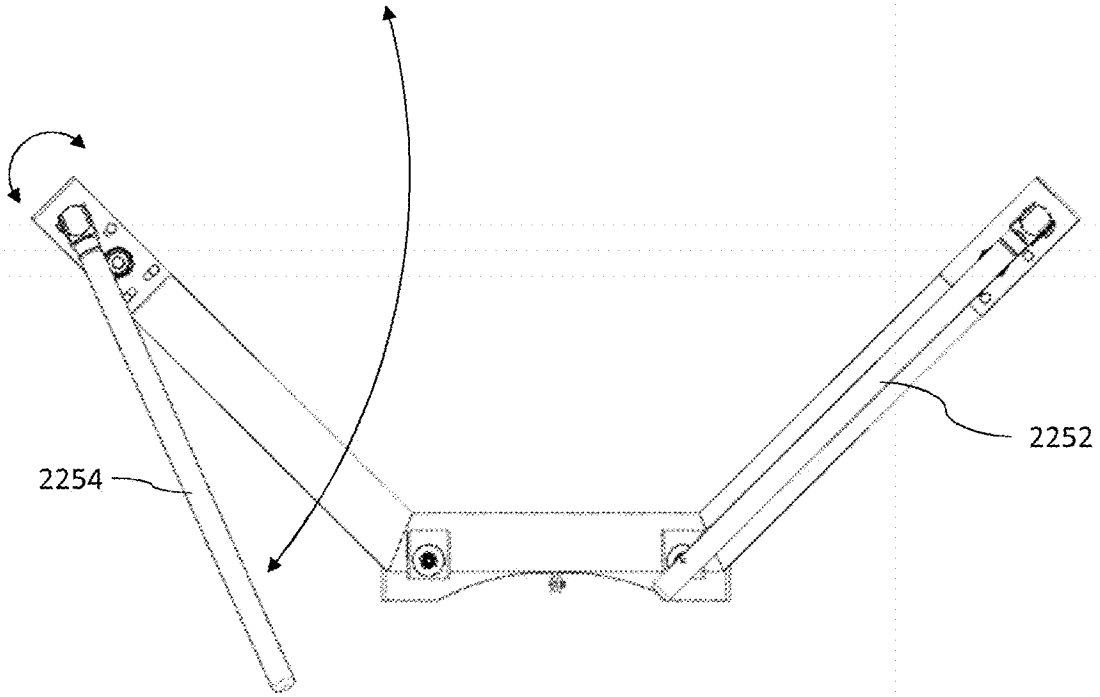

FIG. 24A shows the oar members 2252 and 2254 in a sculling configuration. FIG. 248 shows that one of the handles can be stored in a holster mounted on the wing rigger during a sweep rowing configuration. In this embodiment the oar member 2252 has been stowed away and the oar member 2254 is in operation for sweep rowing. It will of course be appreciated that the oar member 2254 can be stored in a respective holster, and the oar member 2252 can be used for sweep rowing on the other side. Although not shown in the Figures, optional counterbalance weights can be added to one or both sides of the wing rigger for use during individual sweep rowing. As previously discussed, the handles 2252 and 2254 may be extendable to adjust their length for the different configurations.

Figure 25:
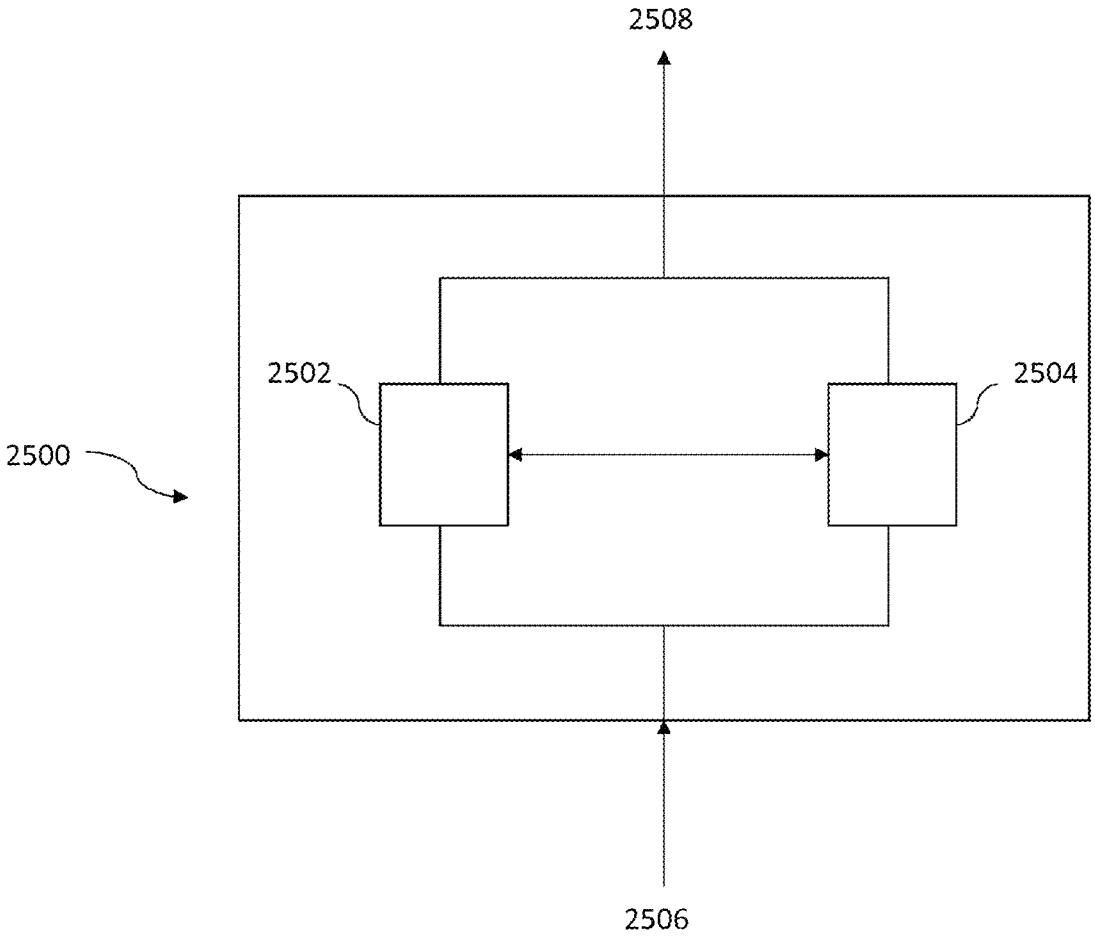
FIG. 25 shows computer hardware of a rowing machine, according to an embodiment.

As previously discussed, the rowing machine may be provided with a display or a docking unit to enable a display to be mounted therein (such as a user's smartphone or tablet etc.). In some embodiments the rowing machine is provided with computer hardware as shown schematically in FIG. 25. The computer hardware shown generally at 2500 comprises one or more memories 2502 connected to one or more processors 2504. The processor 2504 may be configured to receive input information on line 2506 for example in the form of electrical impulses. These electrical impulses may be representative of movement of the seat portion and/or handle and/or foot plate assembly. The processor can interpret these electrical impulses to determine information such as force applied, stroke length, stroke rate etc. This information may be stored in memory 2502. Information may then be output on line 2508. This output information may be output to an integrated display of the rowing machine, or to an output such as a smartphone and/or tablet etc. In other embodiments the rowing machine may simply provide electrical signals which can be interpreted by computer hardware on an attached computing apparatus (such as smartphone or tablet), in which case the rowing machine does not require its own hardware (or only sufficient hardware to create and transmit the electrical signals).

Figure 26:
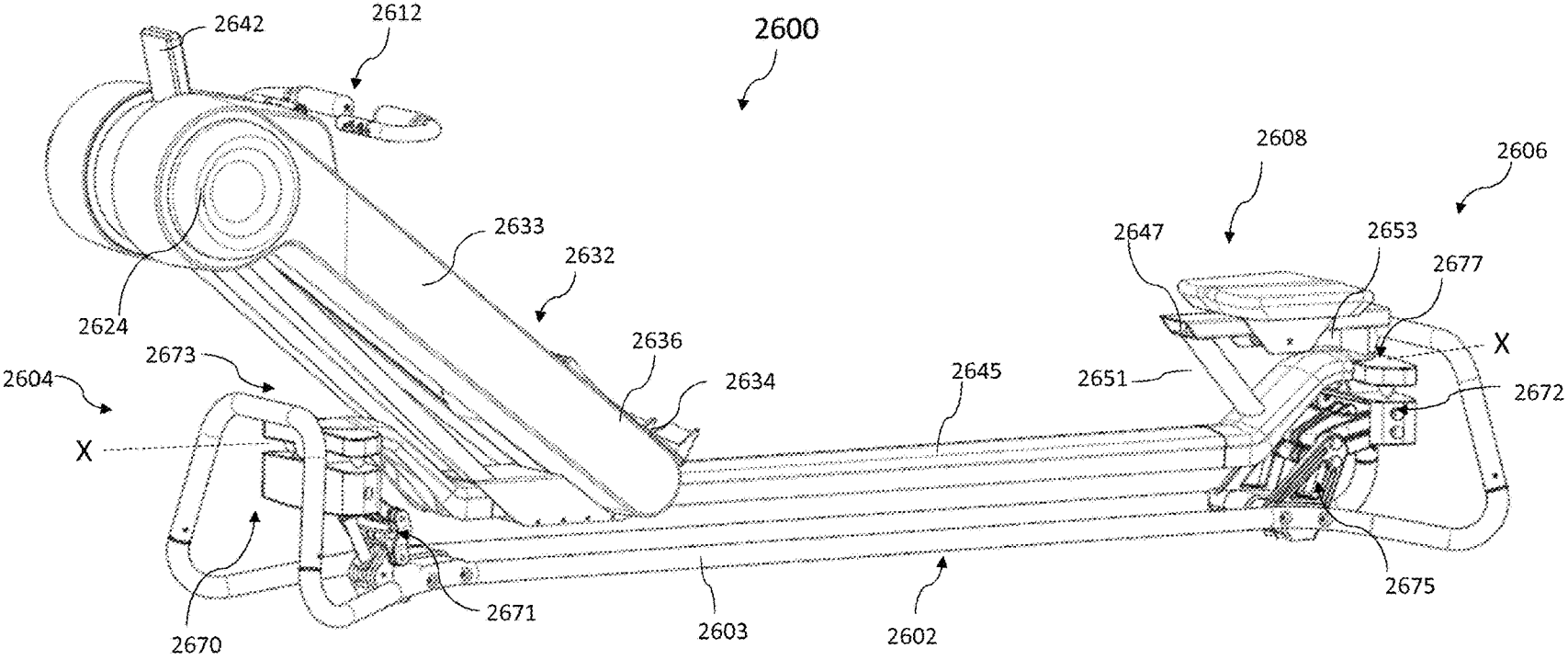
FIG. 26 is an isometric view of a rowing machine according to an embodiment.

Some further embodiments will now be described with respect to FIGS. 26 to 35. FIG. 26 shows a rowing machine 2600 according to an embodiment. The rowing machine comprises a main body portion 2602 which extends in a longitudinal direction i.e. in a direction parallel to the axis X-X in FIG. 26. The rowing machine comprises a first or front end or portion 2604 and a second or rear end or portion 2606. In this embodiment the main body portion 2602 comprises a chassis. In this embodiment the chassis comprises a tubular chassis. For example the tubular chassis comprises one or more tube portions joined together, for example including tubular portion 2603. The tubular chassis may be formed from any number of portions. The separate portions may be joined together in any way. For example the tubular portions may be a friction fit within each other. Alternatively and/or additionally the tubular portions may be secured using different fixing means. For example the further fixing means may include screws, nuts, bolts, adhesive, welding etc. In the example of FIG. 26 the rowing machine chassis comprises a generally straight portion (e.g. portion 2603) positioned between tubular portions at the ends 2604 and 2606 which curve upwardly relative to portion 2603. The tubular chassis is lightweight and provides a relatively high strength to weight ratio. The tubular chassis is also easy to assemble and disassemble. In some embodiments one or more fairings or coverings can be provided to cover or partially cover the chassis. Such fairing(s) may be made of plastic, for example. Alternatively, and as shown in FIG. 26, the chassis may be exposed.

A beam portion or rail portion 2645 is suspended between the first (front) end 2604 and the second (rear) end 2606 of the rowing machine 2600. A first mechanism shown generally at 2670 is provided at the front portion 2604 of the rowing machine, and a second mechanism shown generally at 2672 is shown at the rear portion 2606 of the rowing machine. The first mechanism 2670 may be considered a first suspension mechanism. The second mechanism 2672 may be considered a second suspension mechanism. Each suspension mechanism can enable the rail 2645 to pitch and/or roll relative to the longitudinal axis X-X. The beam or rail 2645 is suspended between the front suspension mechanism 2670 and the rear suspension mechanism 2672. As previously described, each of the suspension mechanisms 2670 and 2672 enables pitching and/or rolling of the rail 2645 relative to the longitudinal axis X-X of the rowing machine, so as to give a user of the rowing machine a floating sensation. The suspension mechanism 2670 comprises a shock absorber portion shown generally at 2671. The suspension mechanism 2670 also comprises a rolling mechanism shown generally at 2673. The suspension mechanism 2672 comprises a shock absorber portion showed generally at 2675. Suspension mechanism 2672 also comprises a rolling mechanism shown generally at 2677. Generally speaking the shock absorber portions enable the pitching motion of the rail 2645. The rolling mechanisms enable the rolling of the rail 2645.

Figure 27:
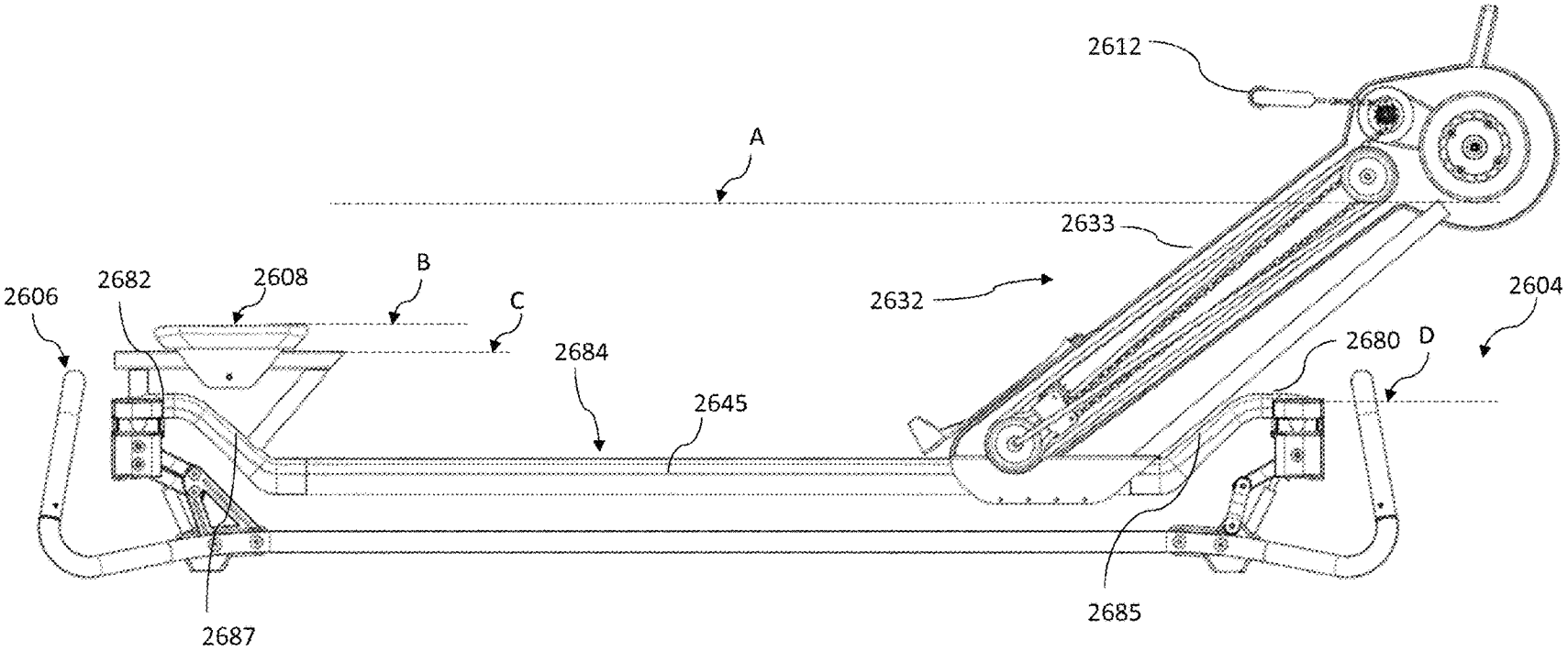
FIG. 27 is a side view of a rowing machine according to an embodiment.

The rail 2645 may be of unitary construction. Alternatively the rail 2645 may be formed of two or more pieces joined together. In this embodiment the rail 2645 has a U-shaped or troughed profile. As best shown in FIG. 27 the rail 2645 comprises first or front portion or end 2680, and a rear or second portion or end 2682. Between the front end 2680 and the second end 2682 there is a valley or trough portion shown generally at 2684. The trough portion 2684 is connected to the front end 2680 via ramp portion 2685. The trough portion 2684 is connected to the rear portion 2682 via ramp portion 2687. In one embodiment the rail 2645 is formed of three separate components which are then joined together to form the rail. For example the middle portion of the rail which ultimately forms the trough portion 2684 may be joined to end portions 2680 and 2682. Different parts of the rail 2645 may be made of different materials. For example each of portions 2680, 2682 and 2684 may be made of metal or plastic. In one embodiment the trough portion 2684 is made of metal and each of the end portions 2680 and 2682 are made of plastic.

As shown in FIGS. 26 and 27 the rowing machine 2600 further comprises an integrated footplate and flywheel assembly shown generally at 2632. The footplate comprises first and second foot plates 2634 and 2636. Straps or some other form of clip means may be provided so that a user can securely attach their feet to the footplates 2634 and 2636. The combined footplate and flywheel assembly 2632 comprises a main body portion 2633. The main body portion 2633 is angled relative to the trough portion of the rail 2645. For example the main body portion 2633 may be angled between 30° and 60° to the horizontal. Preferably this angle is 45° or is about 45°. As discussed further below the main body portion 2633 encloses a chain take-up mechanism of the flywheel drive mechanism. In this embodiment the footplate and flywheel assembly 2632 is slideably movable back and forth on rail 2645 in a direction parallel to axis X-X.

The flywheel is shown generally at 2624 in FIG. 26. Handle portion 2612 is operatively connected to flywheel 2624. This is discussed in more detail further below, for example with respect to FIG. 34.

Also shown is a user interface 2642. This may be similar to or the same as the user interface 242 shown in FIG. 2A, and explained further in FIGS. 6A to 6D.

A seat portion is shown generally at 2608. The seat portion 2608 is slidably mounted on a rail 2647. The rail 2647 is attached to rail assembly 2645 via stanchions 2651 and 2653. The seat portion 2608 can slide back and forth along rail 2647 in a direction parallel to longitudinal axis X-X. Therefore in this embodiment the rail 2647 on which the seat portion 2608 slides is separate from the rails 2645 on which the footplate and flywheel assembly 2632 slides. That is the seat rail 2647 is mounted to the main rail or beam 2645. It will be understood that this arrangement may also be applied to any of the other embodiments described herein.

In FIG. 27 the integrated foot plate and flywheel assembly 2632 is shown with its outer cover removed. Accordingly the flywheel and chain take up mechanism can be seen in more detail. This is described further below with respect to FIG. 34. In embodiments the flywheel comprises a number of vanes which provide air-resistance while the flywheel rotates. In FIG. 27 dashed line A represents the lowermost position of the outer tips of the vanes, or in other words the outer radius of the vanes. In other words the dashed line A shows the lowest point that the tips of the vanes reach. It is to be noted that the tips of the vanes do not extend below a top surface of the seat portion 2608 (represented by dashed line B), or below a top surface of the seat rail 2647 (represented by dashed line C), or below a top surface of the rail 2645 (represented by dashed line D). That is a compact flywheel is provided. Mounting the flywheel in this manner helps to reduce the overall size of the footplate and flywheel assembly 2632. Positioning the flywheel in an offset manner (i.e. above the footplates 2634 and 2636) allows the width of the combined footplate and flywheel assembly to be reduced whilst also freeing up space within the chain take up mechanism 3430, which allows for a greater distance of travel for the chain 3422, chain anchor 3444 and bungee cord 3448 (see description below with respect to FIG. 34). Additionally, the ergonomic positioning allows for the user to easily reach the adjustable controls on the flywheel assembly. These controls increase or decrease air flow through the flywheel assembly, increasing or decreasing the air resistance respectively and therefore adjusting the speed at which the flywheel decelerates after the drive phase—also known as 'drag'.

Figure 28:
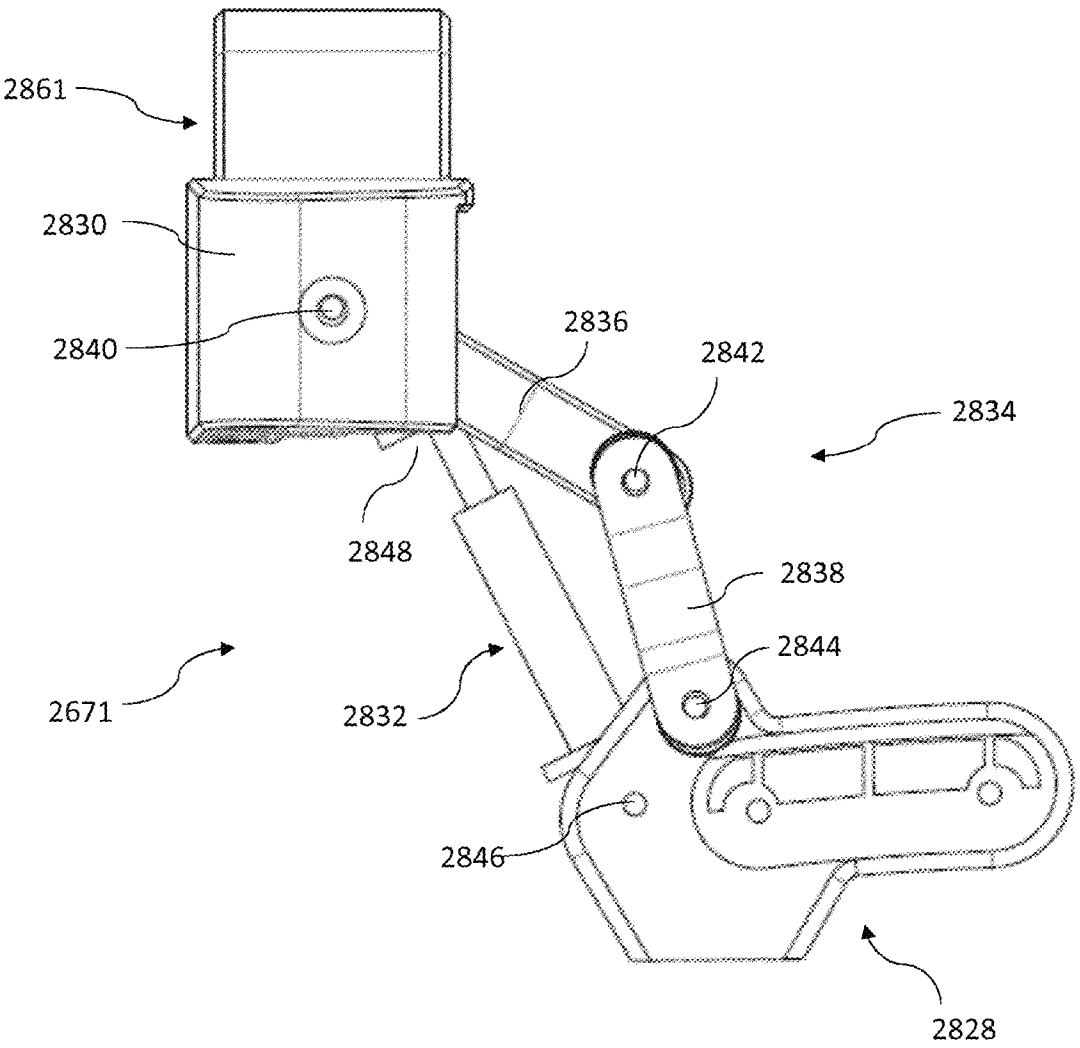
FIG. 28 is a side view of a front shock absorber mechanism according to an embodiment in a first configuration.

FIG. 28 shows the front shock absorber assembly 2671 in more detail. The front shock absorber 2671 comprises a damper 2832. The damper may be any kind of damper. For example the damper may be a spring, a hydraulic damper, a pneumatic damper, or a magnetorheological damper. The shock absorber comprises a block 2828 for enabling the shock absorber to be mounted to the main body portion 2602 of the rowing machine 2600. A linkage mechanism 2834 comprises a first link 2836 and a second link 2838. A bearing block for the rolling mechanism is shown at 2861. Bearing block 2861 is mounted on bracket 2830. Link arm 2838 is connected to block 2828 via shaft 2844. Link arm 2838 is connected to link arm 2836 via shaft 2842. Link arm 2836 is connected to bracket 2830 via shaft 2840. The first end of the damper is connected to block 2828 via shaft 2846. A second end 2848 of the damper is attached to bracket 2830. All of the fixing points are free to pivot about their respective shafts to enable the arms 2838 and 2836 to move in a scissor action. This also enables the assembly (e.g. the bracket 2830 and bearing block 2861) to move up and down as a user's weight and/or force is transferred during use. In some embodiments the damper 2832 is adjustable. That is the damper can be adjusted between softer and firmer modes.

In FIG. 28 the damper 2832 is in an at least partially extended state. This may occur when little or no weight or force is applied to the damper 2832.

Figure 29:
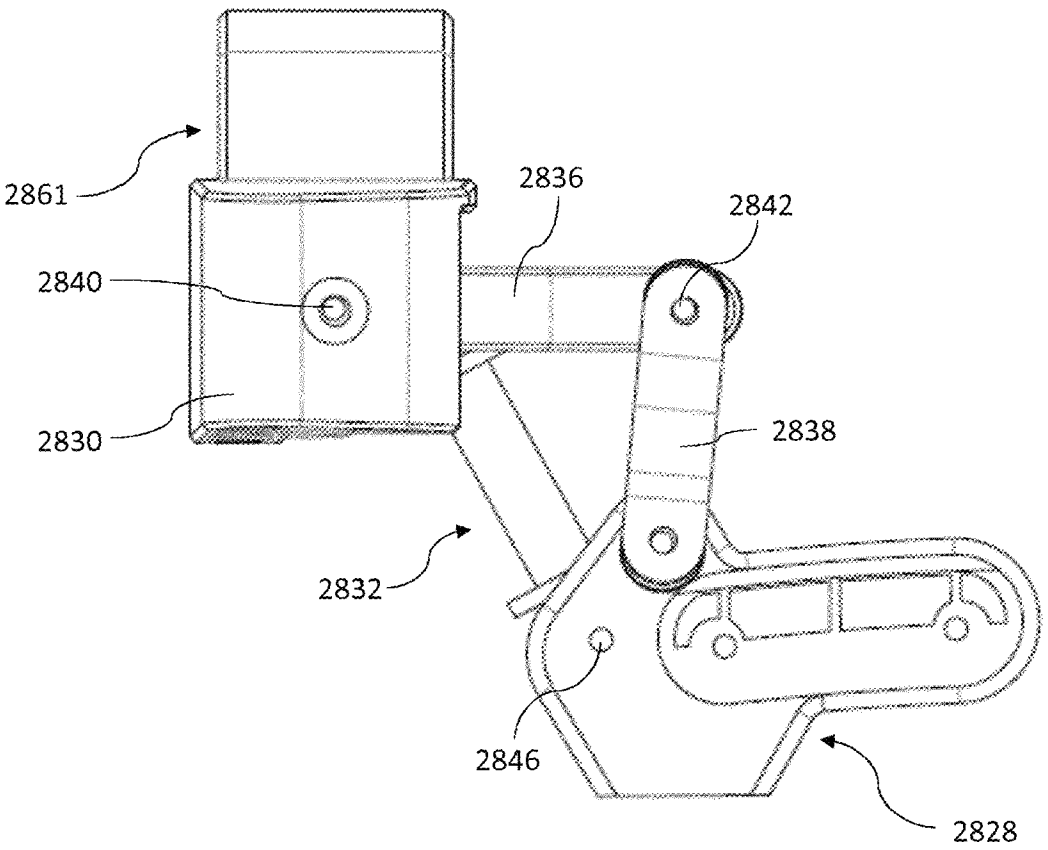
FIG. 29 is a side view of the shock absorber of FIG. 28 in a second configuration.

FIG. 29 shows the damper 2832 when in a compressed state. The damper 2832 may be in this state when a user's weight and/or force is applied.

Figure 30:
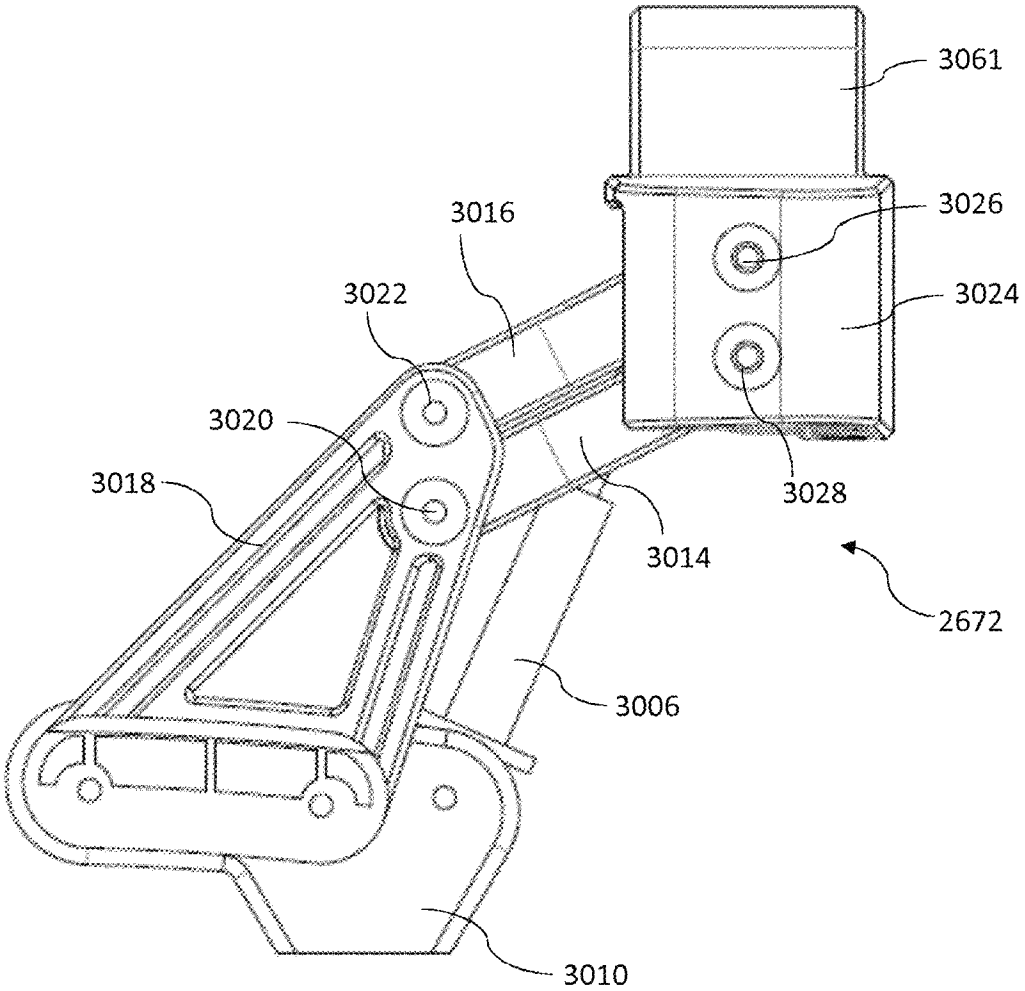
FIG. 30 is a side view of a rear shock absorber mechanism according to an embodiment in a first configuration.
Figure 31:
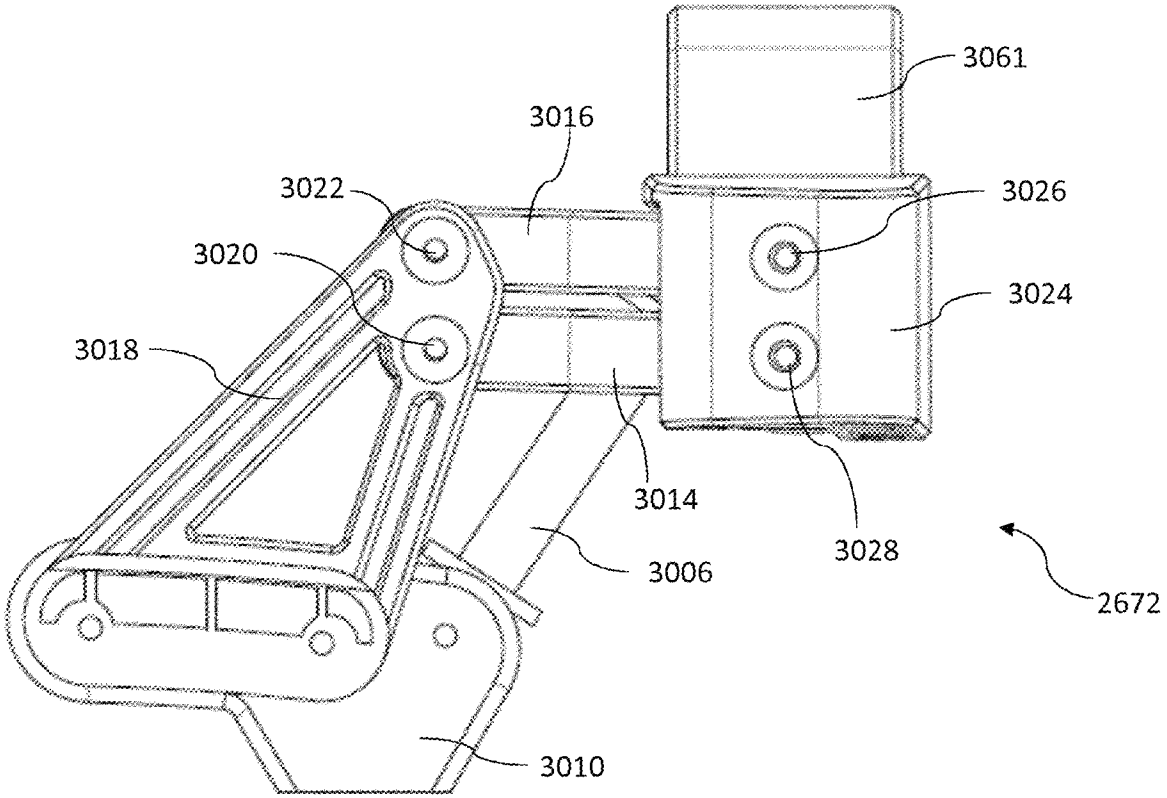
FIG. 31 is a side view of the shock absorber of FIG. 30 in a second configuration.

The rear shock absorber mechanism 2672 is shown in more detail in FIGS. 30 and 31. The rear damper mechanism 2672 comprises a damper 3006. Similar to the front shock absorber mechanism, this damper may be any kind of damper. For example it may be a spring, a pneumatic damper, a hydraulic damper, or a magnetorheological damper. A rolling mechanism bearing block 3061 is attached to bracket 3024. A block 3010 enables the rear shock absorber to be attached to the main body portion 2602 of the rowing machine. A connection bracket 3018 is provided. Linkage arms 3014 and 3016 link the bracket 3018 to the bracket 3024. By virtue of shafts 3020 and 3022 connecting the linkage arms 3014 and 3016 to the bracket 3018 respectively, and the shafts 3026 and 3028 connecting the linkage arms 3014 and 3016 to the bracket 3024 respectively, the bracket 3024 (to which the rolling mechanism bearing block 3061 is attached) can rotate about the bracket 3018. This enables the bracket 3024 to move up and down when viewing FIG. 30. This movement is damped by virtue of the damper 3006.

FIG. 30 shows the damper 3006 in an at least partially extended state. This may be where little or no force is applied to the damper by a user.

FIG. 31 shows the damper 3006 in a compressed state i.e. where a weight or force is applied to the shock absorber, thus compressing the damper 3006.

A comparison of FIGS. 30 and 31 shows that the linkage arms 3014 and 3016 have rotated clockwise between FIG. 30 and FIG. 31, and the rolling mechanism bearing block 3061 is vertically lower in FIG. 31 than in FIG. 30.

It will be understood that as FIGS. 29 to 31 are in side profile that the same or similar components may also be provided to those shown, on the other side of the mechanisms described. This can be appreciated from the isometric view in FIG. 26.

Figure 32:
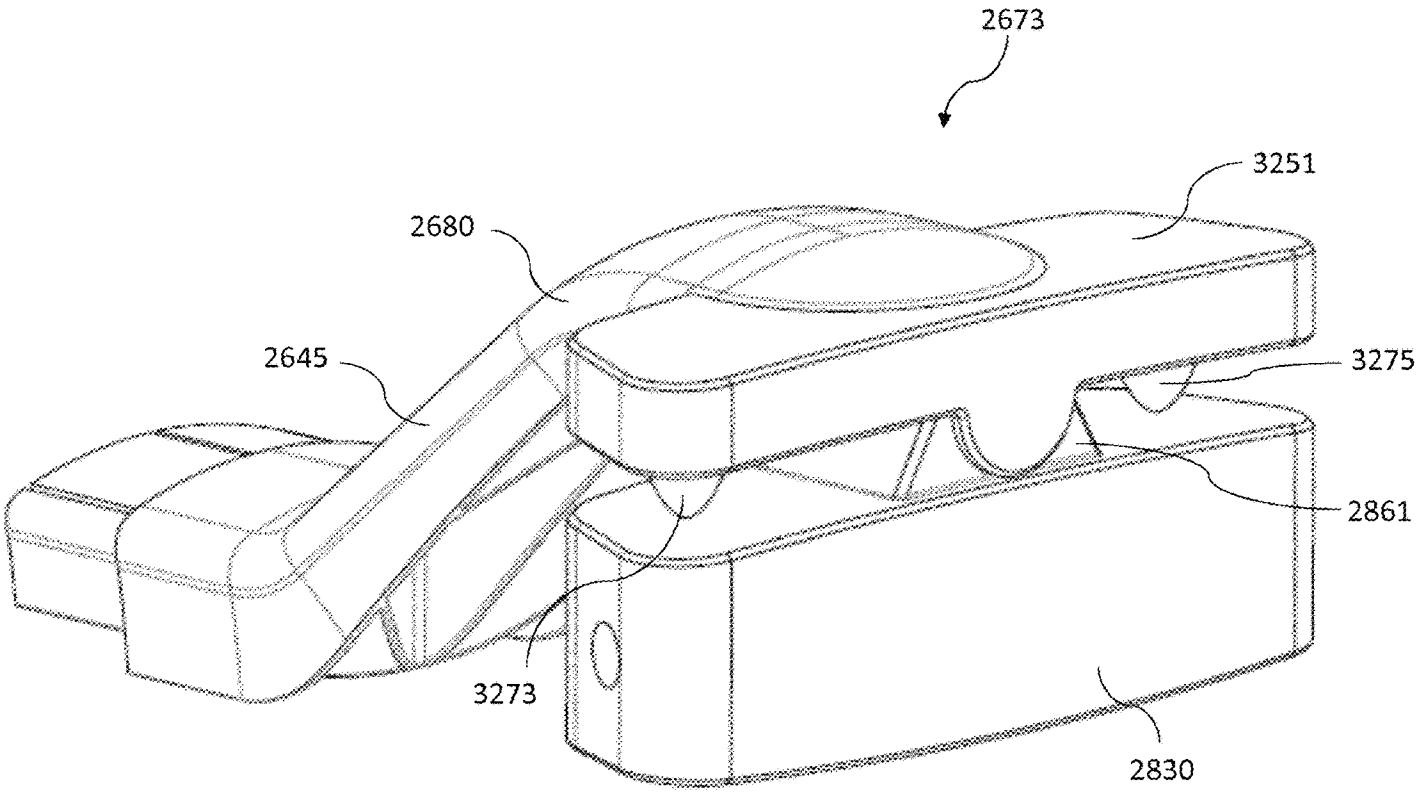
FIG. 32 is an isometric view of a rolling mechanism according to an embodiment in a first configuration.
Figure 33:
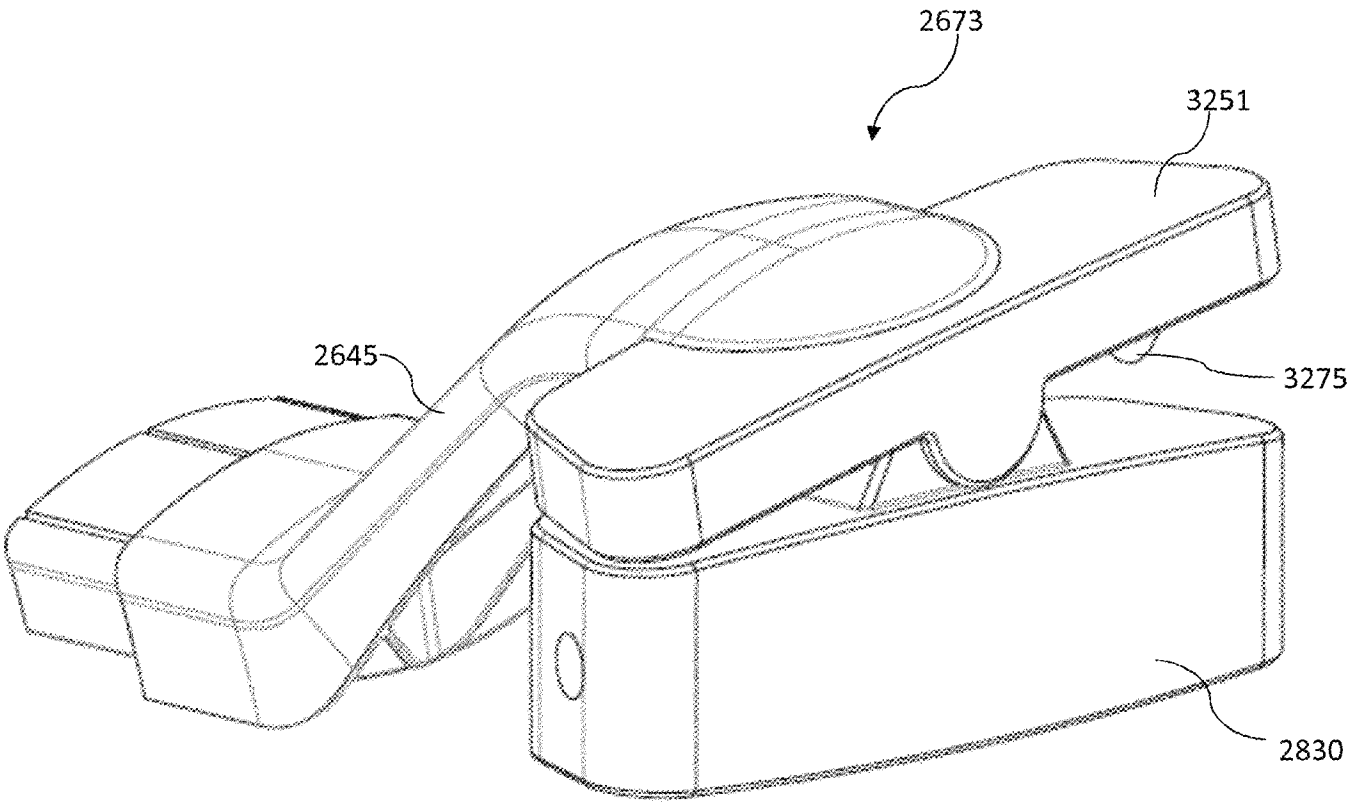
FIG. 33 is an isometric view of the rolling mechanism of FIG. 32 in a second configuration.

FIGS. 32 and 33 show the roll mechanism. In some embodiments, substantially the same mechanism can be used at the front and rear of the rowing machine to provide the rolling functionality. For conciseness the front rolling mechanism is described here, but it will be understood that the rear roll mechanism can operate in fundamentally the same way (although slight alterations may be required for correct fitting etc.).

FIG. 32 shows bracket 2830 to which rolling mechanism bearing block 2861 is mounted. Bearing block 2861 may be integrally formed with bracket 2830, or alternatively they may be two separate components which are attached together by any suitable form of bonding. A connection bracket or roll bracket 3251 operatively connects the rail 2645 to the bearing block 2861. The bracket 3251 may be integrally formed with the rail 2645 (or more particularly to end 2680 of rail 2645). In another embodiment the bracket 3251 and rail 2645 (or end 2680) may be two separate components which are joined together. In plan view the bracket 3251 and rail 2645 form a T shape. In the embodiment shown a shaft (or any other kind of circular protrusion) of the roller bracket 3251 engages in a circular hole in the block 2861, the shaft being able to rotate within the hole so as to impart a rolling motion to the bracket 3251 and consequently to the rail 2645. Dampers or bump stops 3273 and 3275 are provided. The bump stops may be made of rubber or any other suitable resilient material. The bump stops act to damp the rotation of the bracket 3251 and rail 2645, so as to impart a smooth rolling motion thereto. It will of course be understood that alternatively the bump stops could be provided on the block 2830 rather than on the bracket 3251. FIG. 32 shows the bracket 3251 and rail 2645 in a rest position i.e. with 0° of rotation.

FIG. 33 shows the rolling mechanism 2673 when a degree of roll is imparted to the roll bracket 3251 and accordingly rail 2645. In this embodiment the bracket 3251 has rolled in a counter clockwise direction in comparison with FIG. 32. The bracket 2830 acts to limit the degree of rotation available to the roll bracket 3251. It will of course be understood that the roll bracket 3251 and consequently rail 2645 can roll to any degree of rotation between 0° and a maximum degree of rotation. In some embodiments the rolling mechanism is configured to provide a maximum degree of roll of 10°. In some embodiments the rolling mechanism is configured to provide a maximum degree of roll of 20°. As discussed above the rear rolling mechanism may operate in the same or a similar fashion.

Figure 34:
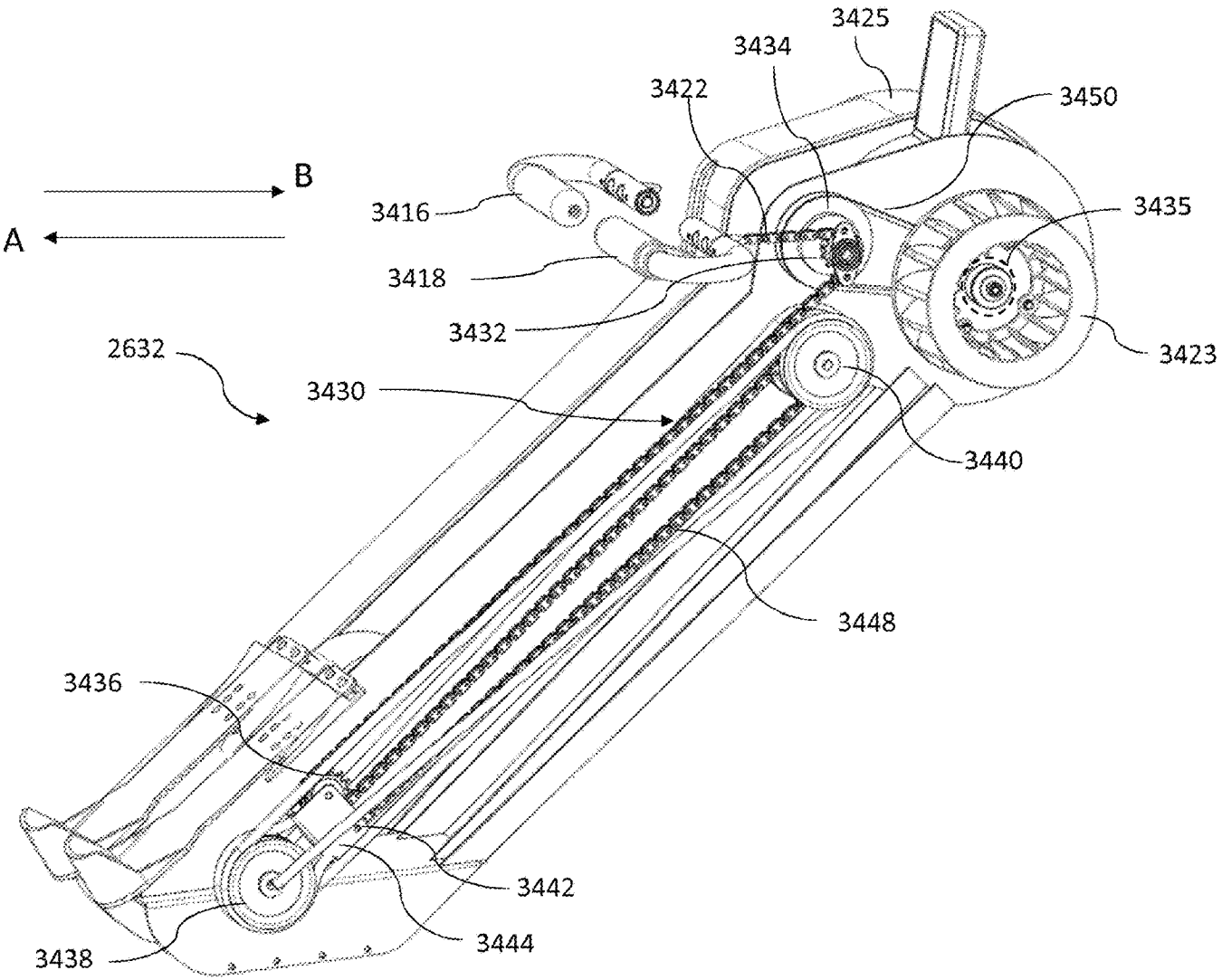
FIG. 34 is an isometric view of a footplate and flywheel assembly according to an embodiment.

The combined foot plate and flywheel assembly 2632 is shown in more detail in FIG. 34. More particularly this Figure shows the drive mechanism for driving the resistance mechanism. In this embodiment the resistance mechanism comprises a flywheel. In FIG. 34 the resistance mechanism comprises two flywheels, right-hand flywheel 3423 which is driven by pulling on handle 3418, and a second, left-hand flywheel 3425 can be driven by pulling on handle 3416. In other embodiments a single flywheel is provided. In this embodiment two handles 3416 and 3418 are shown. These handles can be joined together to effectively provide a single handle portion. Alternatively a single handle of unitary construction may be provided. The number of handles and number of flywheels can be combined in any way. For example a single handle can be used to drive a dual flywheel set-up or to drive a single flywheel set-up. Likewise a two-handle set-up can be used to drive a single flywheel or a dual flywheel. Various flywheel positions can be provided. In the embodiment of FIG. 34 the flywheels are offset to the sides of the assembly 2632. Alternatively the flywheels can be more centrally located within the assembly 2632. Where there is a single flywheel this may be centrally located within the assembly 2632. In general a handle portion is operatively connected to a resistance mechanism by means of a drive connection.

In FIG. 34, the drive connection includes a chain 3422. A chain take up mechanism shown generally at 3430 is provided to take up or let out the chain as required as the user pulls the handle back and forth during a rowing motion. The chain 3422 passes over a first sprocket 3432 on drive pulley 3434. The chain then passes down chain take up mechanism 3430 and is taken up on idler sprocket 3436 which is in the proximity of the first bungee idler pulleys 3438. The chain 3422 then passes back over an idler sprocket, located in between second bungee idler pulleys 3440 for connection to an anchor point 3442 in a travelling chain-anchor 3444. In some embodiments two bungee idler pulleys are provided at the bottom, either side of the chain, and two bungee idler pulleys are provided at the top, either side of the chain. The idler sprocket 3436 is also mounted in anchor 3444. As a user pulls the handle 3418 towards themselves (i.e. in the direction of arrow A when viewing FIG. 34) then the chain 3422 is caused to be drawn out of the chain take up mechanism 3430. This effectively shortens the length of chain within the chain take up mechanism 3430. This also causes the anchor 3444 to move within chain take up mechanism 3430 towards idler pulleys 3440. In some embodiments the anchor 3444 travels approximately a third of the distance that the handle is moved. A bungee cord or cords 3448 passes between the idler pulley sets 3438 and 3440, and the bungee cord is also attached to anchor 3444. The bungee cord 3448 acts to bias the anchor 3444 towards idler pulley 3438. This causes or assists the chain to be drawn back into the chain take up mechanism 3430 when the user is on the return phase i.e. returning the handle towards the front of the rowing machine, in the direction of arrow B when viewing FIG. 34.

Rotational motion of the drive pulley 3434 is transferred to a second pulley 3435 (shown in phantom in FIG. 34), when a user pulls the handle in the direction of arrow A. A hub of the flywheel 3423 is mounted to the pulley 3435, such that movement of pulley 3435 is transferred to flywheel 3423. Drive is transferred from the first pulley 3434 to the second pulley 3435 via a drive means, in this embodiment a belt 3450. In this embodiment the belt 3450 is a toothed belt. In other embodiments a chain or any other means for transferring the drive can be used. In at least some embodiments, the drive mechanism for transferring drive from the handle to the resistance mechanism (e.g. flywheel) comprises a step-up gear mechanism. In the embodiment of FIG. 34 the second pulley 3435 is smaller in diameter than the first pulley 3434. Therefore rotational speed of the second pulley 3435 (and consequently the flywheel 3423) is greater than the rotational speed of the first pulley 3434. In other words the number of revolutions per minute of the second pulley 3435 (and consequently flywheel 3423) is greater than the number of revolutions per minute of the first pulley 3434. This speeding up of the flywheel means that greater air-resistance can be provided for a given radius of flywheel. Therefore the step-up gearing enables a relatively smaller flywheel to be used than if no gearing or if step-down gearing was used. This provides a compact and light weight flywheel assembly.

One or more clutches may also be provided in the resistance and/or chain take-up mechanisms. For example a clutch may be provided to effectively disconnect the operative connection between the handles and resistance mechanism when the handles are being returned in the direction of arrow B. For example a one-way clutch may be provided between the gear 3432 and pulley 3434. Thus, when the handles are drawn in the direction of arrow A the gear 3432 rotates anti-clockwise, and the clutch engages which in turn causes the pulley 3434 to be rotated in an anti-clockwise direction. Accordingly rotational drive is also imparted to the flywheel. When the handles are moved in the direction of arrow B, the gear 3432 is caused to rotate in a clockwise direction, and the clutch disengages such that rotational drive is not imparted to the pulley 3434. Accordingly rotational drive is not imparted to flywheel 3423 either, although the flywheel may continue to spin freely as a result of momentum of an earlier drive phase. The one-way clutch may also be provided elsewhere within the drive train. In some embodiments the one way clutch is mounted within the hub in flywheel 3423, allowing only the flywheel to maintain rotational momentum following the drive phase. Positioning the one way clutch within the flywheel 3423 reduces the overall size of the resistance mechanism 2632, whilst also potentially reducing noise created by the drive mechanism.

In further embodiments different rigging assemblies can be applied to the embodiments of FIGS. 26 to 34. For example a rigging assembly comprising oar members, for example as per FIG. 22*a* can be applied. The rowing machine of FIG. 26 can also be connected in series to provide a rowing machine system as shown for example in FIG. 5*a*.

Figure 35:
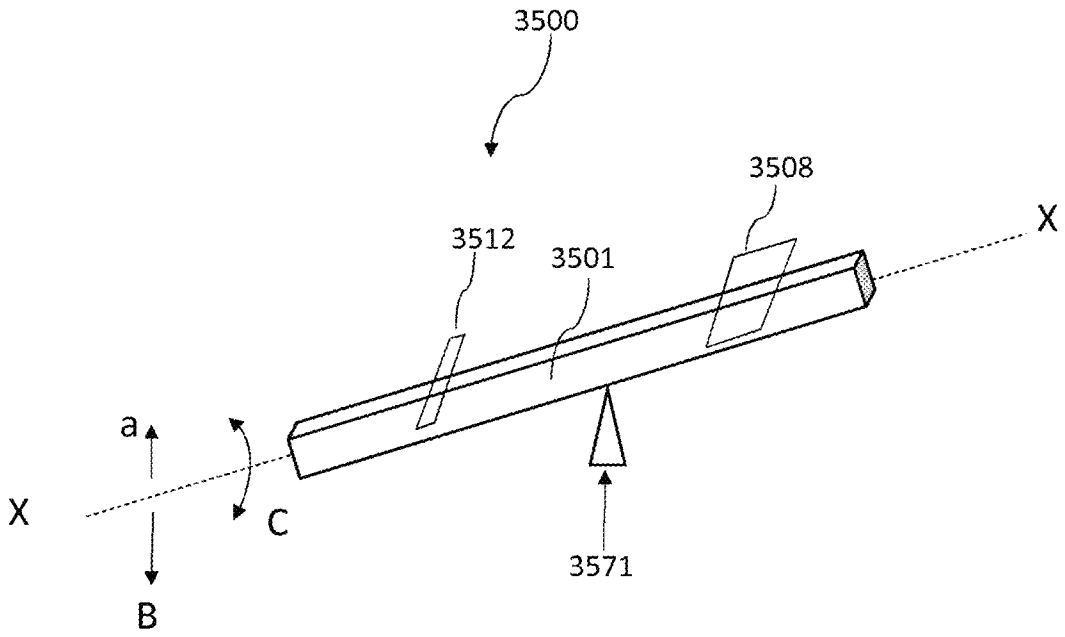
FIG. 35 is a schematic view of a rowing machine according to an embodiment.

FIG. 35 is a schematic isometric view illustrating an overview of a rowing machine 3500 according to some embodiments. The rowing machine 3500 comprises a main body portion 3501. The main body portion extends along a longitudinal axis X-X. The rowing machine 3500 also comprises a seat portion 3508 and a handle portion 3512. The seat portion 3508 and handle portion 3512 are configured to enable a user to simulate a rowing motion during use of the rowing machine. At least one mechanism 3571 is provided. The at least one mechanism 3571 is configured for transferring a pitching motion to a user relative to said longitudinal axis, during use of the rowing machine.

The pitching (or tilting) motion is represented in FIG. 35 by arrows A (upwardly) and B (downwardly). In some embodiments the at least one mechanism 3571 is also configured for transferring a rolling motion to a user relative to said longitudinal axis, during use of said rowing machine. The rolling motion is represented by arrow C in FIG. 35.

It will therefore be understood that the invention is not limited to a particular positioning of the pitching and/or rolling mechanisms on the rowing machine. Although the embodiments described in detail have generally shown mechanisms at either end of the rowing machine, this is by way of example and in other embodiments the at least one mechanism can be positioned elsewhere, for example between the ends of the rowing machine.

It is also noted herein that while the above describes exemplifying embodiments of the invention, there are several variations and modifications which may be made to the disclosed solution without departing from the scope of the present invention. Except where explicitly stated otherwise, features of the various described embodiments may be combined in any way.

The invention claimed is:

1. A rowing machine comprising:

a main body portion extending along a longitudinal axis from a first end of the rowing machine to a second end of the rowing machine;

a rail portion suspended between the first end of the rowing machine and the second end of the rowing machine;

a seat portion;

a handle portion;

the seat portion and the handle portion configured to enable a user to simulate a rowing motion during use of the rowing machine; and wherein the rowing machine comprises at least one mechanism configured for transferring a pitching motion and a rolling motion to said rail portion so as to transfer said pitching motion and said rolling motion to the user relative to said longitudinal axis, in response to movement of the user during use of the rowing machine, the at least one mechanism comprising a first pitching mechanism and a first rolling mechanism at the first end of the rowing machine proximate to a first end of said rail portion, and a second pitching mechanism and a second rolling mechanism at the second end of the rowing machine proximate to a second end of said rail portion, the first pitching mechanism and the second pitching mechanism arranged for independent vertical movement of the first and second ends of said rail portion relative to said longitudinal axis of the rowing machine, and the first rolling mechanism and the second rolling mechanism arranged for rotational movement of the rail portion about said longitudinal axis, wherein each of said first and second rolling mechanisms comprises a rotatable bearing assembly.

2. The rowing machine of claim 1, wherein each of said first and second pitching mechanisms comprises a spring or a damper arrangement.

3. The rowing machine of claim 1, wherein each of said first and second rolling mechanisms comprises a damping mechanism to dampen or limit rolling, and wherein said damping mechanism of each rolling mechanism comprises one or more resilient bump-stops.

4. The rowing machine of claim 1, the first end of said rail portion configured to be mounted proximate to the first end of the rowing machine, and the second end of said rail portion configured to be mounted proximate to the second end of the rowing machine, said rail portion comprising a trough portion between the first end of said rail portion and the second end of said rail portion.

5. The rowing machine of claim 1, said rail portion being suspended relative to said main body portion via said at least one mechanism.

6. The rowing machine of claim 1, wherein at least one of said seat portion and said handle portion are operatively connected to a resistance mechanism.

7. The rowing machine of claim 6, wherein said resistance mechanism comprises a flywheel having one or more vanes connected to a central shaft.

8. The rowing machine of claim 7, said handle portion being operatively connected to said flywheel via a gear mechanism.

9. The rowing machine of claim 8, said gear mechanism comprising a first gear and a second gear, and a drive connection between the first gear and the second gear, the first gear being driven by movement of the handle portion and the second gear being operatively connected to said central shaft of said flywheel, the second gear having a radius that is smaller than a radius of the first gear, such that a speed of rotation of the second gear and the flywheel is greater than a speed of rotation of the first gear, during use of the rowing machine.

10. The rowing machine of claim 7, a radius of said one or more vanes being less than a vertical distance between said central shaft and a top surface of said rail portion.

11. The rowing machine of claim 1, wherein said handle portion comprises at least one oar member, wherein said handle portion is interchangeable between a sweep configuration and a sculling configuration.

12. The rowing machine of claim 1, comprising a display configured to receive information from said at least one mechanism configured for transferring said pitching motion and said rolling motion to the user, and to display to the user presentation information relating to said information received from said at least one mechanism.

13. The rowing machine of claim 1, comprising a resistance mechanism comprising a first resistance mechanism and a second resistance mechanism, and said handle portion comprising a first handle portion and a second handle portion; said first handle portion being operatively connected to said first resistance mechanism, and said second handle portion being operatively connected to said second resistance mechanism.

14. The rowing machine of claim 13, a resistance of said resistance mechanism being adjustable.

15. The rowing machine of claim 14, wherein respective resistances of said first and second resistance mechanisms are independently adjustable.

16. The rowing machine of claim 13, wherein said first resistance mechanism comprises a first flywheel, and said second resistance mechanism comprises a second flywheel.

* * * * *